US011718947B2

(12) United States Patent
Park

(10) Patent No.: US 11,718,947 B2
(45) Date of Patent: Aug. 8, 2023

(54) LAUNDRY TREATMENT MACHINE

(71) Applicant: LG ELECTRONICS INC., Seoul (KR)

(72) Inventor: Junghyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 435 days.

(21) Appl. No.: 16/958,815

(22) PCT Filed: Dec. 28, 2018

(86) PCT No.: PCT/KR2018/016890
§ 371 (c)(1),
(2) Date: Jun. 29, 2020

(87) PCT Pub. No.: WO2019/132602
PCT Pub. Date: Jul. 4, 2019

(65) Prior Publication Data

US 2021/0071340 A1 Mar. 11, 2021

(30) Foreign Application Priority Data

Dec. 28, 2017 (KR) ..... 10-2017-0182267
Jan. 15, 2018 (KR) ..... 10-2018-0005233
May 10, 2018 (KR) ..... 10-2018-0053498

(51) Int. Cl.
*D06F 29/00* (2006.01)
*D06F 37/26* (2006.01)
(Continued)

(52) U.S. Cl.
CPC ..... *D06F 37/267* (2013.01); *D06F 37/26* (2013.01); *D06F 37/42* (2013.01); *D06F 34/20* (2020.02);
(Continued)

(58) Field of Classification Search
CPC ..... D06F 21/00; D06F 21/06; D06F 21/08; D06F 23/00; D06F 23/04; D06F 29/00;
(Continued)

(56) References Cited

U.S. PATENT DOCUMENTS

2015/0184326 A1* 7/2015 Seo ..... D06F 37/20 68/132

FOREIGN PATENT DOCUMENTS

CN 104805632 7/2015
CN 105316894 2/2016
(Continued)

OTHER PUBLICATIONS

Machine Translation of Kwon et al., WO2017217810A1, dated Dec. 2017. (Year: 2017).*
(Continued)

*Primary Examiner* — David G Cormier
(74) *Attorney, Agent, or Firm* — Fish & Richardson P.C.

(57) ABSTRACT

A laundry treatment machine includes a water tank, a first laundry tub to accommodate first laundry, a second laundry tub that accommodates second laundry, and a locker provided in the second laundry tub to fix the second laundry tub. The locker includes a locking member that is configured to move from a first position to a second position by a centrifugal force when the second laundry tub is rotated, and engages with the first laundry tub at the second position to fix the second laundry tub to the first laundry tube, and an elastic member which is elastically deformed when the locking member is located at the second position and is restored to an original shape to return the locking member to the first position when the rotation of the second laundry tub is stopped.

15 Claims, 36 Drawing Sheets

(51) Int. Cl.

| | |
|---|---|
| ***D06F 37/42*** | (2006.01) |
| *D06F 37/24* | (2006.01) |
| *D06F 39/12* | (2006.01) |
| *D06F 103/00* | (2020.01) |
| *D06F 105/52* | (2020.01) |
| *D06F 105/58* | (2020.01) |
| *D06F 34/20* | (2020.01) |
| *D06F 39/02* | (2006.01) |
| *D06F 39/08* | (2006.01) |

(52) U.S. Cl.
CPC ..... *D06F 37/24* (2013.01); *D06F 39/022* (2013.01); *D06F 39/08* (2013.01); *D06F 39/083* (2013.01); *D06F 39/12* (2013.01); *D06F 2103/00* (2020.02); *D06F 2105/52* (2020.02); *D06F 2105/58* (2020.02)

(58) Field of Classification Search
CPC ..... D06F 31/00; D06F 37/02; D06F 37/12; D06F 37/18; D06F 37/20; D06F 37/24
See application file for complete search history.

(56) References Cited

FOREIGN PATENT DOCUMENTS

| | | |
|---|---|---|
| KR | 1020030045447 | 6/2003 |
| KR | 1020150072169 | 6/2015 |
| KR | 1020150077059 | 7/2015 |
| KR | 1020150089344 | 8/2015 |
| KR | 1020150106680 | 9/2015 |
| WO | WO2016175557 | 11/2016 |
| WO | WO2017188754 | 11/2017 |
| WO | WO2017217810 | 12/2017 |

OTHER PUBLICATIONS

Office Action in Chinese Appln. No. 201880090338.7, dated Apr. 25, 2022, 17 pages (with English translation).
Australian Office Action in AU Appln. No. 2018395018, dated Mar. 23, 2021, 5 pages.
PCT International Search Report in International Appln. No. PCT/KR2018/016890, dated Apr. 24, 2019, 5 pages.

* cited by examiner

【Figure 1】
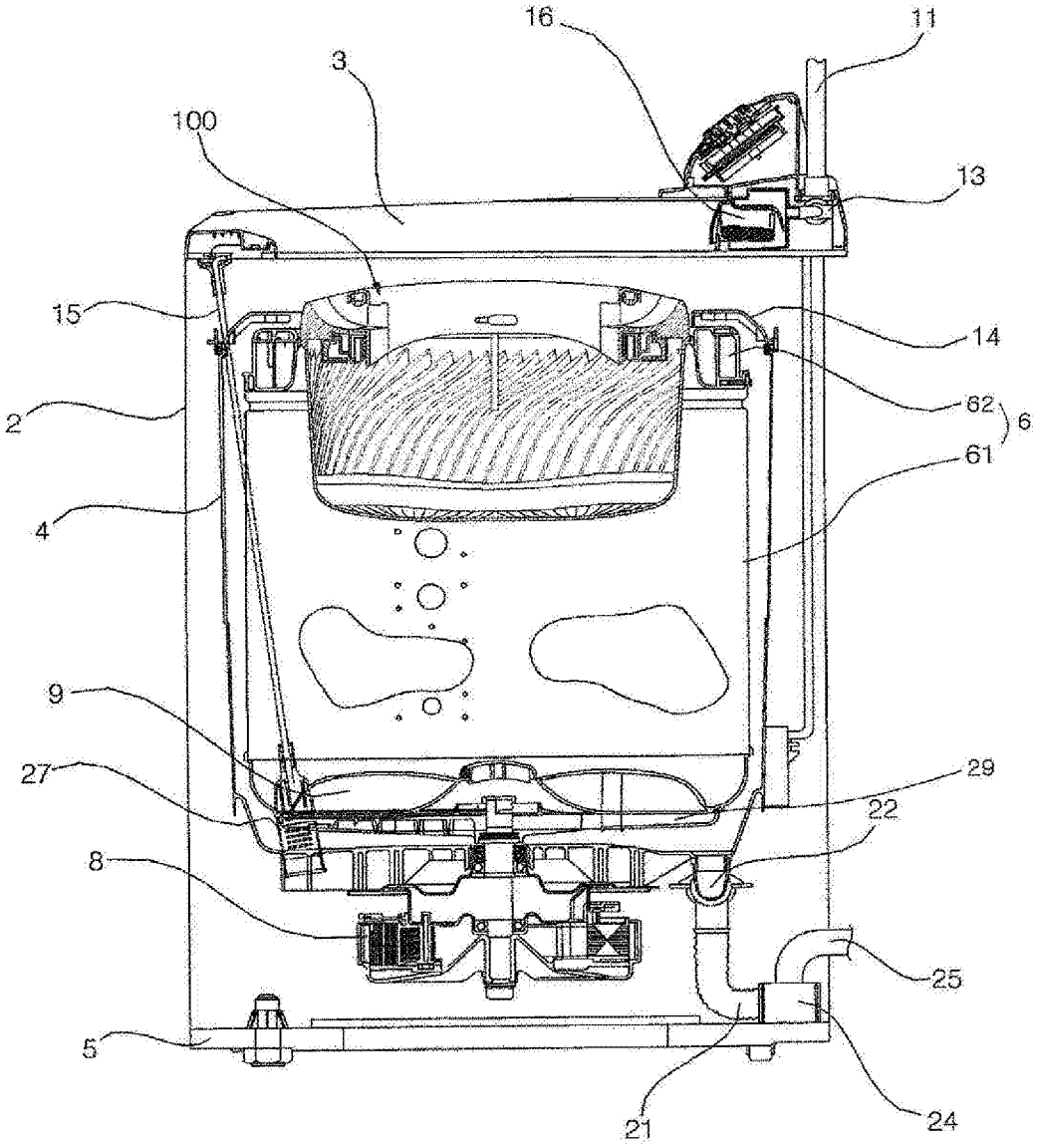

【Figure 2】
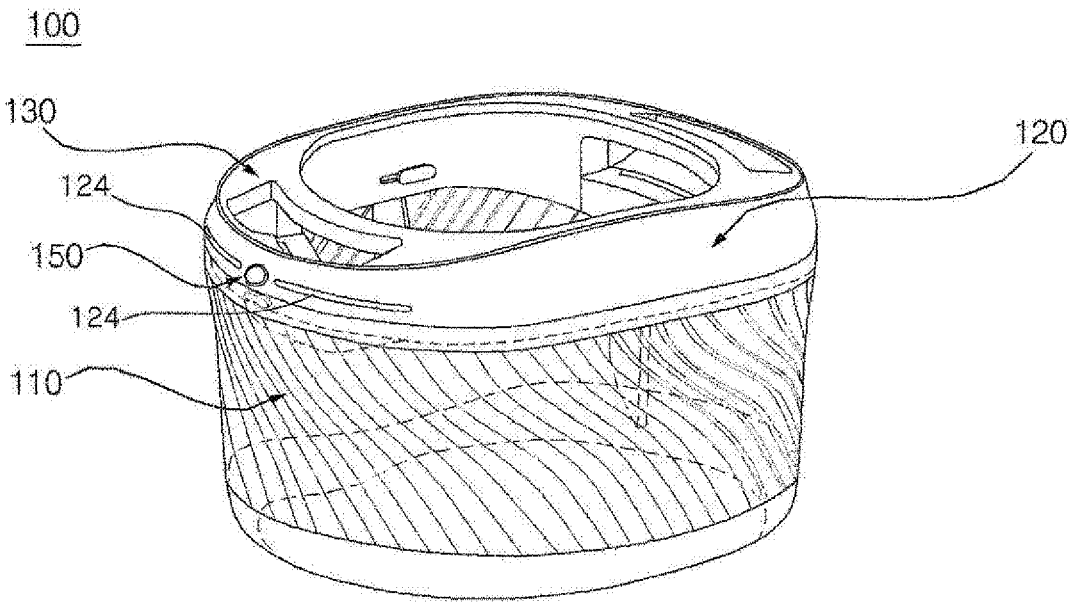

【Figure 3】
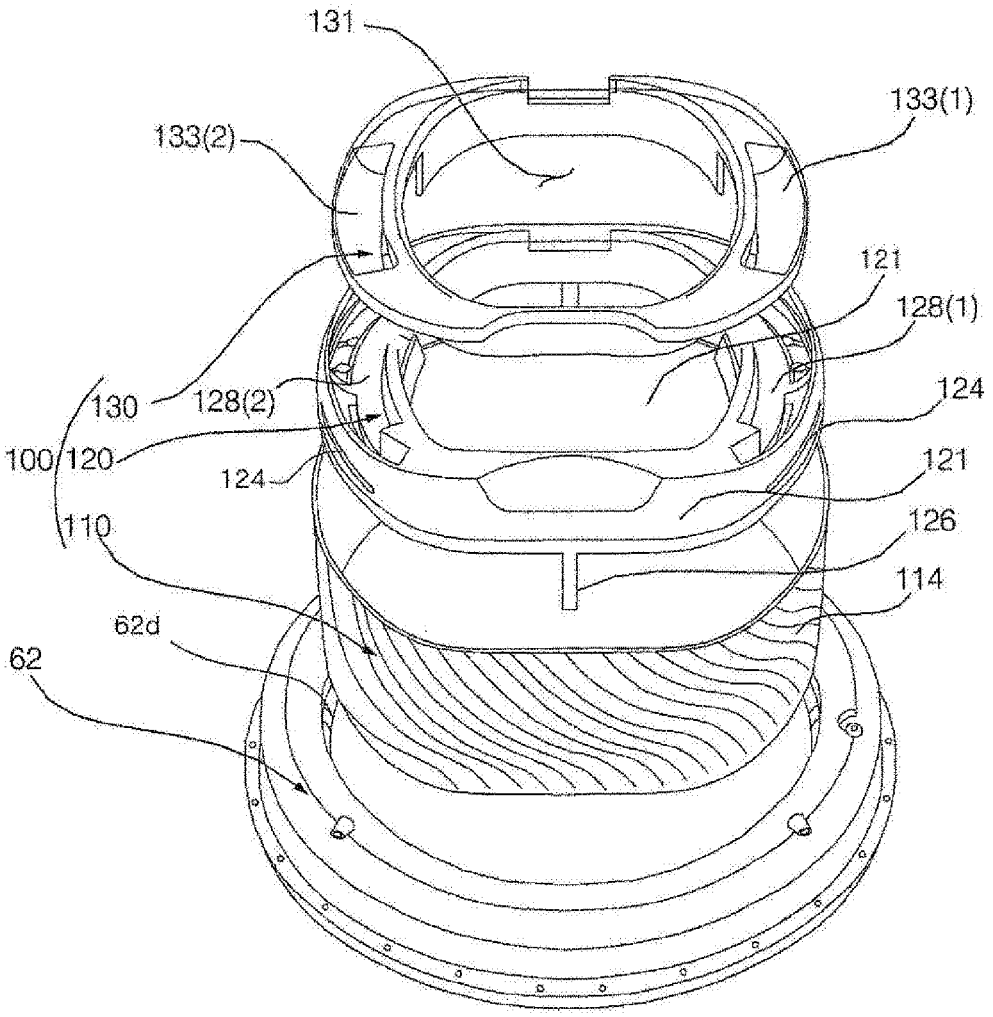

【Figure 4】
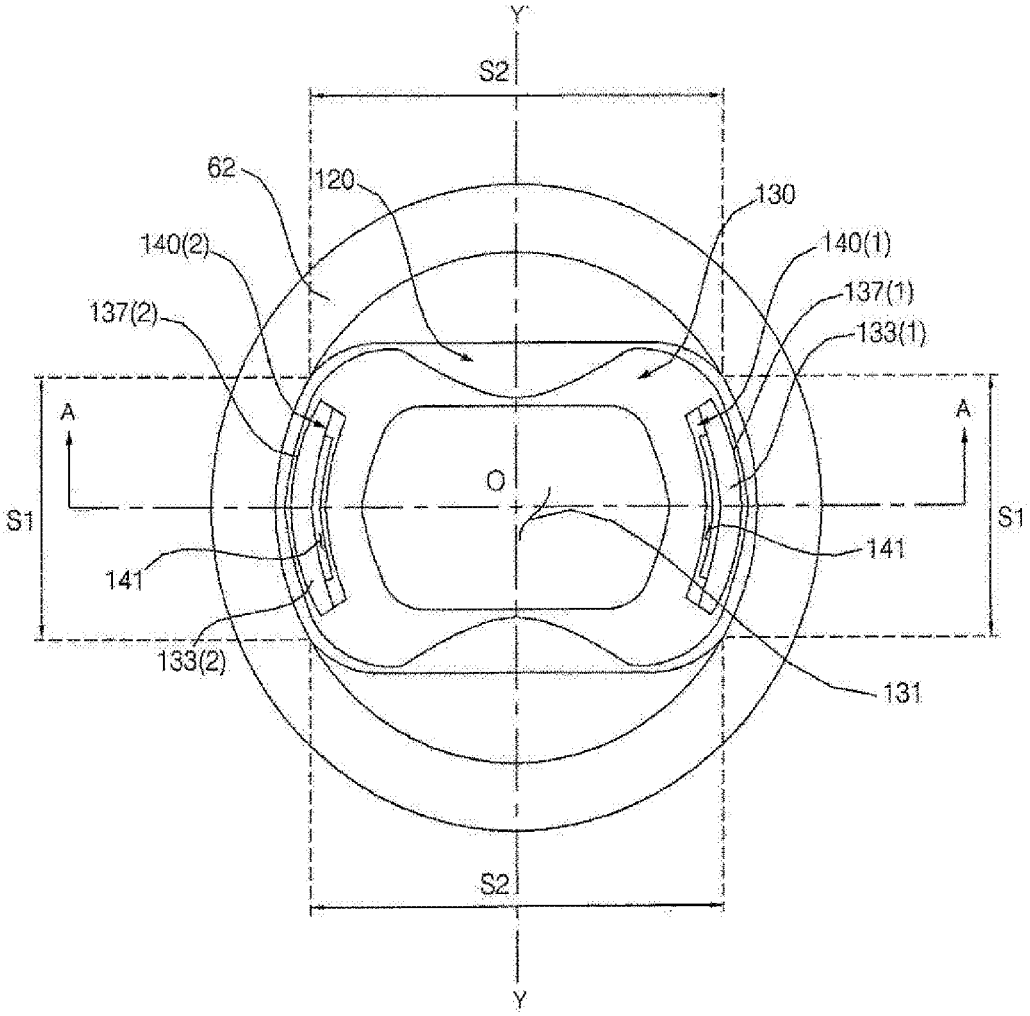

【Figure 5】
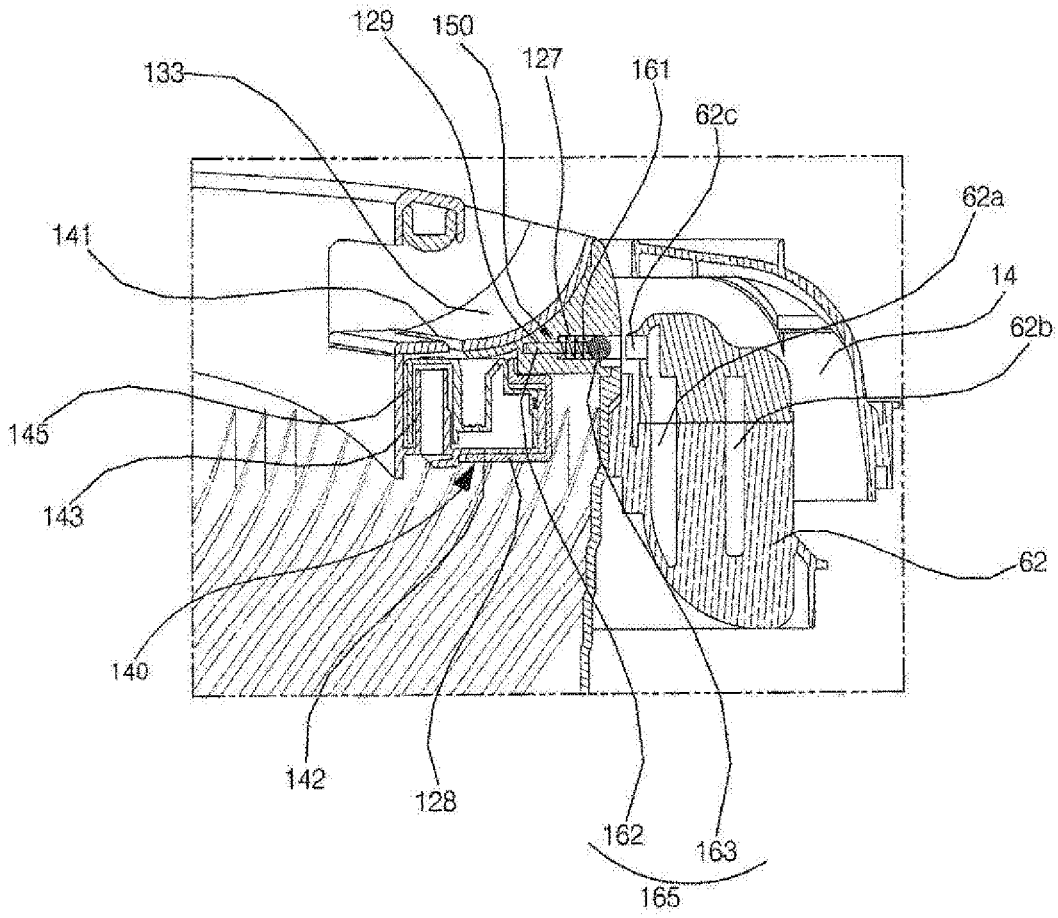

【Figure 6】
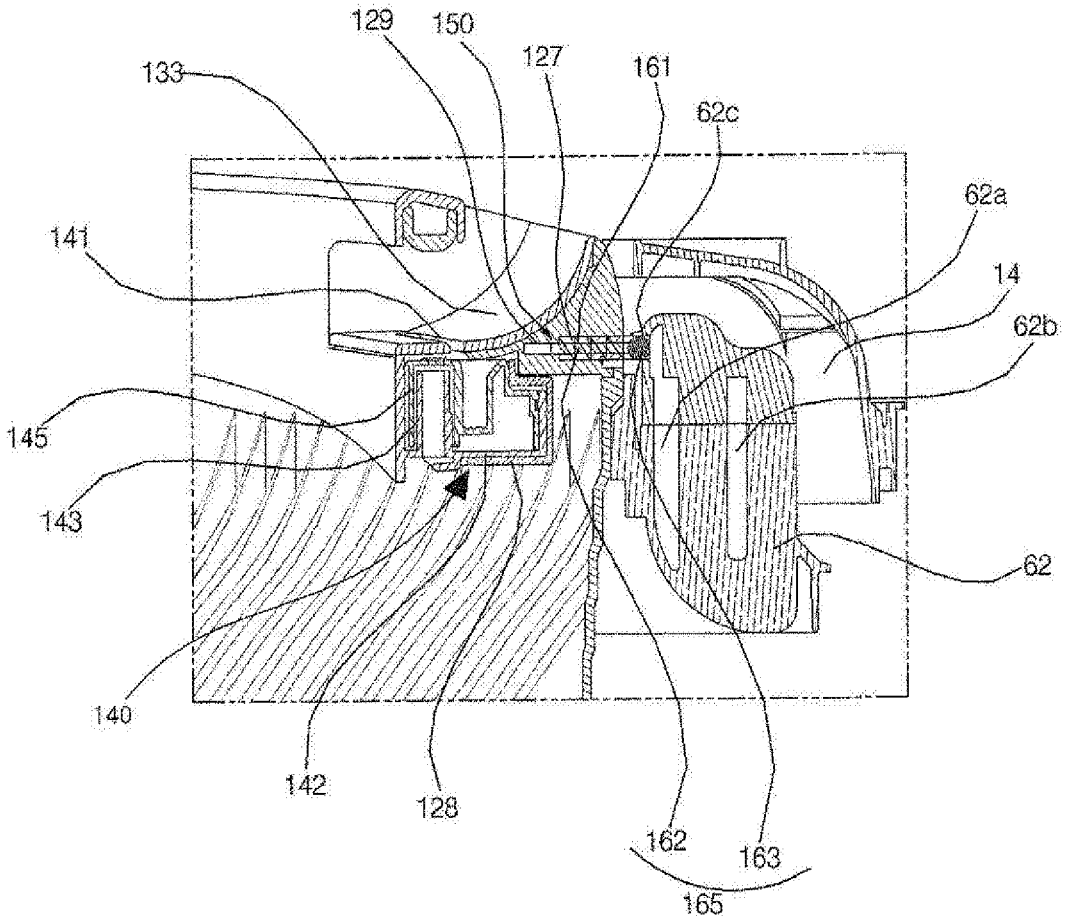

【Figure 7】
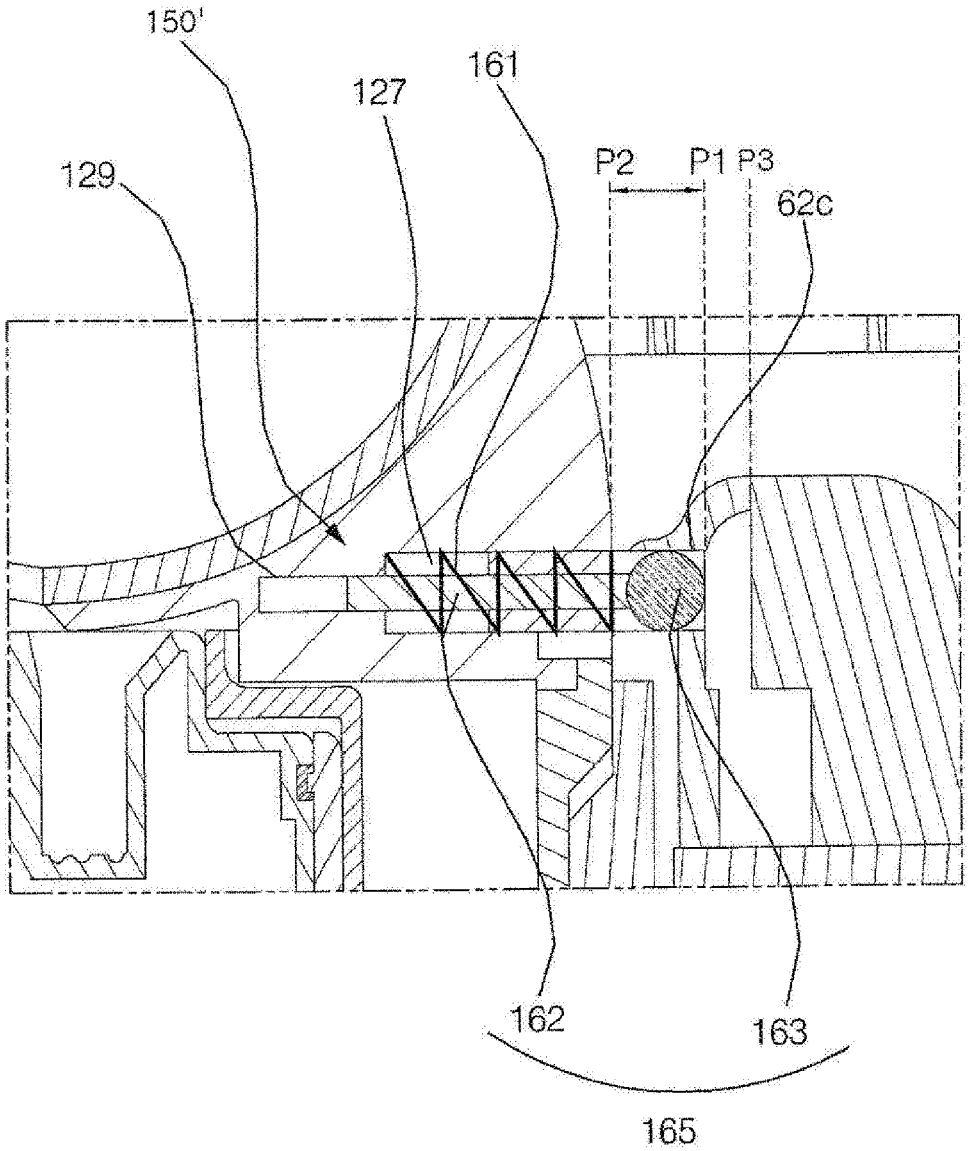

【Figure 8】
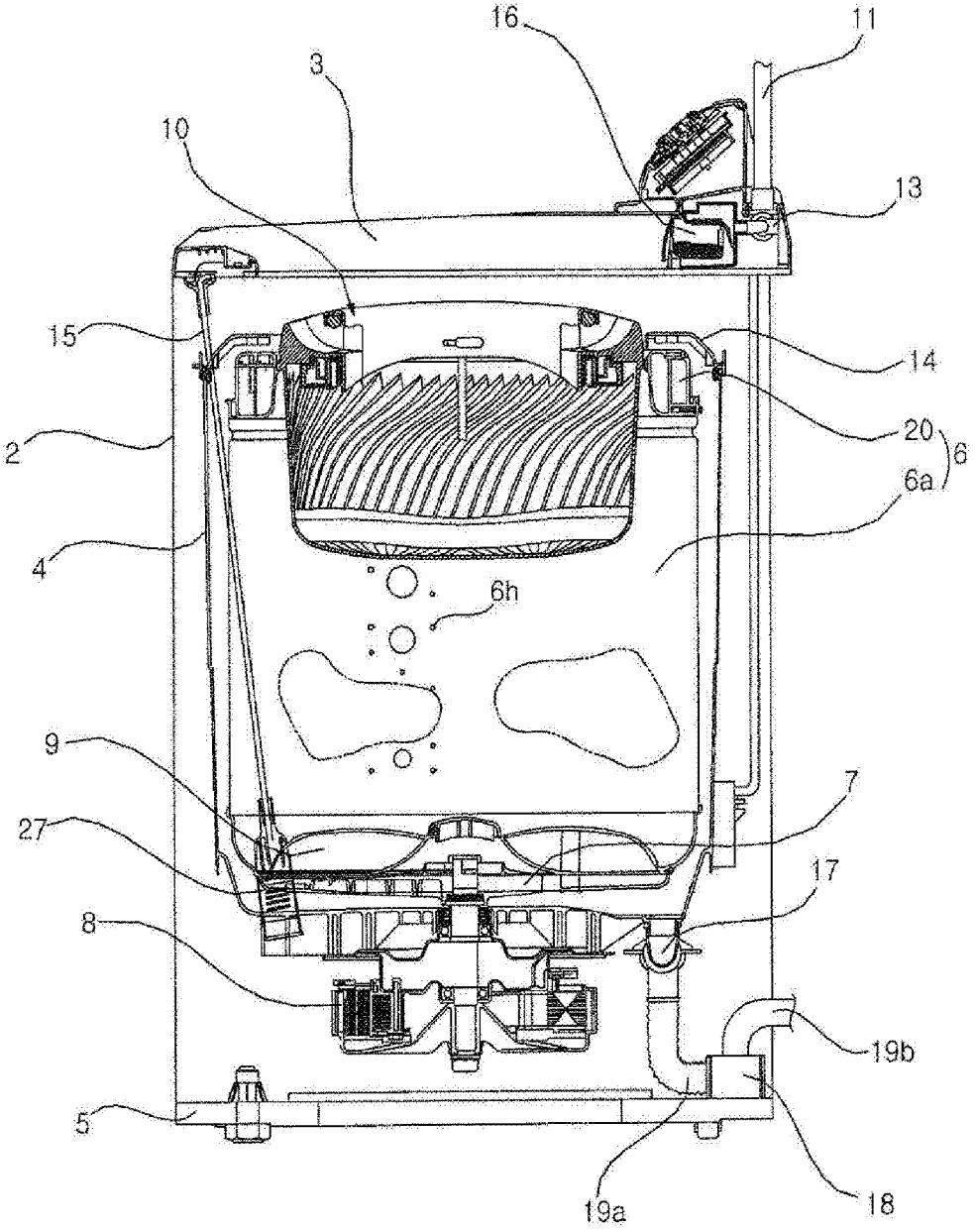

【Figure 9】
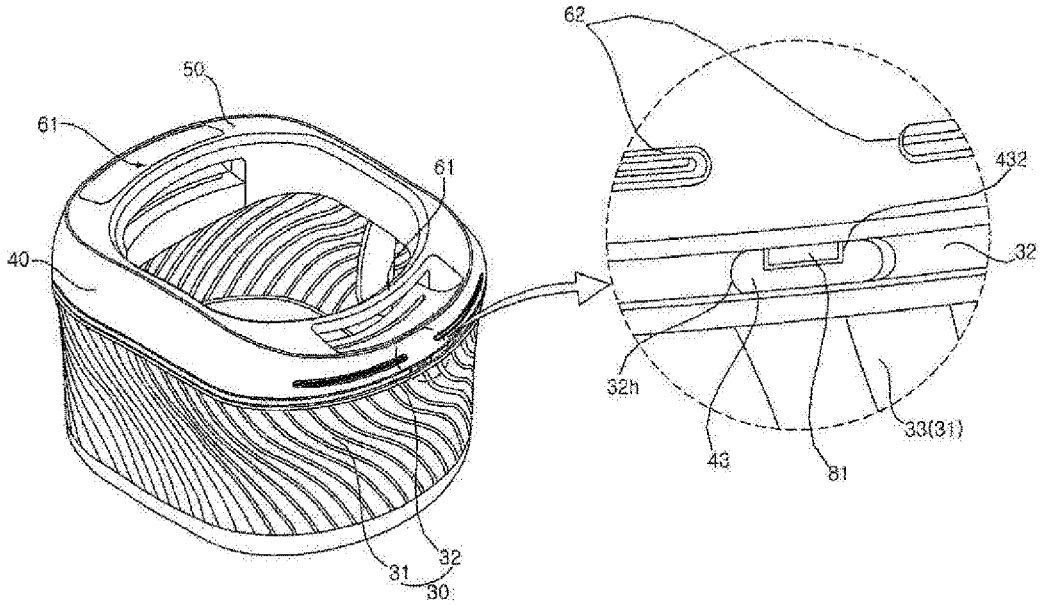

【Figure 10】
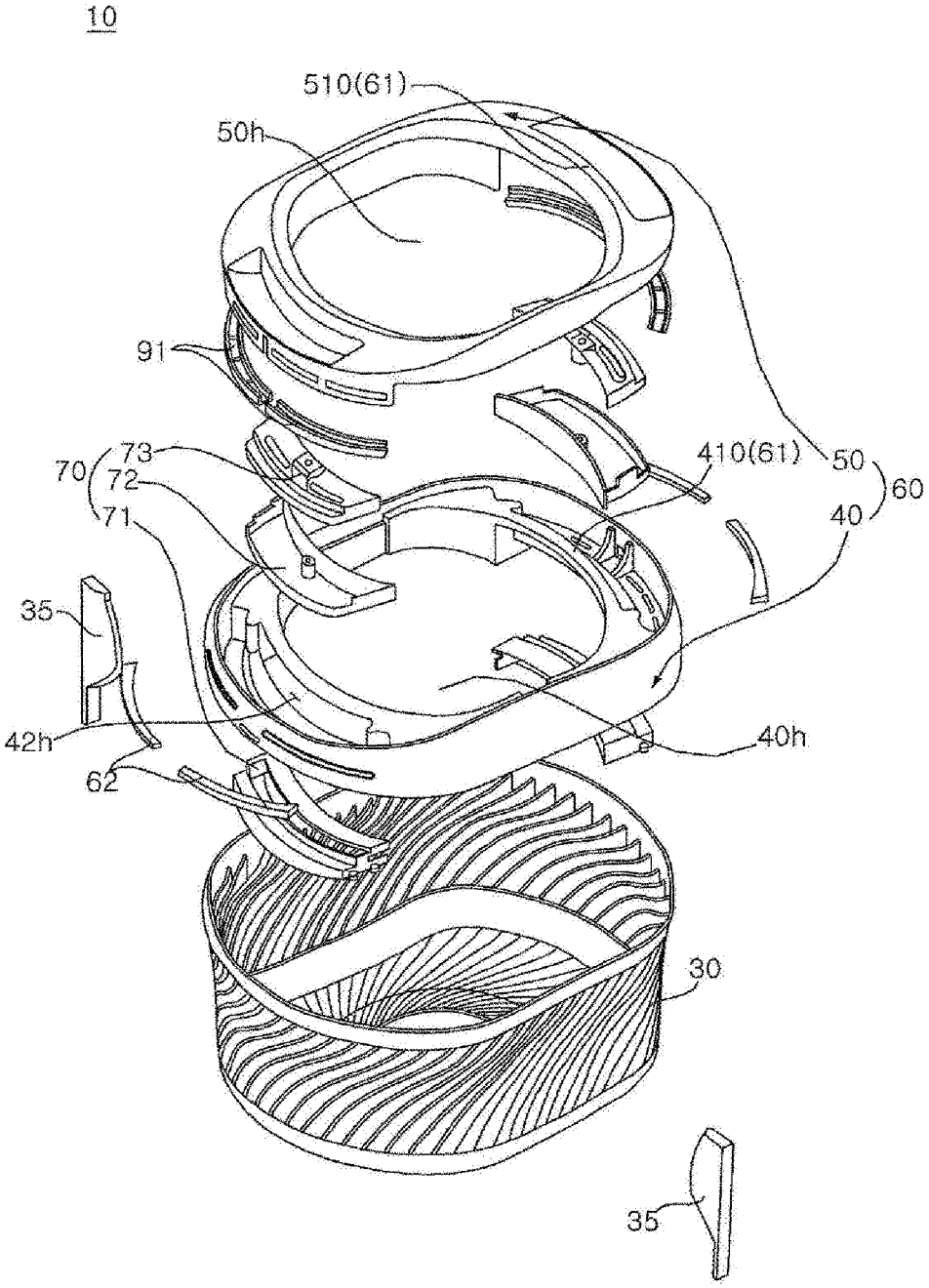

【Figure 11】
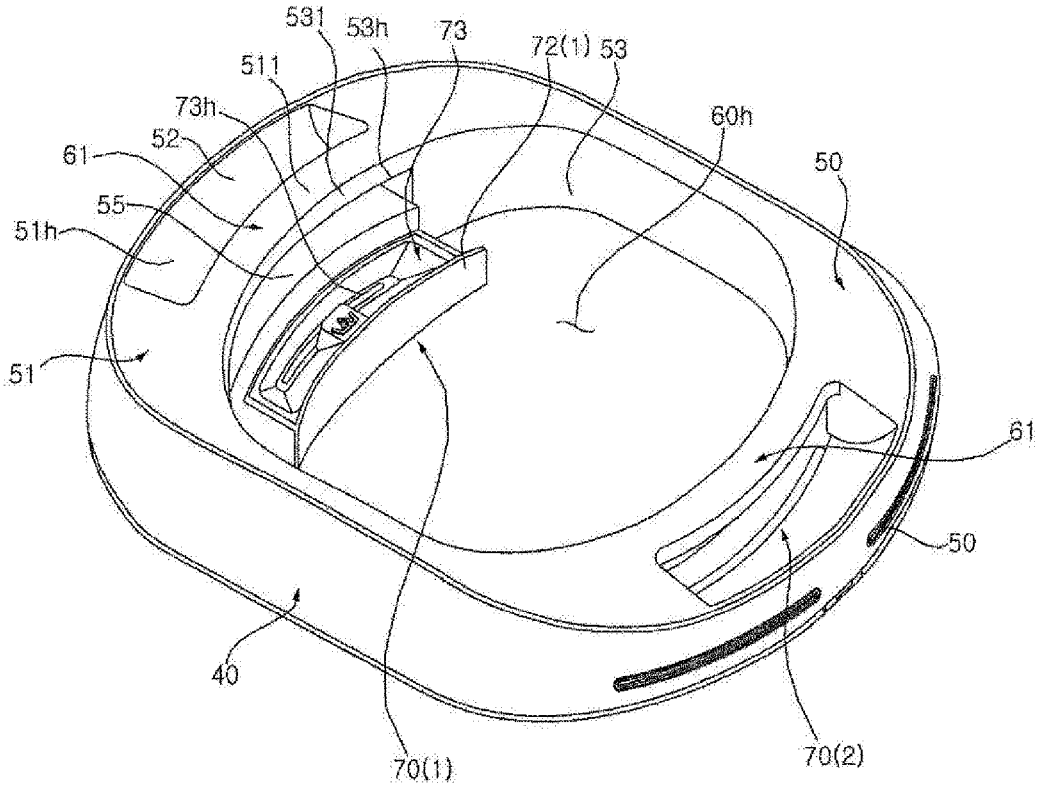

【Figure 12】
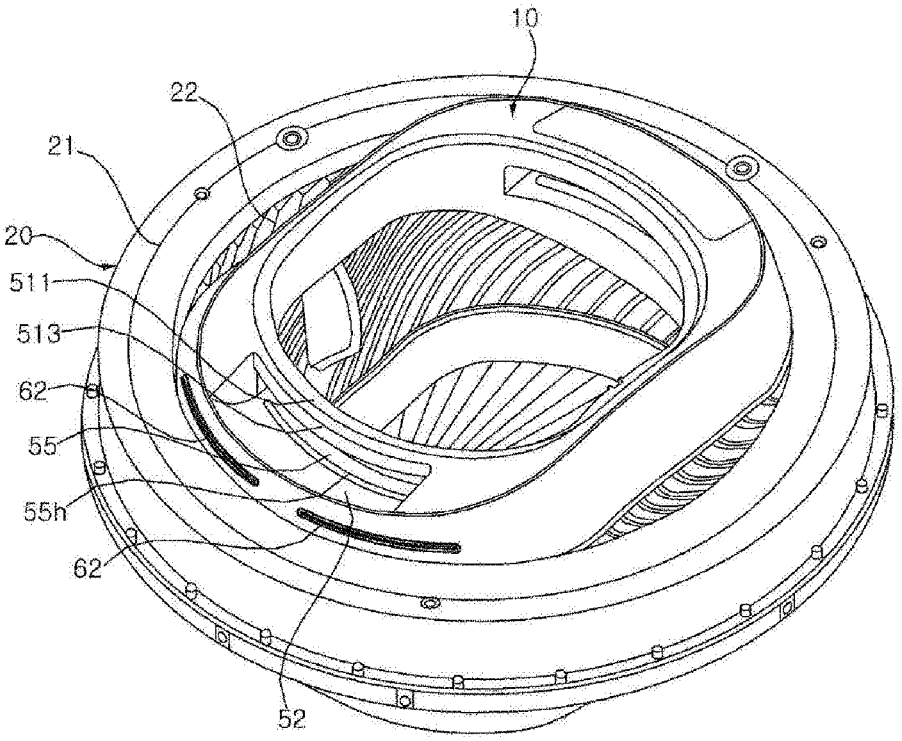

【Figure 13】
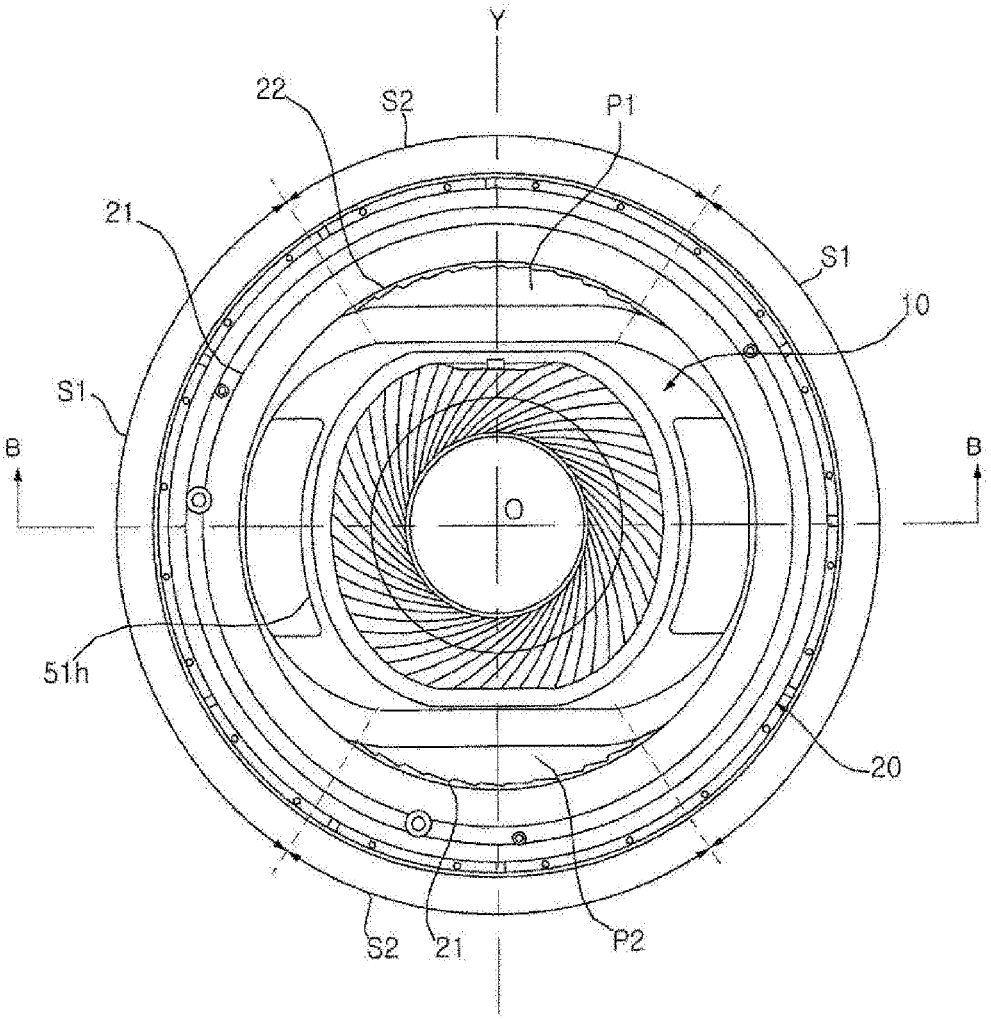

【Figure 14】
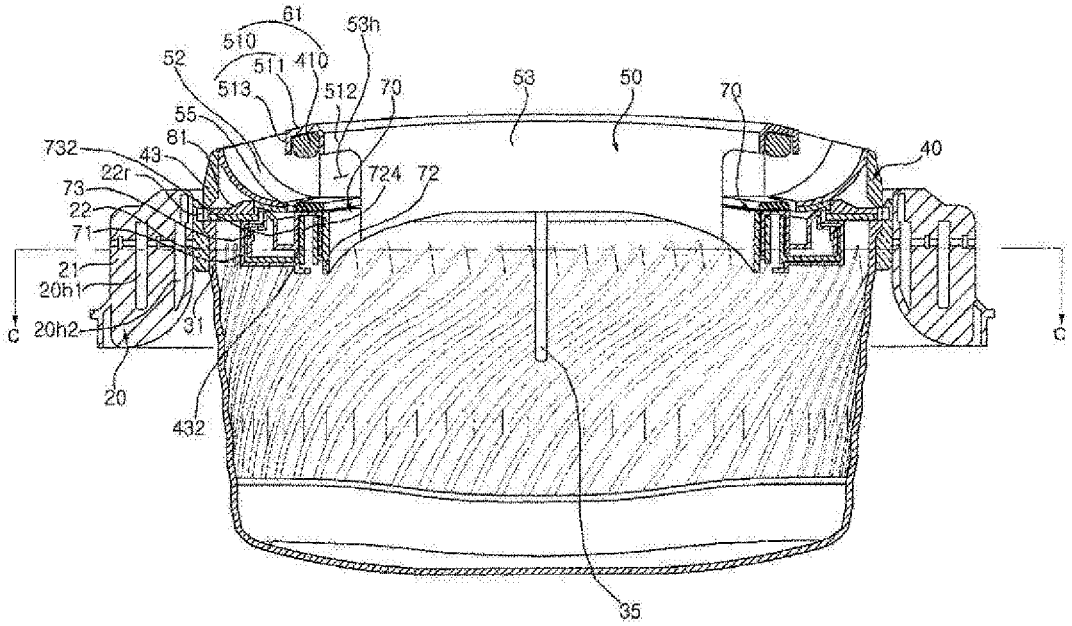

【Figure 15】
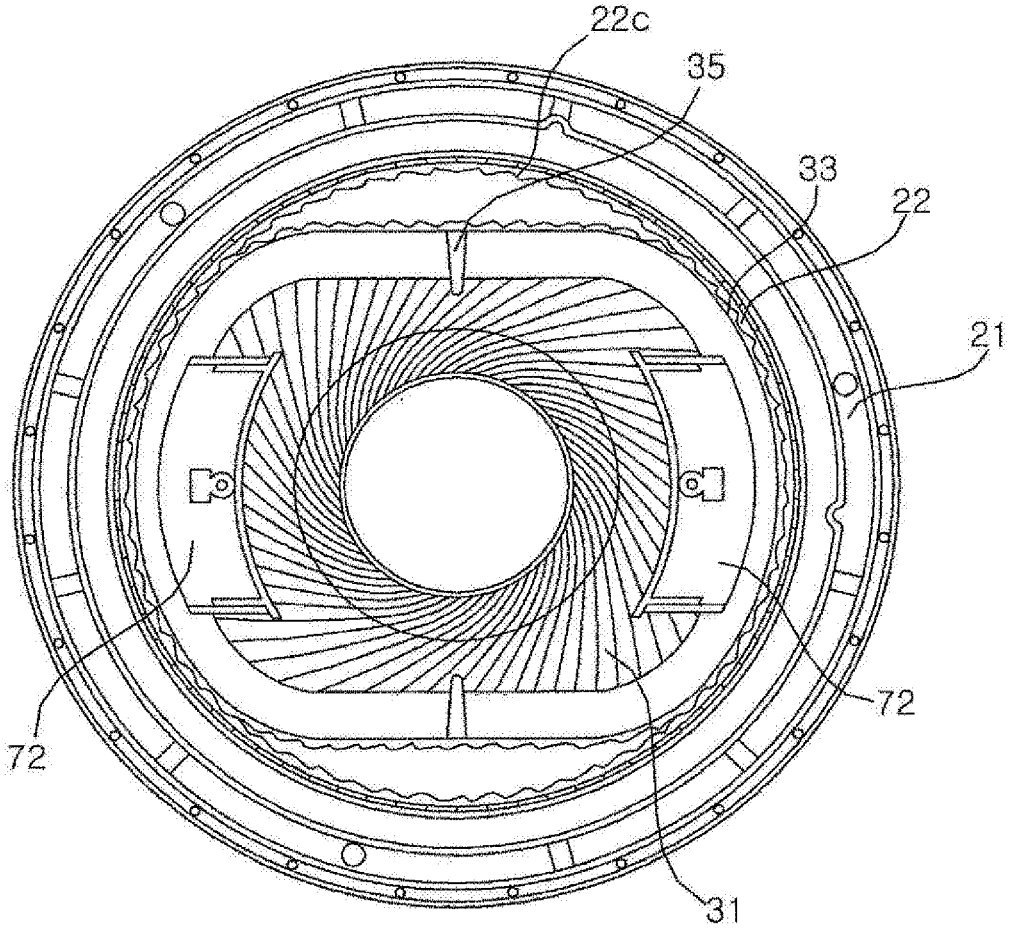

【Figure 16】
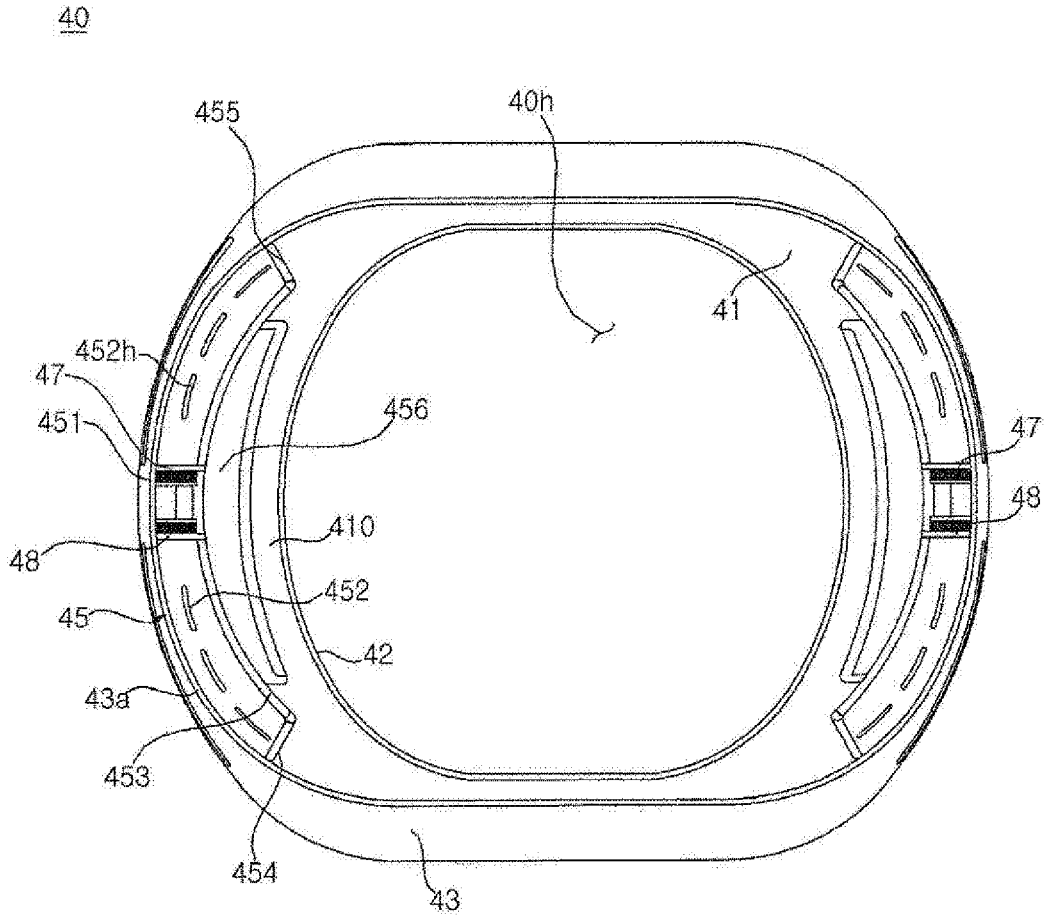

【Figure 17】
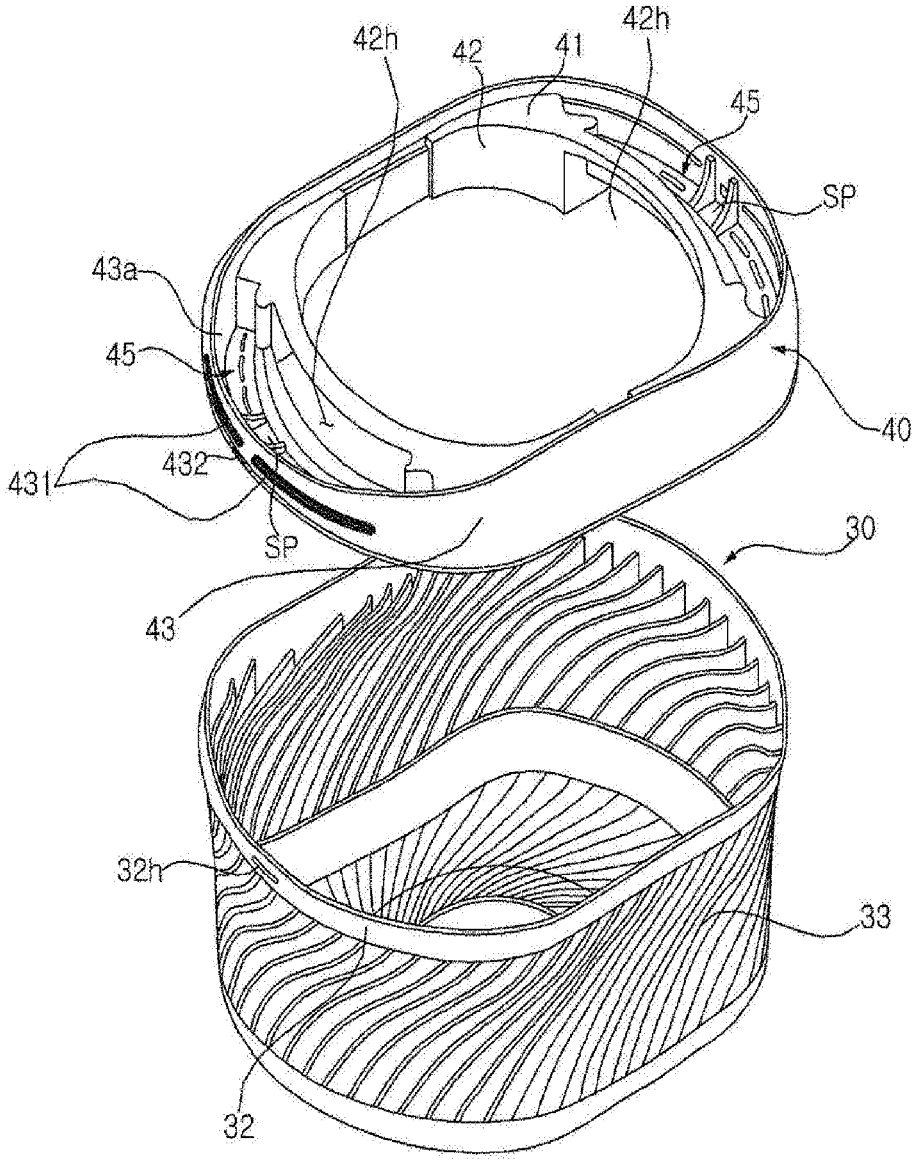

【Figure 18】
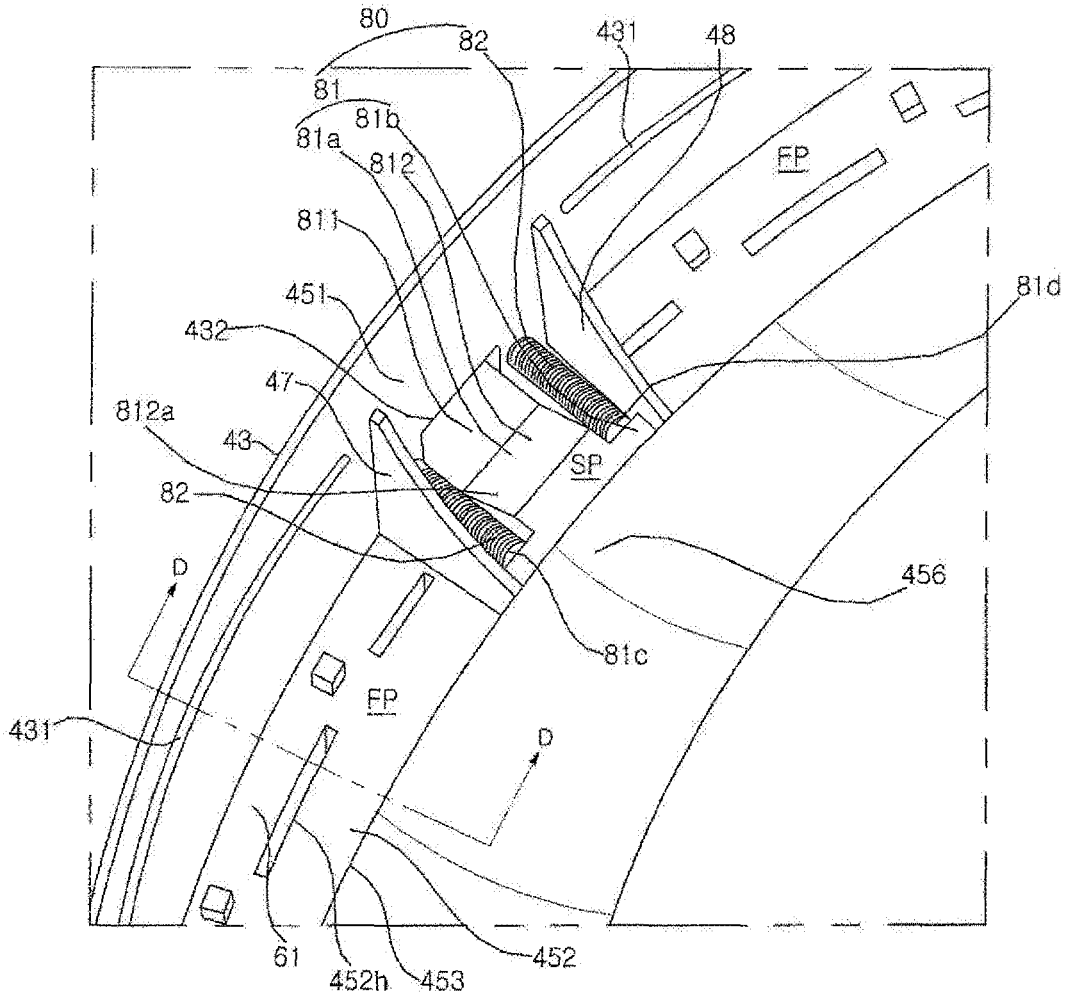

【Figure 19】
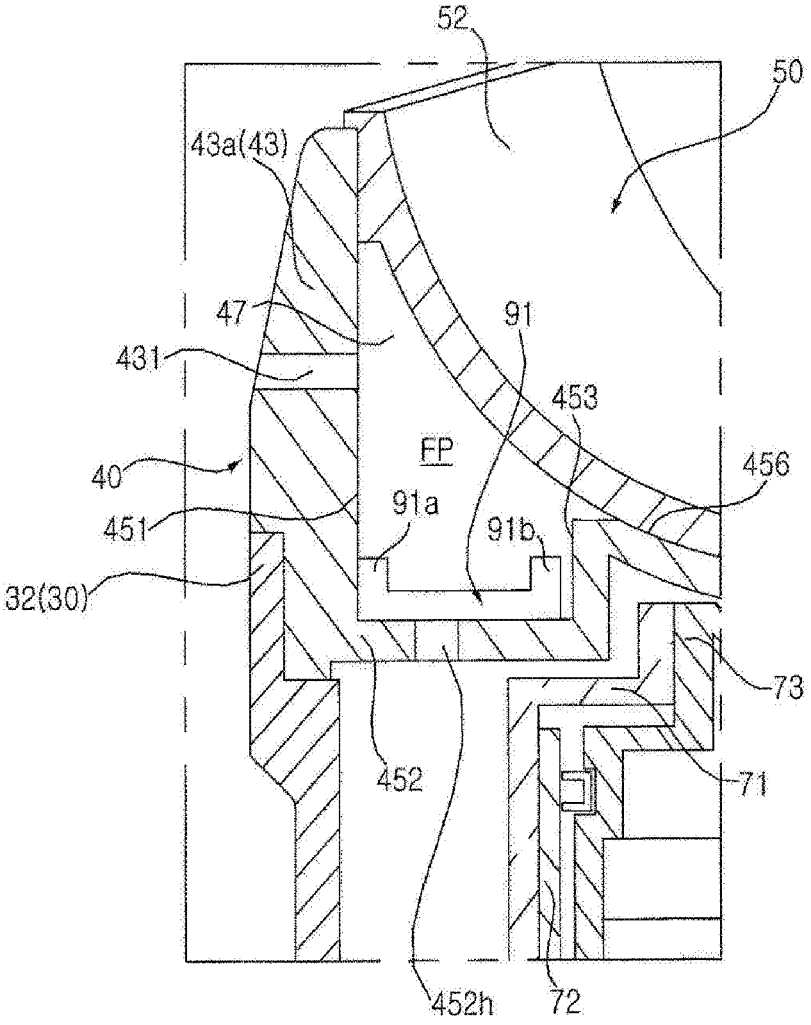

【Figure 20】
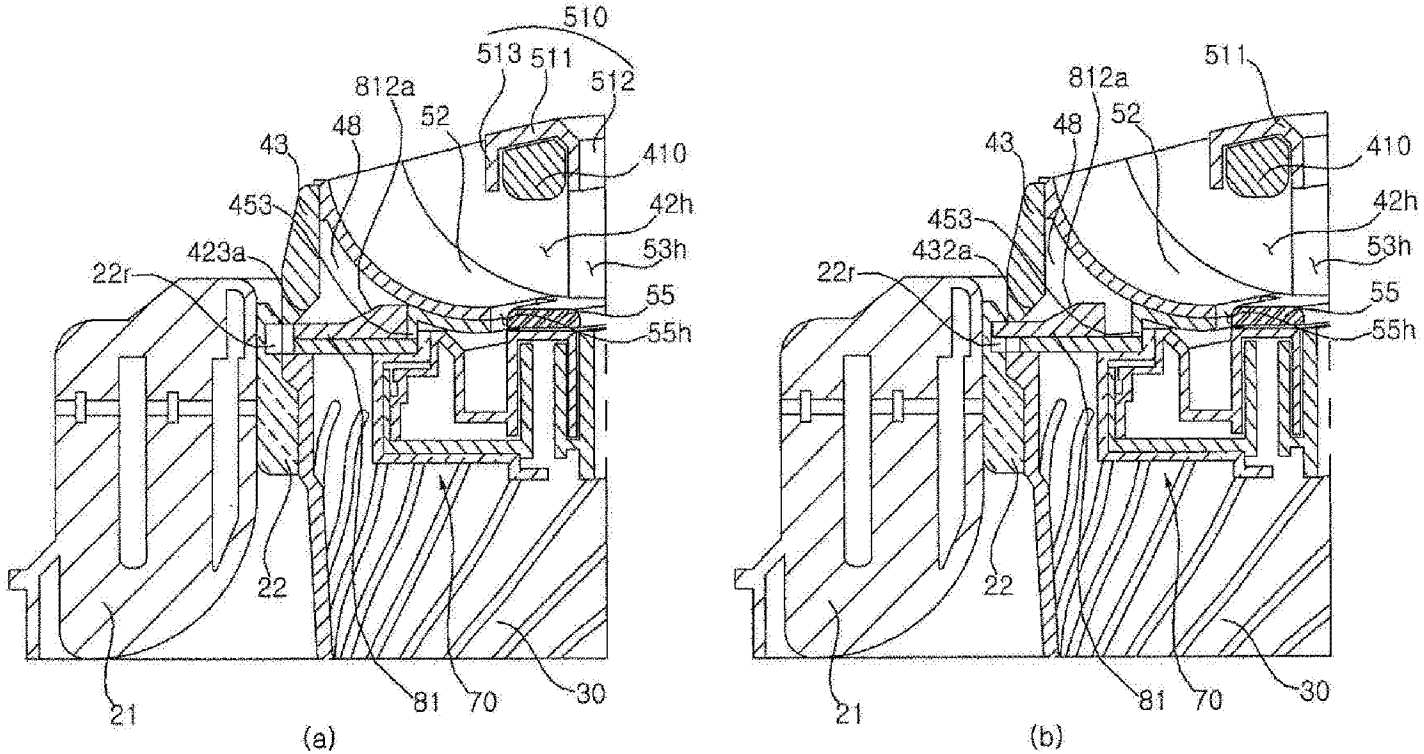

【Figure 21】
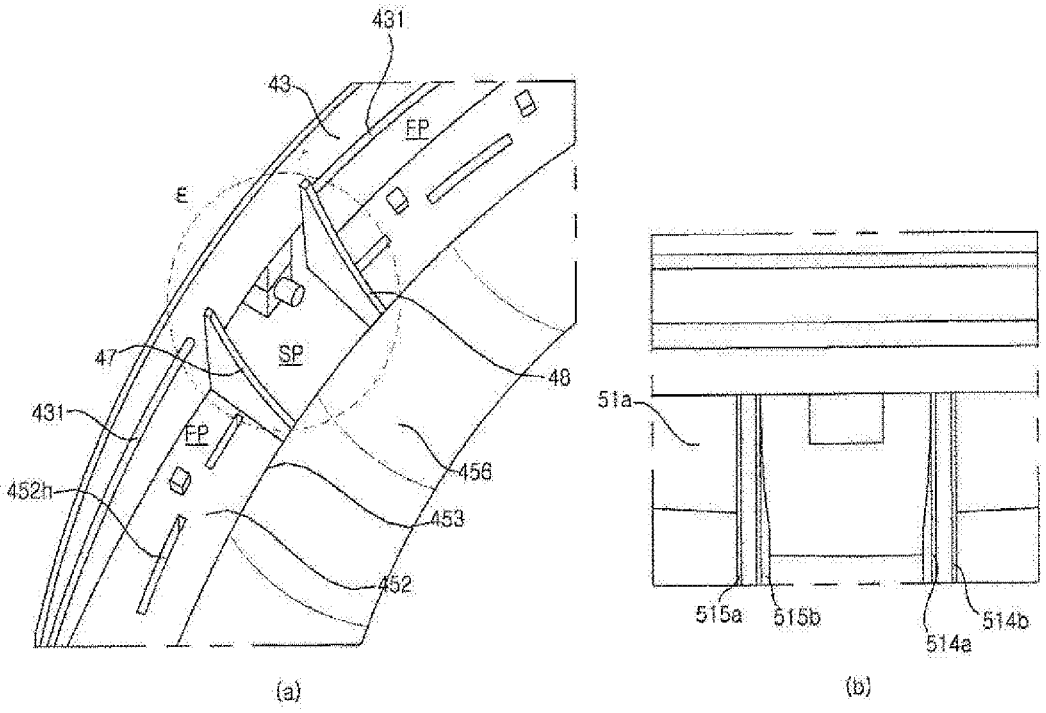

【Figure 22】
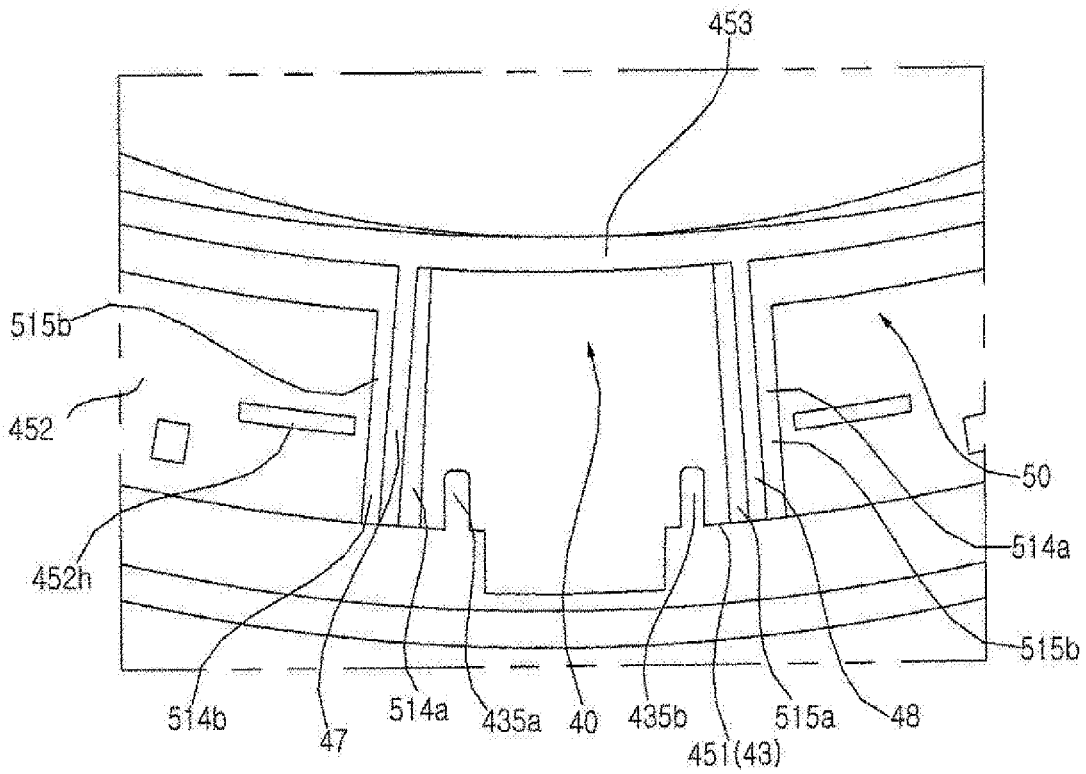

【Figure 23】
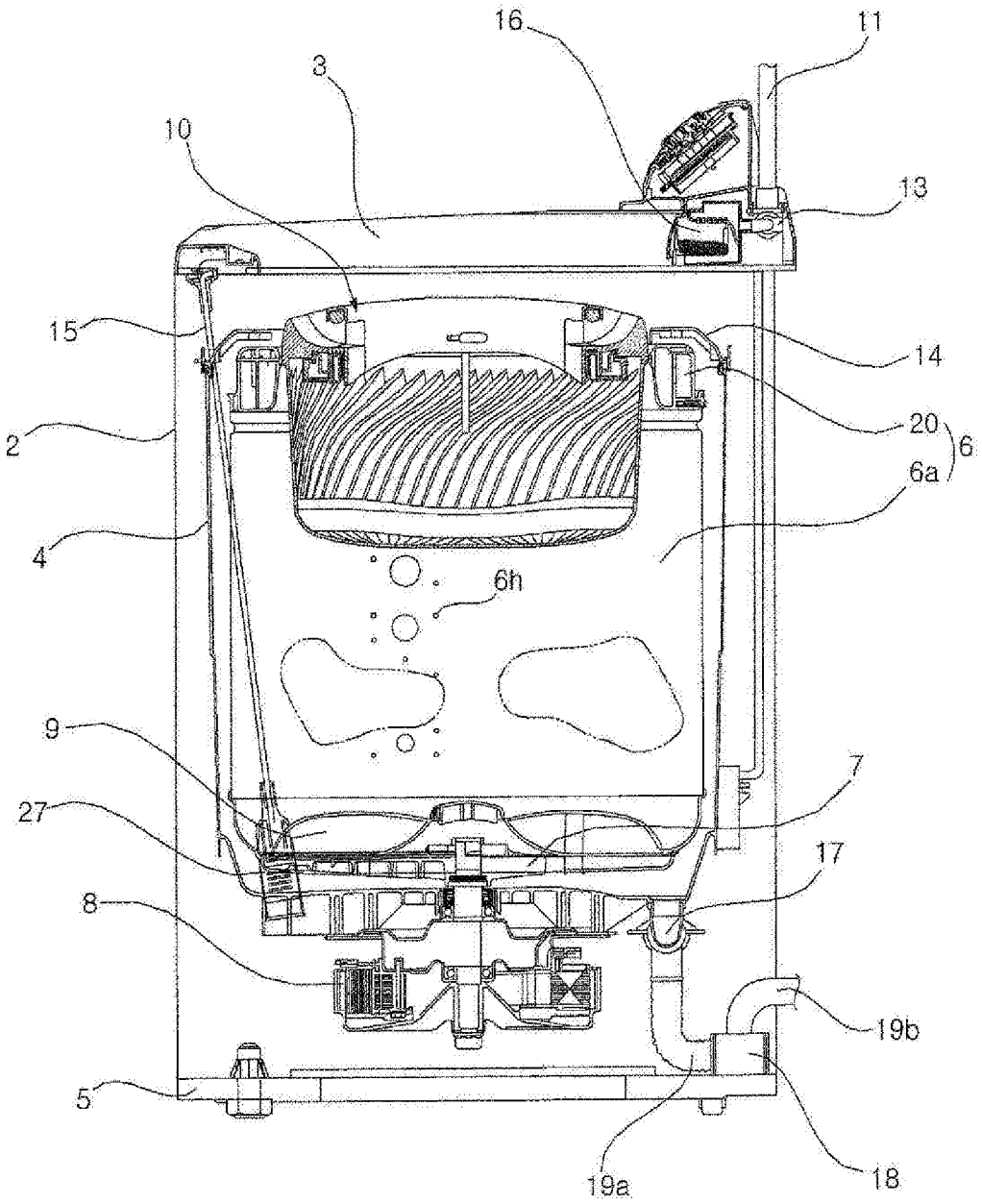

[Figure 24]
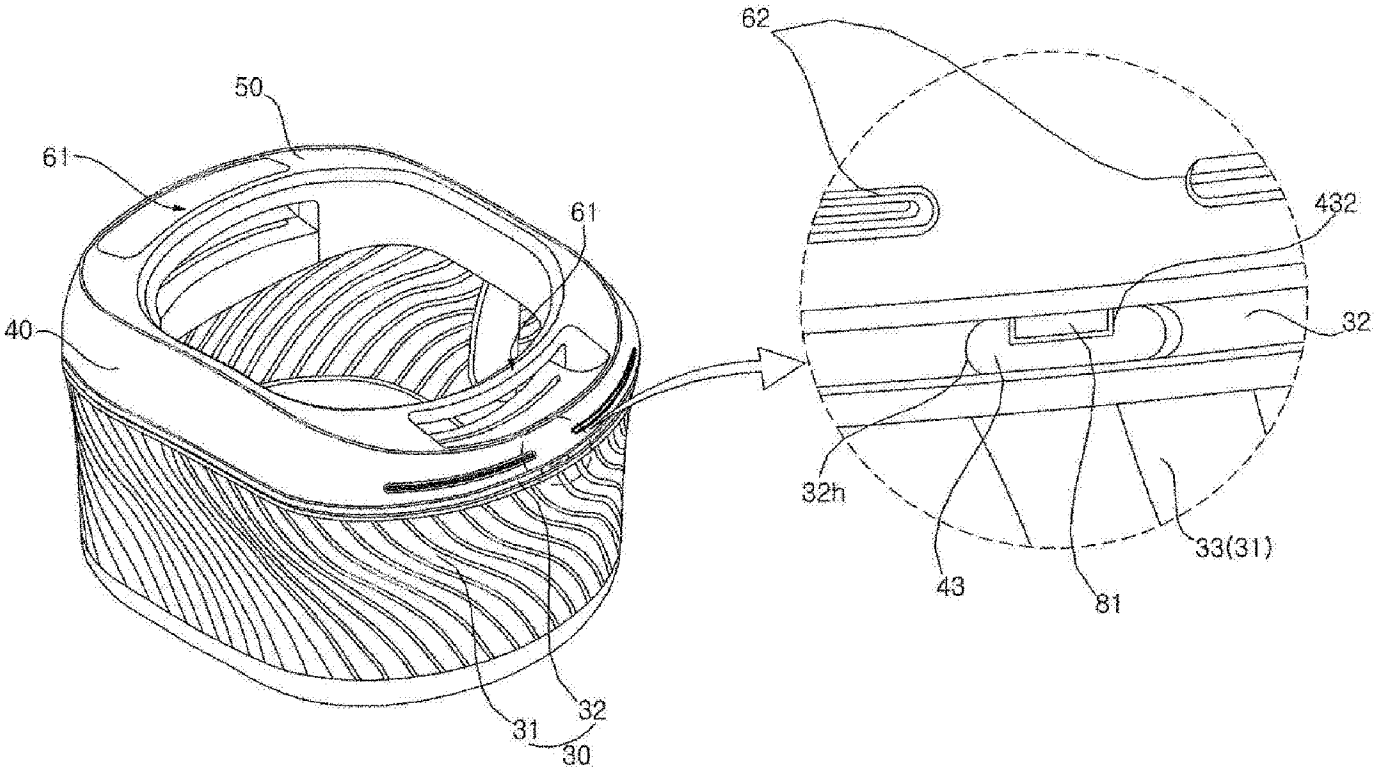

【Figure 25】
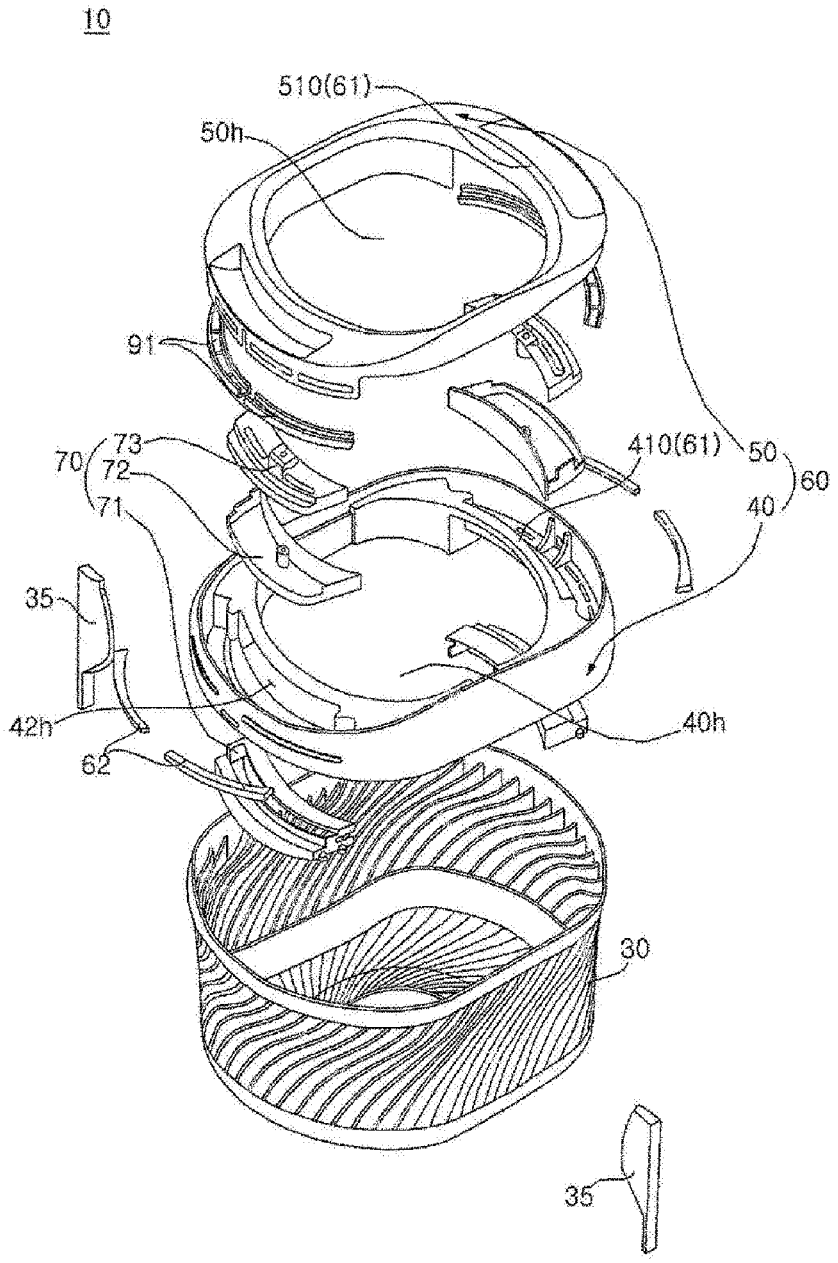

【Figure 26】
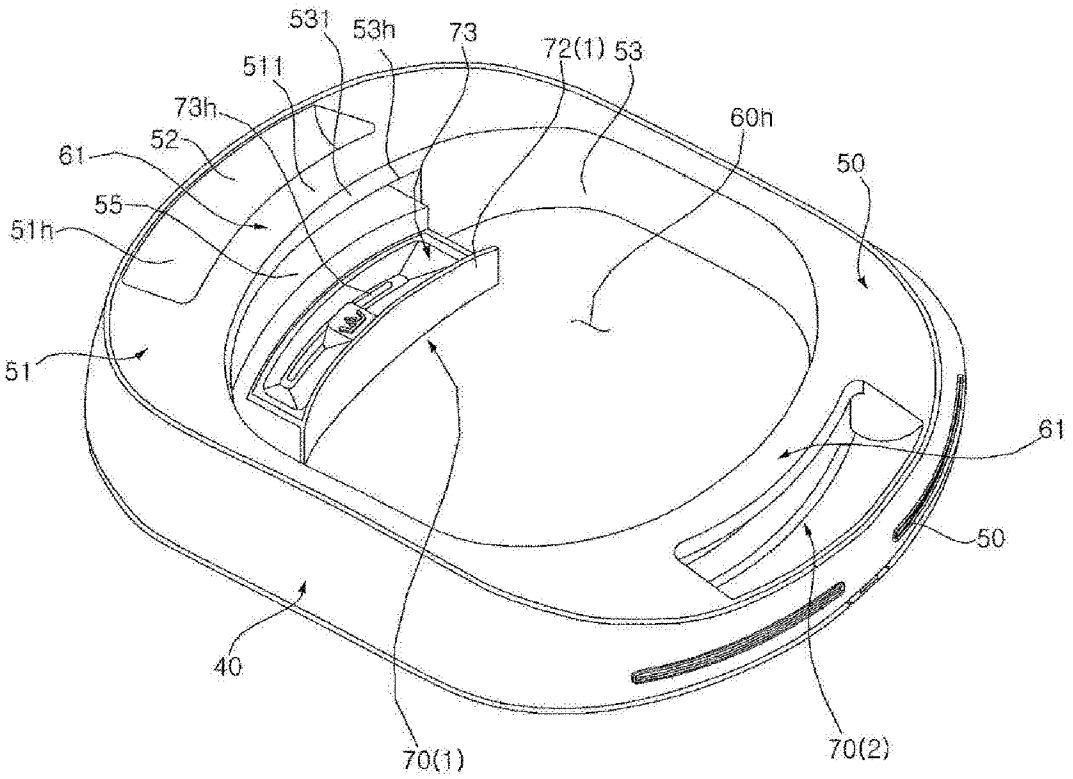

[Figure 27]
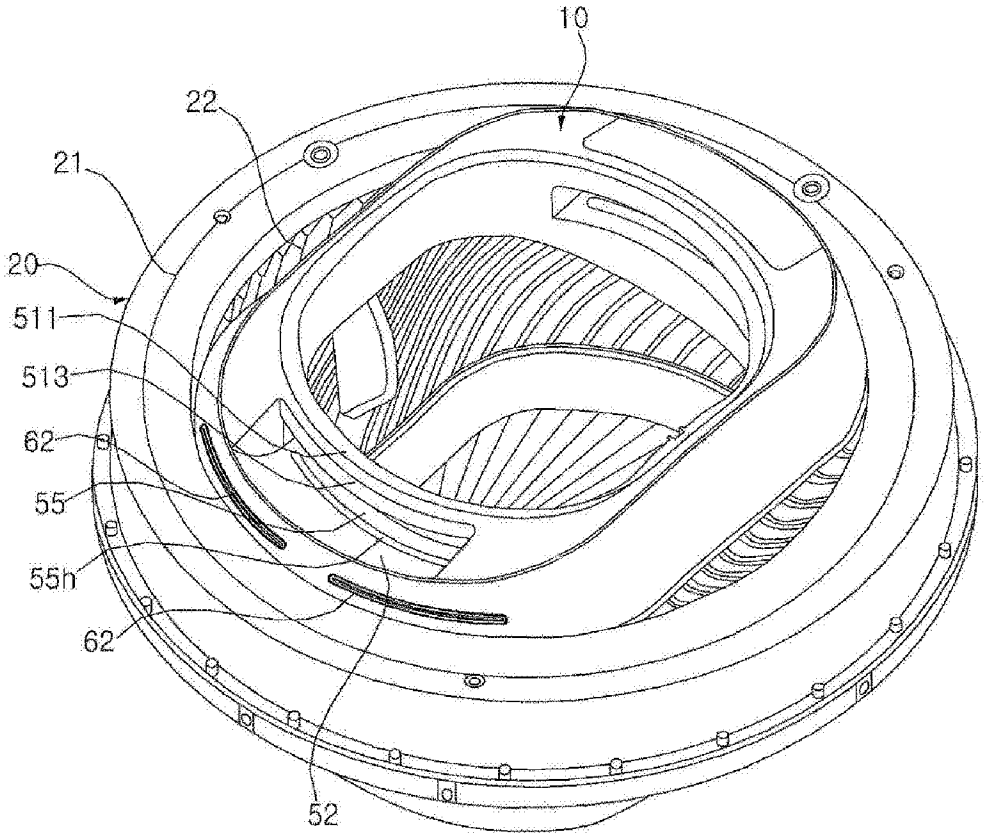

【Figure 28】
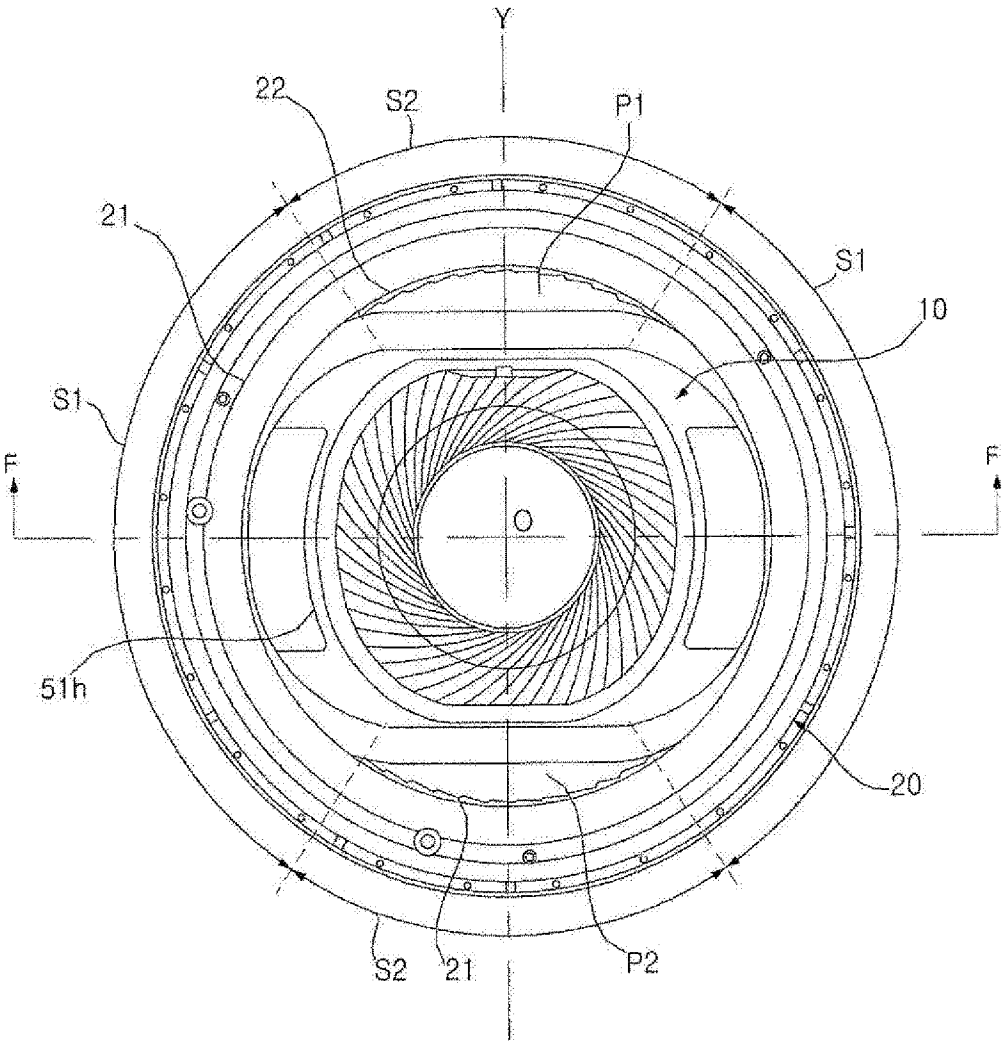

[Figure 29]
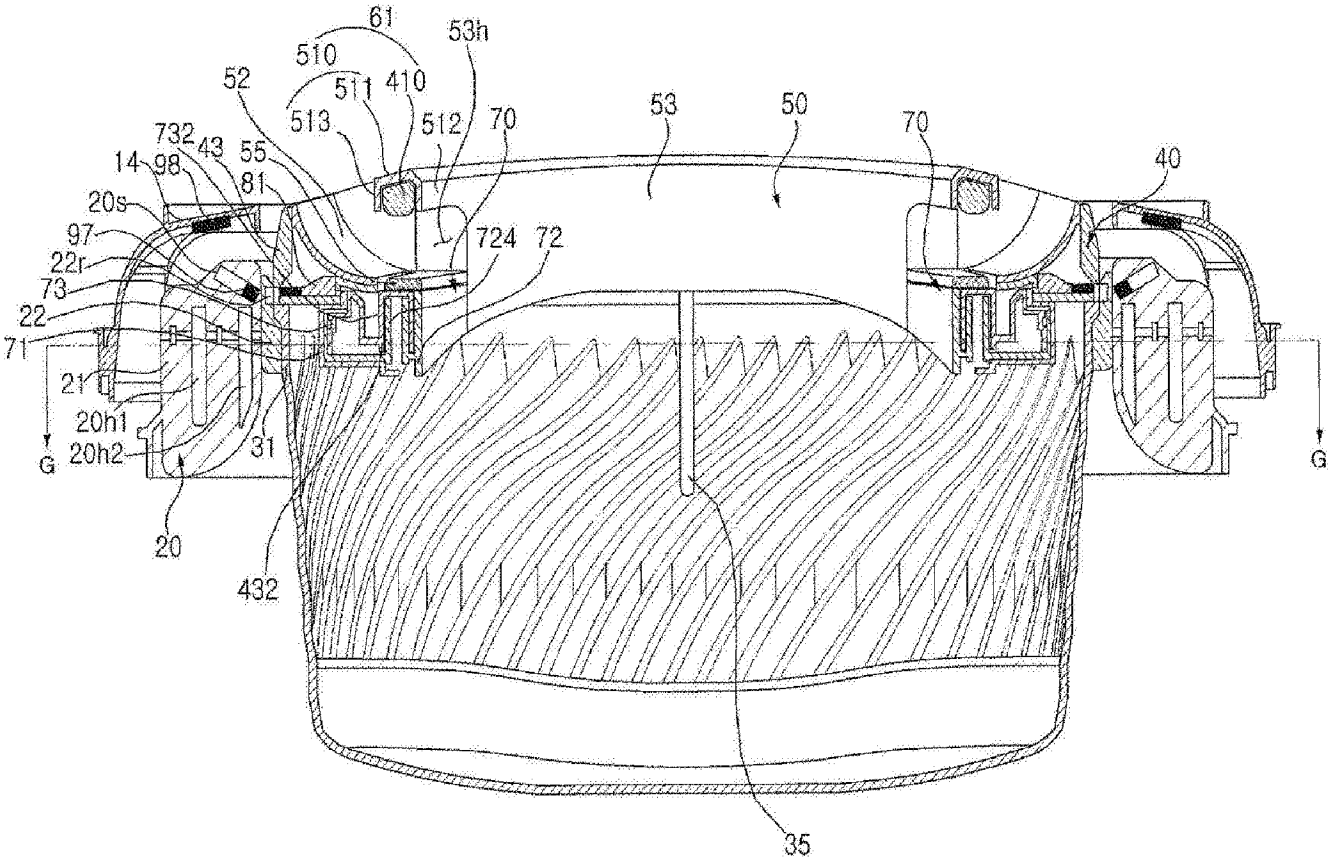

[Figure 30]
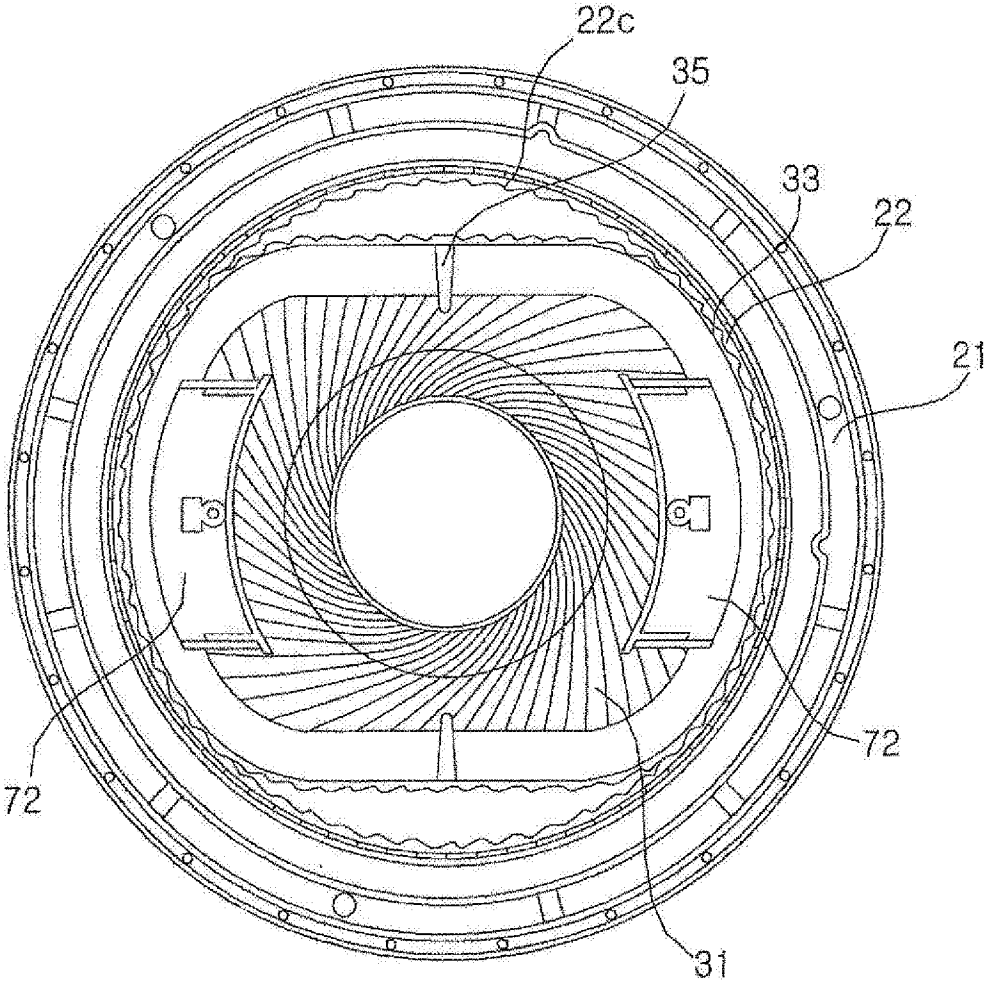

【Figure 31】
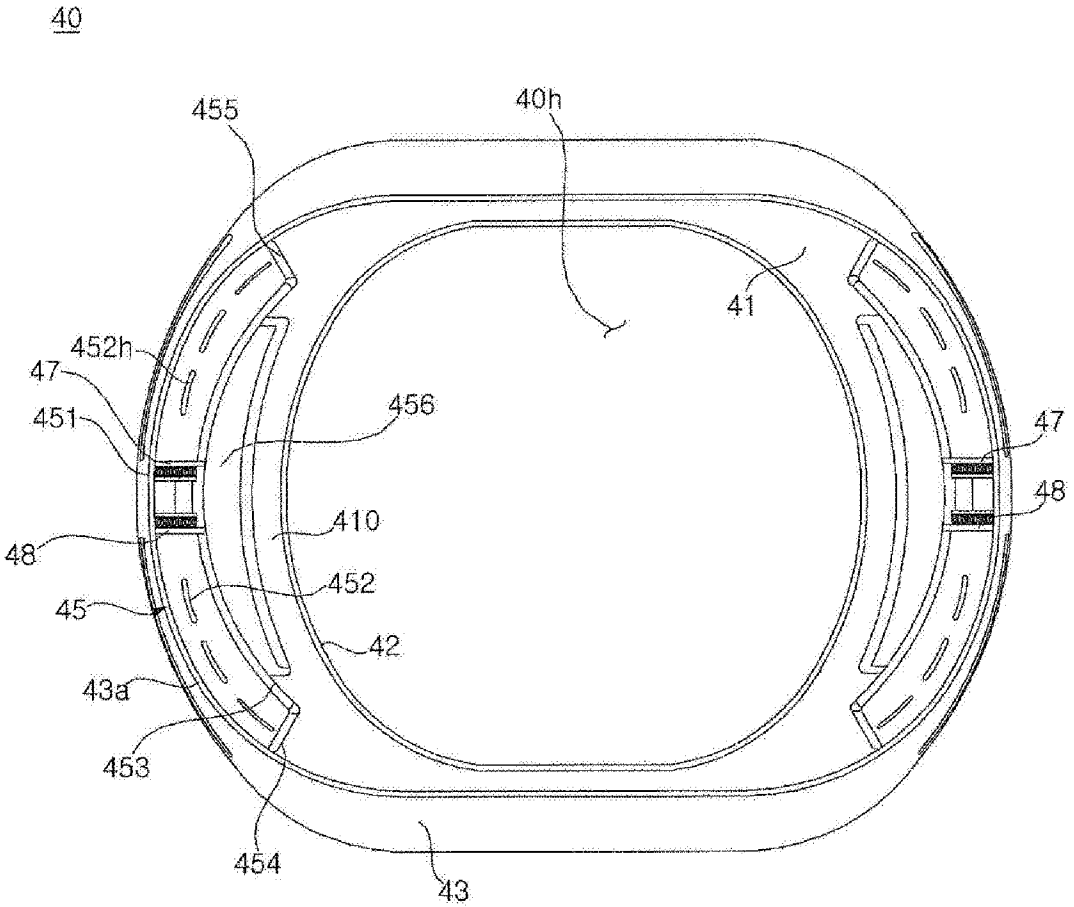

【Figure 32】
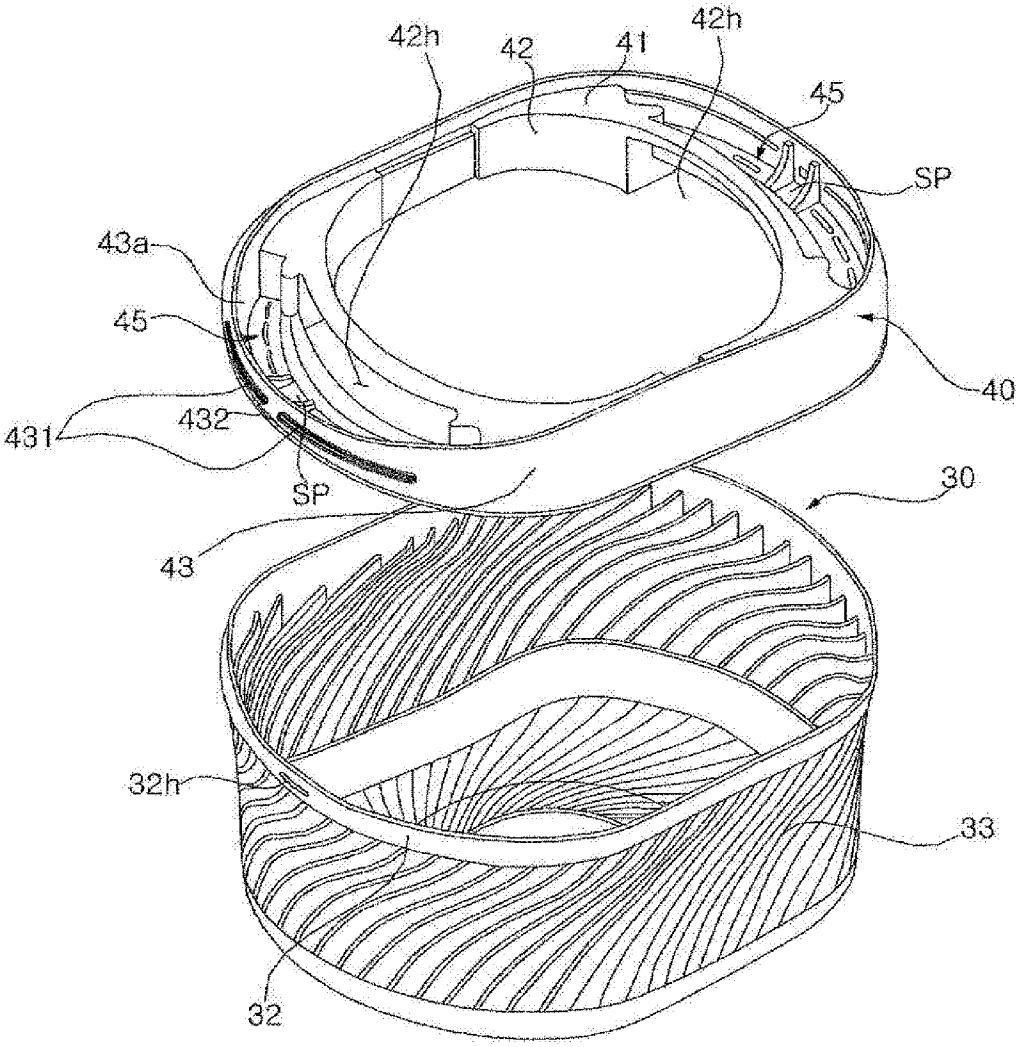

【Figure 33】
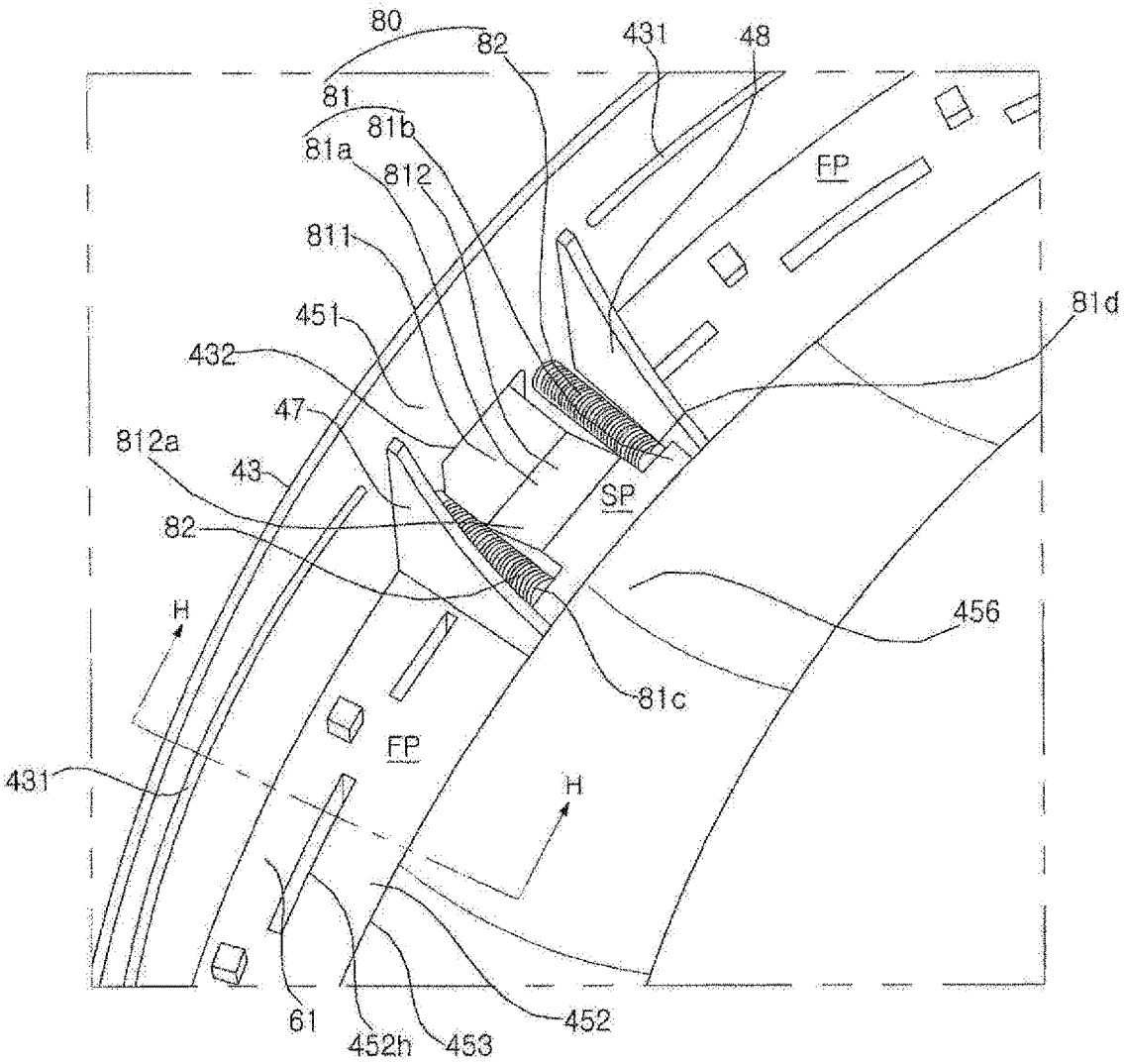

【Figure 34】
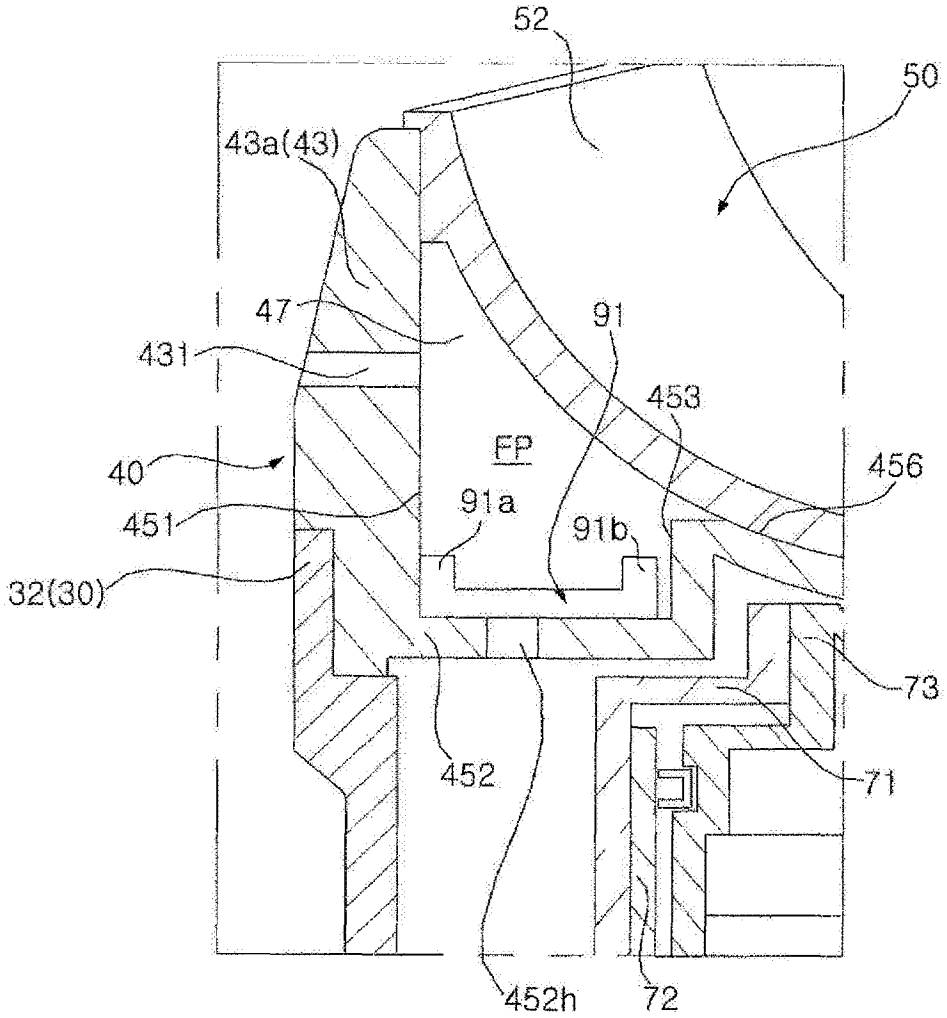

【Figure 35】
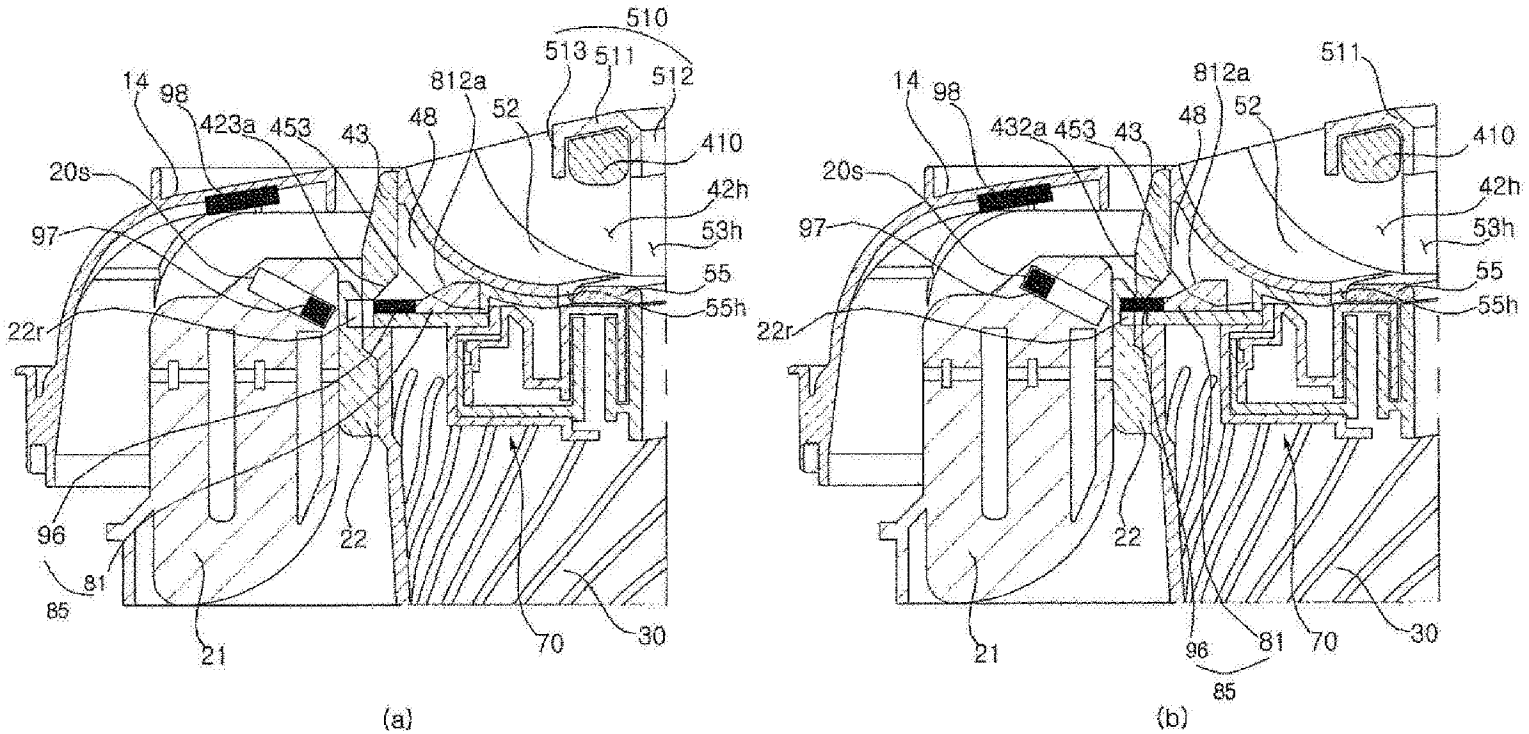

【Figure 36】
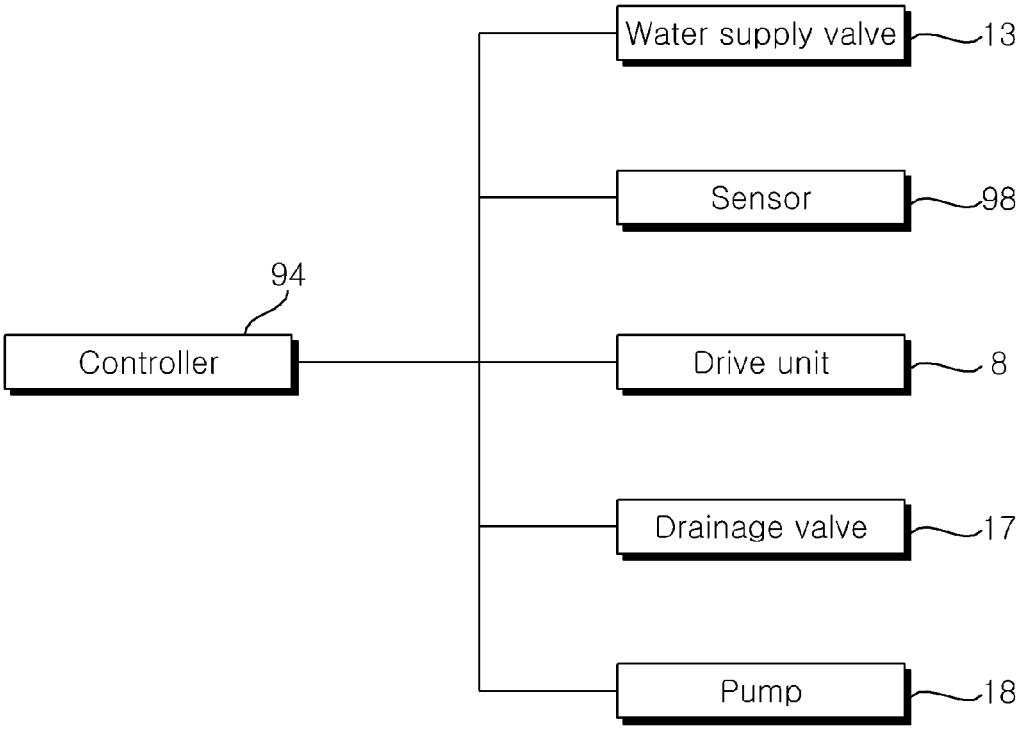

LAUNDRY TREATMENT MACHINE

CROSS REFERENCE TO RELATED APPLICATIONS

This application is a National Stage application under 35 U.S.C. § 371 of International Application No. PCT/KR2018/016890, filed on Dec. 28, 2018, which claims the benefit of Korean Patent Application No. 10-2018-0053498, filed on May 10, 2018, Korean Patent Application No. 10-2018-0005233, filed on Jan. 15, 2018, and Korean Patent Application No. 10-2017-0182267, filed on Dec. 28, 2017. The disclosures of the prior applications are incorporated by reference in their entirety.

TECHNICAL FIELD

The present disclosure relates to a laundry treatment machine, and more particularly, to a laundry treatment machine having two laundry tanks.

BACKGROUND ART

A laundry treatment machine is a device which treats laundry through various actions such as washing, dehydration, and/or drying. The laundry treatment machine includes a washing machine which removes contamination from laundry using water and detergent, a dehydrator which rotates a drum into which wet laundry is put at a high speed to dehydrate the laundry, a dryer which supplies dry air into a drum into which laundry is put to dry the laundry, or a dry combined use washing machine which has both a drying function and a washing function.

Recently, a washing machine having two laundry tubs has been launched. The washing machine has a large capacity laundry tub and a small capacity laundry tub, and each laundry tub is separated from each other. The washing machine is convenient because respective laundry tubs can be used at the same time or at different times according to the user's needs, and further, is very economical because only a small capacity laundry tub can be used when a small amount of laundry is required.

However, in the washing machine of the related art, since the two laundry tubs are separated, the overall size of the washing machine is inevitably increased due to spaces which accommodate the laundry tubs respectively. Moreover, two drive units for the laundry tubs, two water supply mechanisms for supplying water, and two drainage mechanisms for draining water are required, a price of a product also increases.

DISCLOSURE

Technical Problem

In objects of the present disclosure, a first object is to provide a laundry treatment machine which prevents a second laundry tub from being separated from a first laundry tub while the first laundry tube and the second laundry tub provided above the first laundry tub are rotated integrally with each other.

A second object is to provide a laundry treatment machine which prevents a movement of the second laundry tub in an up-down direction while the first laundry tube and the second laundry tub are rotated integrally with each other.

A third object is to provide a laundry treatment machine in which the second laundry tub and the first laundry tub are automatically locked during rotations thereof, and when the rotations are stopped, the locked state is automatically released.

A fourth object is to provide a laundry treatment machine in which the second laundry tub is detachably installed in the first laundry tub permanently installed in a cabinet, in which in a process in which the second laundry tub is rotated integrally with the first laundry tub, the second laundry tub and the first laundry tub are locked to each other by a centrifugal force so that second laundry tub is not separated from the first laundry tub. In particularly, a laundry treatment machine is provided, in which the second laundry tub includes a channel for draining water used in washing, a locker locked (or secured) to the first laundry is disposed in the second laundry tub, and the locker is disposed in a space separated from the channel.

A fifth object is to provide a laundry treatment machine in which the second laundry tub is configured to include a lower cover and an upper cover and the locker is disposed between the lower cover and the upper cover. In the laundry treatment machine having the above-described configuration, the space in which the locker is disposed is separated and partitioned from the channel by only assembling the upper cover after installing the locker in the lower cover.

A sixth object is to provide a laundry treatment machine in which an operation of the locker is not implemented by a separate active driving source such as a motor, but is implemented mechanically by centrifugal force generated when the second laundry tub is rotated, and in particular, an airtight structure to prevent corrosion of the spring is applied to a structure in which the locker is returned to an original position of the locker by a restoring force of a spring.

A seventh object is to provide a laundry treatment machine in which water is prevent from entering the space in which the locker is accommodated in a process in which water in the second laundry tub is drained.

An eighth object is to provide a laundry treatment machine which prevents the second laundry tub from being separated from a first laundry tub while the first laundry tube and the second laundry tub provided above the first laundry tub are rotated integrally with each other.

A ninth object is to provide a laundry treatment machine which prevents a movement of the second laundry tub in the up-down direction while the first laundry tube and the second laundry tub are rotated integrally with each other.

A tenth object is to provide a laundry treatment machine in which the second laundry tub and the first laundry tub are automatically locked during rotations thereof, and when the rotations are stopped, the locked state is automatically released.

An eleventh object is to provide a laundry treatment machine in which the second laundry tub is detachably installed in the first laundry tub permanently installed in the cabinet and includes the locker securing the second a laundry tub to the first laundry tub, and which can detect whether or not the lock is correctly performed by the locker.

Technical Solution

According to an aspect of the present disclosure, there is provided a laundry treatment machine including: a water tank in which water is stored; a first laundry tub which is rotatably provided in a water tank to accommodate first laundry and is rotated about a vertical axis; a second laundry tub which accommodates second laundry, is detachably coupled to the first laundry tub, and is rotated integrally with the first laundry tub; and a locker which is provided in the second laundry tub and fixes the second laundry tub so that the second laundry tub is not removed from the first laundry tub while the second laundry tub is rotated.

The locker includes a locking member which is located at a first position in a state where the second laundry tub is stopped, is moved from the first position to a second position by a centrifugal force when the second laundry tub is rotated, and engages with the first laundry tub at the second position to fix the second laundry tub to the first laundry tube, and an elastic member which is elastically deformed when the locking member is located at the second position and is restored to an original shape to return the locking member to the first position when the rotation of the second laundry tub is stopped.

According to another aspect of the present disclosure, there is provided a laundry treatment machine including: a water tank in which water is stored; a first laundry tub which is rotatably provided in a water tank to accommodate first laundry and is rotated about a vertical axis; a second laundry tub which accommodates second laundry, is detachably coupled to the first laundry tub, and is rotated integrally with the first laundry tub; and a locker which is provided in any one of the first laundry tub and the second laundry tub and fixes the one so that the one is not removed from the other of the first laundry tub and the second laundry tub.

The locker includes an elastic member, and a locking member which is supported by the elastic member, is located at a first position in a state where the second laundry tub is removed from the first laundry tub, is moved from the first position from a second position by an interference with the other of the first laundry tub and the second laundry tub in a process in which the second laundry tub is mounted on the first laundry tub, is returned to the first position by the elastic member in a state where the mounting of the second laundry tub on the first laundry tub is completed, and engages with the other at the first position to fix the second laundry tub to the first laundry tub.

According to still another aspect of the present disclosure, there is provided a laundry treatment machine including: a first laundry tub which is rotated about a vertical axis; a second laundry tub which is detachably coupled to the first laundry tub and is rotated integrally with the first laundry tub; and a locker which is provided in the second laundry tub and fixes the second laundry tub so that the second laundry tub is not removed from the first laundry tub while the second laundry tub is rotated.

wherein the second laundry tub includes a container which accommodates laundry, and a laundry tub cover which covers the container and includes an input port through which the laundry is put into the container.

The laundry tub cover includes a lower cover which is coupled to an upper side of the container and includes an inlet into which water raised in the container flows when the first laundry tub is rotated and an outlet from which the water flowing in through the inlet is discharged, and an upper cover which is coupled to an upper side of the lower cover and defines a channel from the inlet to the outlet.

The lower cover includes a space in which a pair of partition walls is formed and the locker is accommodated between the pair of partition walls, and the space is separated from the channel by the pair of partition walls.

According to still another aspect of the present disclosure, there is provided a laundry treatment machine including: a water tank which stores water and has an open upper surface; a first laundry tub which is rotated about a vertical axis in the water tank; a second laundry tub which is detachably coupled to the first laundry tub, and is rotated integrally with the first laundry tub; a locking member which is provided in the second laundry tub, is moved to a lock position by a centrifugal force when the second laundry tub is rotated at a preset dehydration rate to engage with first laundry tub, and is returned to an unlock position when the second laundry tub is stopped to release the engagement between the first laundry tub and the locking member; a first magnet which is disposed in the locking member; a second magnet which is disposed in the first laundry tub and applies a repulsive force between the first magnet and the second magnet; and a sensor which is disposed in a predetermined structure fixed outside the first laundry tub and detects the second magnet.

The second laundry tub includes a raising/lowering guide which guides the second magnet so that the second magnet is gradually raised in a process in which the second magnet is moved by the repulsive force applied from the first magnet.

The second magnet is located at the first position at which the second magnet causes the sensor to not perform sensing when the locking member is located at the unlock position, and when the locking member is moved to the lock position, the second magnet is moved along the raising/lowering guide by the repulsive force applied from the first magnet to reach the second position and causes the sensor to perform the sensing.

Advantageous Effects

According to the laundry treatment machine of the present disclosure, it is possible to prevent the second laundry tub from being separated from the first laundry tub while the first laundry tub and the second laundry tube provided above the first laundry tub are rotated integrally with each other.

In particular, the second laundry tub is prevented from being moved in the up-down direction while the first laundry tub and the second laundry tube are rotated integrally with each other, and thus, a phenomenon that the second laundry tub impacts the door located above the second laundry tub does not occur. Accordingly, it is possible to prevent breakage of the machine, and thus, to prevent an accident.

Moreover, the second laundry tub and the first laundry tub are automatically locked during the rotations thereof, and when the rotations are stopped, the lock state is automatically released, and thus, usability is improved. In particular, the process of the locking is not a method of using a separate electric force, but is a method using a centrifugal force naturally generated by the rotation or an elastic force of the elastic member. Accordingly, a structure for the lock is simple and a manufacturing cost is low.

In addition, the lock is released without a separate operation of a user in the state where the operation of the laundry treatment machine is ended. Accordingly, the second laundry tub can be removed without the user having to be aware of whether the lock is released, and thus, usability is improved.

Moreover, in a structure in which the locker is provided in the second laundry tub and the second laundry tub includes the channel for draining water used for washing, the locker is disposed in a space separated from the channel. Accordingly, it is possible to prevent the space in which the locker is accommodated from being flooded. In particular, it is possible to prevent water from entering the space in which the locker is accommodated in the process in which the water in the second laundry tub is drained.

In addition, after the locker is installed in the lower cover, the space in which the locker is disposed can be separated and partitioned from the channel only by assembling the upper cover.

Moreover, by detecting whether the locker securing the second laundry tub to the first laundry tub is operated correctly, it is possible to prevent a problem that the second laundry tub is separated from the first laundry tub while the second laundry tub is rotated integrally with the first laundry tub.

DESCRIPTION OF DRAWINGS

FIG. 1 is a side cross-sectional view of a laundry treatment machine according to an embodiment of the present disclosure.

FIG. 2 is a perspective view of a second laundry tub illustrated in FIG. 1.

FIG. 3 is a view illustrating a state where the second laundry tub illustrated in FIG. 2 is exploded.

FIG. 4 is a view when a state where the second laundry tub illustrated in FIG. 2 is installed in a balancer is viewed from above.

FIG. 5 is a cross-sectional taken along line A-A of FIG. 4 and illustrates a state where a locking member is located at a first position, and FIG. 6 illustrates a state where the locking member is located at a second position.

FIG. 7 illustrates another embodiment of a locker.

FIG. 8 is a side cross-sectional view of a laundry treatment machine according to another embodiment of the present disclosure.

FIG. 9 is a perspective view of a second laundry tube illustrated in FIG. 8.

FIG. 10 is an exploded perspective view of the second laundry tub illustrated in FIG. 9.

FIG. 11 is a perspective view illustrating a laundry tub cover illustrated in FIG. 10.

FIG. 12 is a perspective view illustrating a state where the second laundry tub illustrated in FIG. 9 is installed in a balancer.

FIG. 13 is a view when an assembly illustrated in FIG. 12 is viewed from above.

FIG. 14 is a cross-sectional view taken along line B-B of FIG. 13 and illustrates a state where the locking member is located at the first position.

FIG. 15 is a cross-sectional view taken along line C-C of FIG. 14.

FIG. 16 is a view when an upper cover illustrated in FIG. 10 is viewed from above.

FIG. 17 is a view illustrating a state where the upper cover illustrated in FIG. 10 and a container are separated from each other.

FIG. 18 is a view illustrating a state where a locker is installed in the upper cover illustrated in FIG. 10 and, in particular, illustrates a state where the locker is disposed between a pair of partition walls.

FIG. 19 is a cross-sectional view taken along line D-D of FIG. 18.

FIG. 20 is an enlarged view of a portion of FIG. 14, (a) illustrates a state where the locking member is located at the first position, and (b) illustrates a state where the locking member is located at the second position.

FIG. 21(*a*) illustrates a lower cover according to another embodiment of the present disclosure and FIG. 21(*b*) illustrates a portion of a bottom surface of an upper cover.

FIG. 22 is a view when a portion of FIG. 21 indicated by E is viewed from above.

FIG. 23 is a side cross-sectional view of a laundry treatment machine according to still another embodiment of the present disclosure.

FIG. 24 is a perspective view of a second laundry tub illustrated in FIG. 23.

FIG. 25 is an exploded perspective view of the second laundry tub illustrated in FIG. 24.

FIG. 26 is a perspective view illustrating a laundry tub cover illustrated in FIG. 25.

FIG. 27 is a perspective view illustrating a state where the second laundry tub illustrated in FIG. 24 is installed in a balancer.

FIG. 28 is a view when an assembly illustrated in FIG. 27 is viewed from above.

FIG. 29 is a cross-sectional view taken along line F-F of FIG. 28 and illustrates a state where a locking member is located at a first position.

FIG. 30 is a cross-sectional view taken along line G-G of FIG. 29.

FIG. 31 is a view when an upper cover illustrated in FIG. 25 is viewed from above.

FIG. 32 is a view illustrating a state where the upper cover illustrated in FIG. 31 and a container is separated from each other.

FIG. 33 is a view illustrating a state where a locker is installed in the upper cover illustrated in FIG. 25 and, in particular, illustrates a state where the locker is disposed between a pair of partition walls.

FIG. 34 is a cross-sectional view taken along line H-H of FIG. 33.

FIG. 35 is an enlarged view of a portion of FIG. 29, (a) illustrates a state where the locking member is located at a first position and (b) illustrates a state where the locking member is located at a lock position.

FIG. 36 is a block diagram illustrating a control relationship between main components of the laundry treatment machine according to an embodiment of the present disclosure.

MODE FOR INVENTION

FIG. 1 is a side cross-sectional view of a laundry treatment machine according to an embodiment of the present disclosure. FIG. 2 is a perspective view of a second laundry tub. FIG. 3 is a view illustrating a state where the second laundry tub is exploded. FIG. 4 is a view when a state where the second laundry tub is installed in a balancer is viewed from above.

Referring to FIGS. 1 to 4, a cabinet 2 forms an external appearance of the laundry treatment machine, and a space in which a water tank 4 is accommodated is formed in the cabinet 2. The cabinet 2 is supported by a flat cabinet base 5, an upper surface thereof is open, and the cabinet 2 may include a front surface, a left surface, a right surface, and a back surface.

A top cover 3 may be coupled to an open upper end of the cabinet 2. The top cover 3 may include an input port for input and withdrawal of laundry. A door (not illustrated) which opens and closes the input port may be rotatably coupled to the top cover 3.

The water tank 4 is for storing washing water, and can be suspended in the cabinet 2 by a support rod 15. The support rod 15 may be provided in each of four corners of the cabinet 2, one end of each support rod 15 is pivotally connected to the top cover 3, and the other end thereof is connected to the water tank 4 by a suspension 27 for dampening vibrations.

The water tank 4 has an open upper surface, and a water tank cover 14 may be provided on the opened upper surface. The water tank cover 14 is formed in a ring shape in which a substantially circular opening portion is formed in a central portion, and the laundry is input through the opening portion.

A first laundry tub 6 which accommodates the laundry and rotates about a vertical axis (O, refer to FIG. 4) may be disposed in the water tank 4. The vertical axis is substantially perpendicular to the ground, and may be precisely aligned with the ground. However, the vertical axis is not limited thereto, and the vertical axis may be inclined at a predetermined angle (preferably, 5° or less) with respect to a vertical line. In the first laundry tub 6, a plurality of through holes through which water passes may be formed, and water may flow between the first laundry tub 6 and the water tank 4 through the through holes.

The first laundry tub 6 may include a drum 6*a* having an open upper side and a ring-shaped balancer 20 coupled to an upper portion of the drum 6*a*. A lower side of the drum 6*a* may be connected to a rotating shaft of a drive unit 8 by a hub 29. The through hole may be formed in the drum 6*a*.

The balancer 20 compensates for eccentricity caused when the drum 6*a* rotates. Annular cavities 62*a* and 62*b* (refer to FIG. 5) may be formed inside the balancer 20. A fluid (for example, salt water) or a plurality of weight bodies (for example, metal spheres) may be inserted into the cavities 62*a* and 62*b*. The annular cavities 62*a* and 62*b* have different diameters, but a plurality of concentric cavities may be formed.

If the drum 6*a* is biased to one side while being rotated, fluids or weights are moved to a side opposite to the biased direction of the drum 6*a* to correct the eccentricity. Various types of the ring-type balancer 20 applied to the laundry treatment machine are already known, and further description will be omitted.

A second laundry tub 100 detachable from the first laundry tub 6 is provided. The second laundry tub 100 accommodates laundry and is detachably coupled with the first laundry tub 6. When the first laundry tub 6 is rotated in a state where the second laundry tub 100 is installed, the second laundry tub 100 is also rotated integrally with the first laundry tub 6.

If necessary, the user may input first laundry into only the first laundry tub 6 in a state where the second laundry tub 100 is not installed, or install the second laundry tub 100 to input second laundry into the second laundry tub 100.

A pulsator 9 may be rotatably provided in an inner lower portion of the first laundry tub 6. The pulsator 9 may include a plurality of radial ribs protruding upward. When the pulsator 9 is rotated, a water flow may be formed by the ribs.

A drive unit 8 for providing power to rotate the first laundry tub 6 and the pulsator 9 may be disposed in the cabinet 2. The drive unit 8 is disposed under the water tank 4 and may be provided to be suspended in the cabinet 2 together with the water tank 4. A rotating shaft of the drive unit 8 is always coupled with the pulsator 9, and may be coupled with or decoupled from the first laundry tub 6 according to a switching operation of the clutch (not illustrated). Therefore, when the drive unit 8 is operated in a state where the rotating shaft of the drive unit 8 is coupled with the first laundry tub 6, the pulsator 9 and the first laundry tub 6 are integrally rotated, and when the drive unit 8 is operated in a state where the rotating shaft is separated from the first laundry tub 6, only the pulsator (9) is rotated in a state where the first laundry tub (6) is stopped.

The drive unit 8 may include a washing motor capable of controlling a speed. The washing motor may be an inverter direct drive motor. A controller (not illustrated) may be configured to include a Proportional-Integral controller (PI controller), a Proportional-Integral-Derivative controller (PID controller), or the like. The controller receives an output value (for example, output current) of the washing motor as an input, and may perform a control based on the received output value so that the rotating speed (or rotation speed) of the washing motor follows the preset target rotating speed (or target rotation speed).

The controller may control not only the washing motor but also all operations of the laundry treatment machine, and it will be understood that a control of each of the components mentioned below is made by the control of the controller.

Meanwhile, the laundry treatment machine may include at least one water supply pipe 11 which guides water supplied from an external water source such as a tap. At least one water supply pipe 11 may include a cold water pipe (not illustrated) receiving cold water from an external water source and a hot water pipe (not illustrated) receiving hot water.

A water supply unit 13 for supplying water supplied from the external water source to the first laundry tub 6 and/or the second laundry tub 100 may be provided. The water supply unit 13 may selectively control the at least one water supply pipe 11. To this end, the water supply unit 13 may include at least one water supply valve. When the at least one water supply valve is opened under the control of the controller, water is supplied to a dispenser 16 through the water supply pipe corresponding to the opened water supply valve.

The dispenser 16 supplies an additive acting on the laundry together with the water supplied through the water supply pipe 11. The additive supplied by the dispenser 16 includes a laundry detergent and a rinse fiber softener.

The second laundry tub 100 may be inserted into a space (or an approximately circular opening) defined by the ring-shaped balancer 20, and supported by the balancer 20 in the inserted state. An unevenness 114 extending obliquely in the up-down direction may be formed on the outer circumferential surface of the second laundry tub 100.

The balancer 20 may have a fixing groove 62*d* corresponding to the unevenness 114 on an inner peripheral surface defining a central opening portion. The unevenness 114 is inserted along the fixing groove 62*d*, and thus, when the first laundry tub 6 is rotated, the second laundry tub 100 is not idle and can be integrally rotated with the first laundry tub 6.

Referring to FIG. 4, when viewed from above, an outer shape of the second laundry tub 100 may include a first section S1 which is in contact with the inner peripheral surface (or a surface defining a central opening portion) of the balancer 20 and a second section S2 which is spaced apart from the inner peripheral surface of the balancer 20.

The first section S1 may be located on a first axis A-A passing through the vertical axis O, and the second section S2 may be located on a second axis Y which passes through the vertical axis O and is orthogonal to the first axis A-A. The first section S1 may be formed on both sides symmetrically with respect to the second axis Y, and the second section S2 may be formed on both sides symmetrically with respect to the first axis A-A.

When the controller controls the drive unit 8 so that the first laundry tub 6 (or second laundry tub 100) is located at a first rotational position, the water discharged from the water supply unit 13 may be supplied to the first laundry tub 6 through a gap formed between the second section S2 and the inner peripheral surface of the balancer 20.

When the controller controls the drive unit 8 so that the first laundry tub 6 is located at a second rotation position which is rotated by a predetermined angle from the first rotation position, the water discharged from the water supply unit 13 is supplied to the second laundry tub 100. The second laundry tub 100 may include an inlet 137 into which the water discharged from the water supply unit 13 flows, and the inlet 137 is aligned with the water supply unit 13 at the second rotation position. The inlet 137 may be disposed both sides (137(1) and 137(2) indicate both inlets) of the second laundry tub 100, and preferably, may be disposed along the first axis A-A to be symmetrically with respect to the second axis Y.

The second rotation position may be the position at which the first laundry tub 6 is rotated by 90° from the first rotation position. As described above, since the washing motor is capable of controlling the speed, the controller can control a rotation angle of the first laundry tub 6 or a rotation position of the first laundry tub 6 based on the speed of the washing motor.

Specifically, the water tank cover 14 may include a first hall sensor (not illustrated), and the second laundry tub 100 may include a first magnet. While the second laundry tub 100 is rotated, the first hall sensor may be configured to detect a magnetic field formed by the first magnet and send a signal to the controller based on the detected magnetic field. Based on the received signal, the controller can determine a rotation speed, a rotational position (or position of the first magnet), a rotation angle, or the like of the second laundry tub 100, and based on these, the controller can control the washing motor so that the first laundry tub 6 is aligned with the first rotation position or the second rotation position.

Meanwhile, a second magnet may be further provided in a rotor of the washing motor, and a second hall sensor for detecting a magnetic field generated by the second magnet may be disposed in a fixed structure (for example, a bottom surface of the water tank 4) near the second magnet. A plurality of second magnets may be disposed along a periphery of the rotor. The controller may control the washing motor based on a signal output from the second hall sensor, and in this case, by together considering the signal output from the first hall sensor, the controller may control the second laundry tub 100 so that the second laundry tub 100 is aligned with the first rotation position or the second rotation position.

Meanwhile, according to an embodiment, the rotation angle of the rotor may be detected without a separate sensor. That is, it is possible to detect a rotation angle of the rotor in a sensor-less manner without a sensor. In the sensor-less method, after a phase current having a constant frequency phase current flows through the washing motor, a position of the rotor of the washing motor can be estimated based on an output current detected while the current having the constant frequency flows through the washing motor. This sensor-less method is a known technique, detailed descriptions thereof are omitted.

The second laundry tub 100 may include a container 110, a first cover 120, and a second cover 130. The container 110 contains laundry and water, and an upper side thereof is opened, and a first cover 120 is coupled to the opened upper side. The first cover 120 may be coupled with an upper end of the container 110. The first cover 120 and the container 110 are made of a synthetic resin material, and are coupled with each other by welding, preferably, thermal welding, more preferably. However, the present disclosure is not limited thereto.

A guide rib 126 which protrudes from an inner surface of the container 110 and extends in the up-down direction may be provided. After the water flow generated by the rotation of the second laundry tub 100 is raised by collision with the guide rib 126, the water may fall to a center of the container 110. The unevenness 114 may be formed on the outer surface of the container 110. The container 110 may be made of a transparent material so that laundry accommodated inside the container 110 is visible from the outside.

An opening portion 121 is formed at a substantially center of the first cover 120 so that laundry can be put into the container 110, and a space for accommodating a detergent box (140, refer to FIGS. 5 and 6) is provided in the first cover 120. The detergent box 140 may be detached from the first cover 120. The detergent box 140 may be provided on each of both sides of the first cover 120.

When the second laundry tub 100 is rotated, in the container 110, a water flow developed toward the outside along a radial direction by a centrifugal force is raised along the inner surface of the container 110. The first cover 120 may include a channel for guiding the raised water flow to an outlet 124. The controller may control the speed of the second laundry tub 100 (or the speed of the drive unit 8) so that the water in the container 110 is discharged through the outlet 124, and in this case, the water discharged through the outlet 124 is collected in the water tank 4. This process may be performed when the laundry in the second laundry tub 100 is washed and then the water used for the washing is drained.

Meanwhile, although not illustrated, a check valve for interrupting the channel may be further provided, and the check valve may be configured to be opened or closed by the centrifugal force caused by rotation of the second laundry tub 100 or to be opened or closed by a hydraulic pressure.

The second cover 130 is detachably coupled with the first cover 120, and an opening portion 131 is formed at a substantially center of the second cover 130. The second cover 130 includes a water supply guide 133 which guides the water discharged from the water supply unit 13 to the detergent box (140, refer to FIG. 5). The water supply guide 133 forms an inclined surface so that the water discharged from the water supply unit 13 is guided downward, and the water guided along the inclined surface is supplied to the detergent box 140 through a water supply port (141, refer to FIG. 4). The water supply guide 133 may be provided on each of both sides of the first cover 120. Preferably, both water supply guides 133(1) and 133(2) may be disposed along the first axis A-A to be symmetric with respect to the second axis Y.

The detergent box 140 contains a detergent, bleach or a fabric softener, the water discharged from the water supply unit 13 passes through the detergent box 140, and thus, the water is supplied into the second laundry tub 100 together with detergent.

The first cover 120 may include a housing 128 in which the detergent box 140 is accommodated, and the detergent box 140 is coupled with the housing 128 to be withdrawn. A siphon tube 143 may extend upward from a bottom 142 of the detergent box 140 in order to smoothly supply a liquid detergent, and a siphon cover 145 covering the siphon tube 143 may be further provided (refer to FIGS. 5 and 6).

A lower end of the siphon tube 143 communicates with the bottom 142 and an upper end thereof is open. Moreover, the siphon cover 145 is configured to form a channel having an annular cross section between an outer peripheral surface of the siphon cover 143 and the siphon cover 145. When the water is supplied and a water level in the detergent box 140 increases along the channel, the water flows into the siphon tube 143 through the opened upper end of the siphon tube 143, and then, is discharged to the second laundry tub 100 through the opened lower end of the siphon tube 143.

The detergent box 140 may be provided in each of both sides of the second cover 130. The detergent boxes 140 may be disposed at positions corresponding to the pair of inlets 137(1) and 137(2). A detergent or bleach may be input into a first detergent box 140(1) and a fabric softener may be input into a second detergent box 140(2). The water discharged from the water supply unit 13 is selectively supplied to the first detergent box 140(1) or the second detergent box 140(2) according to the rotation position of the second laundry tub 100. For example, the rotation position of the second laundry tub 100 is controlled by the controller so that the water is supplied to the first detergent box 140(1) during a washing process and the water is supplied to the second detergent box 140(2) during a rinse process.

The laundry treatment machine may further include a drainage bellows 21 for discharging water from the water tank 4 and a drainage valve 22 for controlling the drainage bellows 21. The drainage bellows 21 may be connected to a pump 24. When the drainage valve 22 is opened, the water may be supplied to the pump 24 through the drainage bellows 21. The water which has flowed into the pump 24 is discharged to the outside of the laundry treatment machine through a drainage pipe 25 when the pump 24 is operated.

FIG. 5 is a cross-sectional taken along line A-A of FIG. 4 and illustrates a state where a locking member is located at a first position. FIG. 6 illustrates a state where the locking member is located at a second position.

The laundry treatment machine according to the embodiment of the present disclosure includes a locker 150 which is provided in the second laundry tub 100 and fixes the second laundry tub 100 so that the second laundry tub 100 is not removed from the first laundry tub 6 while the second laundry tub 100 is rotated. The locker 150 may be provided in the first cover 120.

The locker 150 includes a locking member 165 and an elastic member 161. The locking member 165 is located at the first position (refer to FIG. 5) in a state where the second laundry tub 100 is stopped, and is moved from the first position to the second position (refer to FIG. 6) by a centrifugal force when the second laundry tub 100 is rotated. The locker 150 engages with the first laundry tub 6 at the second position to fix the second laundry tub 100 to the first laundry tub 6. A straight line connecting the first position to the second position may intersect the second section S2.

The balancer 20 may include a locking groove 62*c* into which the locking member 165 is inserted at the second position. When the second laundry tub 100 is inserted into a center portion of the ring-shaped balancer 20 and is rotated at a predetermined speed or more in a state of being aligned at a preset rotation position, the locking member 165 is moved outward by the centrifugal force along the radial direction to reach the second position, and in this process, the locking member 165 is inserted into the locking groove 62*c*. Even when the second laundry tub 100 is shaken or vibrated during the rotation thereof, since the locking member 165 and the locking roove 62*c* engage with each other, the second laundry tub 100 is prevented from being removed, and in particular, the second laundry tub 100 is restrained from being moved upward, and thus, a problem that the second laundry tub 100 impacts the door does not occur. Even when the second laundry tub 100 is rotated at a high speed (for example, a dehydration process), it is possible to prevent the machine from being damaged and prevent an accident.

In particular, the locking of the second laundry tub 100 is not performed by a separate power mechanism (for example, a motor), and the locking is performed by the centrifugal force caused by the rotation of the second laundry tub 100. Accordingly, it is possible to simply configure a structure for the lock and it is not necessary to take a special control for the lock.

The elastic member 161 is elastically deformed when the locking member 165 is located at the second position, and when the rotation of the second laundry tub 100 is stopped, the elastic member 161 is restored to an original shape and returns the locking member 165 to the first position. When the rotation of the second laundry tub 100 is stopped, the locking member 165 is returned to the first position by a restoring force of the elastic member 161, and thus, the lock is automatically released. When the washing is completed, since the lock is automatically released, the second laundry tub 100 can be easily lifted without the user having to perform a separate operation for releasing the lock.

The second laundry tub 100 includes a guide groove 127 which guides the locking member 165 so that the locking member 165 is moved from the first position toward the second position. The guide groove 127 may be formed in the first cover 120. The elastic member 161 is disposed in the guide groove 127, one end thereof is fixed to the first cover 120, and the other end thereof may be connected to the locking member 165. The elastic member 161 may include a spring 161 which is tensioned when the locking member 165 is moved from the first position to the second position.

The locking member 165 may include a head 163 which is inserted into the locking groove 62*c* and a stem 162 which extends long from the head 163. The head 163 is connected to the spring 161. After the stem 162 passes through the spring 161, the stem 162 can be inserted into a support groove 129 formed in the first cover 120. It is preferable that an inner diameter of the support groove 129 is formed to be slightly larger than an outer diameter of the stem 162 so as to allow movement of the stem 162 while preventing shaking during the movement. In FIGS. 5 to 7, the head 163 is illustrated in a spherical shape, but is not limited thereto, and may be configured in various forms.

Even when the locking member 165 is located at any point between the first position and the second position, the stem 162 is configured to maintain a state where the stem 162 is always inserted into the support groove 129, and thus, the locking member 165 is not shaken during the movement and can be stably supported.

FIG. 7 illustrates another embodiment of the locker. Referring to FIG. 7, a locker 150' according to the present embodiment is provided in any one (in the embodiment, the second laundry tub 100) of the first laundry tub 6 and the second laundry tub 100, and fixes the second laundry tub 100 so that the second laundry tub 100 is not removed from the first laundry tub 6.

The locker 150' includes the elastic member 161 and the locking member 165. The locking member 165 is supported by the elastic member 161 and is located at a first position P1 in a state where the second laundry tub 100 is removed from the first laundry tub 6. The locking member 165 is moved from the first position P1 to the second position P2 by an interference between the locking member 165 and the other of the first laundry tub 6 and the second laundry tub 100 in a process in which the second laundry tub 100 is mounted on the first laundry tub 6, and in a state where the mounting of the second laundry tub 100 to the first laundry tub 6 is completed, the locking member 165 is returned to the first position P1 by the elastic member 161, engages with the other (in the embodiment, the first laundry tub 6) at the first position P1, and fixes the second laundry tub 100 to the first laundry tub 6.

The other includes the locking groove 62*c* into which the locking member 165 is inserted at the first position P1. The locking groove 62*c* may be formed on an inner peripheral surface (that is, the space (that is, the center portion of the balancer) formed in an annular shape) of the balancer 20.

Meanwhile, as the above-described embodiment, when the second laundry tub 100 is rotated, the locking member 165 can be moved to a third position P3 by the centrifugal force. Here, the third position P3 is located outside the first position P1 in the radial direction. The locking member 165 is inserted deeper into the locking groove 62*c* at the third position P3, and thus, the second laundry tub 100 is more firmly locked to the first laundry tub 6. The elastic member 161 may be connected to the locking member 165, and in this case, when the rotation of the second laundry tub 100 is stopped, the stretched elastic member 161 is restored to the original shape, and thus, the locking member 165 is also returned from the third position to the first position P1.

FIG. 8 is a side cross-sectional view of a laundry treatment machine according to another embodiment of the present disclosure. FIG. 9 is a perspective view of a second laundry tube illustrated in FIG. 8. FIG. 10 is an exploded perspective view of the second laundry tub illustrated in FIG. 9. FIG. 11 is a perspective view illustrating a laundry tub cover illustrated in FIG. 10. FIG. 12 is a perspective view illustrating a state where the second laundry tub illustrated in FIG. 9 is installed in a balancer. FIG. 13 is a view when an assembly illustrated in FIG. 12 is viewed from above. FIG. 14 is a cross-sectional view taken along line B-B of FIG. 13 and illustrates a state where a locking member is located at a first position. FIG. 15 is a cross-sectional view taken along line C-C of FIG. 14. FIG. 16 is a view when an upper cover illustrated in FIG. 10 is viewed from above. FIG. 17 is a view illustrating a state where the upper cover illustrated in FIG. 10 and a container are separated from each other. FIG. 18 is a view illustrating a state where a locker is installed in the upper cover illustrated in FIG. 10 and, in particular, illustrates a state where the locker is disposed between a pair of partition walls. FIG. 19 is a cross-sectional view taken along line D-D of FIG. 18. FIG. 20 is an enlarged view of a portion of FIG. 14, (a) illustrates a state where the locking member is located at the first position, and (b) illustrates a state where the locking member is located at the second position. Hereinafter, the laundry treatment machine according to the embodiment of the present disclosure will be described with reference to FIGS. 8 to 20.

Referring to FIG. 8, a cabinet 2 forms an external appearance of the laundry treatment machine, and a space in which a water tank 4 is accommodated is formed in the cabinet 2. The cabinet 2 is supported by a flat cabinet base 5, the cabinet 2 may include a front surface, a left surface, a right surface, and a back surface, and an upper surface of the cabinet 2 is open.

A top cover 3 may be coupled to an open upper surface of the cabinet 2. The top cover 3 may include an opening portion for input and withdrawal of laundry. A door (not illustrated) which opens and closes the opening portion may be rotatably coupled to the top cover 3.

The water tank 4 is for storing water, and can be suspended in the cabinet 2 by a support rod 15. The support rod 15 may be provided in each of four corners of the cabinet 2, one end of each support rod 15 is pivotally connected to the top cover 3, and the other end thereof is connected to the water tank 4 by a suspension 27 for dampening vibrations.

The water tank 4 has an open upper surface, and a water tank cover 14 may be provided on the opened upper surface. The water tank cover 14 is formed in a ring shape in which a substantially circular opening portion is formed in a central portion, and the laundry is input through the opening portion.

A first laundry tub 6 which accommodates the laundry and rotates about a vertical axis may be disposed in the water tank 4. The vertical axis is substantially perpendicular to the ground. The vertical axis may be precisely aligned on a line perpendicular to the ground. However, the vertical axis is not limited thereto, and the vertical axis may be inclined at a predetermined angle with respect to a vertical line. In the first laundry tub 6, a plurality of through holes 6*h* through which water passes may be formed, and water may flow between the first laundry tub 6 and the water tank 4 through the through holes 6*h*.

The first laundry tub 6 may include a drum 6*a* which has an open upper side and the through holes 6*h* and a ring-shaped balancer 20 coupled to an upper portion of the drum 6*a*. A lower surface of the drum 6*a* may be connected to a rotating shaft of a drive unit 8 by a hub 29.

A pulsator 9 may be rotatably provided in an inner lower portion of the first laundry tub 6. The pulsator 9 may include a plurality of radial wings protruding upward. When the pulsator 9 is rotated, a water flow may be formed by the wings.

The balancer 20 compensates for eccentricity caused when the drum 6*a* rotates. The balancer 20 is coupled to an upper end portion of the drum 6*a*. Referring to FIGS. 12 to 14, the balancer 20 may include a balancer body 21 forming ring-shaped cavities 20*h*1 and 20*h*2. A fluid (for example, salt water) or a plurality of weight bodies (for example, metal spheres) may be inserted into the cavities 20*h*1 and 20*h*2. The annular cavities 20*h*1 and 20*h*2 are concentric cavities. However, a plurality of cavities having different diameters may be formed.

If the drum 6*a* is biased to one side while being rotated, fluids or weights are moved to a side opposite to the biased direction of the drum 6*a* to correct the eccentricity. Various types of the ring-type balancer 20 applied to the laundry treatment machine are already known, and further description will be omitted.

The second laundry tub 10 may be inserted into the space (or, a substantially circular opening portion) defined by the ring-shaped balancer 20, and can be supported by the balancer 20 in the state where the second laundry tub 10 is inserted into the space. The second laundry tub 10 includes a container 30 in which the laundry is contained and a laundry tub cover 60 which covers the container 30. The laundry and water are contained in the container 30, an upper surface of the container 30 is open, and the laundry tub cover 60 covers at least a portion of the opened upper surface. The container 30 may be made of a transparent material so that laundry accommodated inside the container 30 is visible from the outside.

An inner diameter portion (when viewed from above, a portion forming an inner circle of two circles constituting the ring shape) of the balancer body 21 includes a ring-shaped support portion 22 supporting the container 30. A plurality of engagement grooves 22*c* (refer to FIG. 15)

extending in the up-down direction are arranged in the support portion 22 along the circumferential direction. Each engagement groove 22*c* may be formed in a spiral shape.

An outer surface of the container 30 may be formed with threads 33 in the form of protrusions which engage with the engagement grooves 22*c* formed on the support portion 22. The thread 33 extends up and down in a shape corresponding to the engagement groove 22*c*. That is, when the engagement groove 22*c* is in the form of a spiral, the thread 33 is also a protrusion extending in a spiral shape. The plurality of threads 33 are arranged along the circumferential direction.

The threads 33 constitute a kind of helical gear, and engage with engagement grooves 22*c* formed in a seating portion 33 of the balancer 20. According to this structure, when the first laundry tub 6 is rotated, the second laundry tub 10 can be rotated integrally with the first laundry tub 6 without being idle. In addition, since this type of coupling between the balancer 20 and the container 30 is also a kind of screw coupling, the coupling between the second laundry tub 10 and the first laundry tub 6 is maintained reliably. In particular, the second laundry tub 10 can be fixed without being lowered by a restraining force (for example, a frictional force acting between engaging surfaces) of the coupling between the thread 33 and the engagement groove 22*c*.

The second laundry tub 10 accommodates the laundry and is provided to be detachable to the first laundry tub 6. That is, the second laundry tub 10 is detachably coupled with the first laundry tub 6. When the first laundry tub 6 is rotated in a state where the second laundry tub 10 is installed, the second laundry tub 10 is also rotated integrally with the first laundry tub 6.

The user may input first laundry into only the first laundry tub 6 in a state where the second laundry tub 10 is not installed, or installs the second laundry tub 10 to input second laundry into the second laundry tub 10.

Referring to FIG. 8, a drive unit 8 for providing power to rotate the first laundry tub 6 and the pulsator 9 may be disposed in the cabinet 2. The drive unit 8 is disposed under the water tank 4 and may be suspended in the cabinet 2 in a state of being coupled with the bottom surface of the water tank 4.

A rotating shaft of the drive unit 8 is always coupled with the pulsator 9, and may be coupled with or decoupled from the first laundry tub 6 according to a switching operation of a clutch (not illustrated). Therefore, when the drive unit 8 is operated in a state where the rotating shaft of the drive unit 8 is coupled with the first laundry tub 6, the pulsator 9 and the first laundry tub 6 are integrally rotated, and when the drive unit 8 is operated in a state where the rotating shaft is disconnected to (separated from) the first laundry tub 6, only the pulsator 9 is rotated in a state where the first laundry tub 6 is stopped.

The drive unit 8 may include a washing motor capable of controlling a speed. The washing motor may be an inverter direct drive motor. A controller (not illustrated) may be configured to include a Proportional-Integral controller (PI controller), a Proportional-Integral-Derivative controller (PID controller), or the like. The controller receives an output value (for example, output current) of the washing motor as an input, and may perform a control based on the received output value so that the rotating speed (or rotation speed) of the washing motor follows the preset target rotating speed (or target rotation speed).

The controller may control not only the washing motor but also all operations of the laundry treatment machine, and it will be understood that a control of each of the components mentioned below is made by the control of the controller.

Meanwhile, the laundry treatment machine may include at least one water supply pipe 11 which guides water supplied from an external water source such as a tap. At least one water supply pipe 11 may include a cold water pipe (not illustrated) receiving cold water from an external water source and a hot water pipe (not illustrated) receiving hot water.

A water supply valve 13 for controlling the water supply pipe 11 may be provided. In a case where a plurality of the water supply pipes 11 are provided, a plurality of the water supply valves 13 are provided, and thus, the water supply pipes 11 are respectively controlled by the water supply valves 13. When the at least one water supply valve 13 is opened under the control of the controller, water is supplied to a main dispenser 16 through the water supply pipe 11 corresponding to the opened water supply valve 13.

The main dispenser 16 supplies an additive acting on the laundry to the water tank 4 together with the water supplied through the water supply pipe 11. The additive supplied by the main dispenser 16 includes a laundry detergent, a fabric softener, bleach, or the like.

Meanwhile, the laundry treatment machine may further include a drainage bellows 19*a* for discharging water from the water tank 4 and a drainage valve 17 for controlling the drainage bellows 19*a*. The drainage bellows 19*a* may be connected to a pump 18. When the drainage valve 17 is opened, the water may be supplied to the pump 18 through the drainage bellows 19*a*. The water which has flowed into the pump 18 is discharged to the outside of the laundry treatment machine through a drainage pipe 19*b* when the pump 18 is operated.

An input port 60*h* through which the laundry is input into the container 30 is formed at a substantially center of the laundry tub cover 60. The laundry tub cover 60 may include a lower cover 40 and an upper cover 50 coupled to an upper side of the lower cover 40. The lower cover 40 may be coupled to an upper end portion of the container 30. The lower cover and the container 30 are made of a synthetic resin material, and are coupled with each other by welding, preferably, thermal welding, more preferably. However, the present disclosure is not limited thereto.

The upper cover 50 and the lower cover 40 may be detachably coupled with each other. The lower cover 40 includes a first opening portion 40*h*, and the upper cover 50 includes a second opening portion 50*h* which communicates with the first opening portion 40*h* and constitutes the input portion 60*h*.

A space in which a locker 80, a check valve 91, and a channel FP to be described later are disposed is provided between the upper cover 50 and the lower cover 40, and if necessary, after the user separates the upper cover 50 from the lower cover 40, the user may maintain or repair the locker 80 or the check valve 91 or clean the channel FP.

The laundry tub cover 60 may include a water supply port 51*h* into which the water discharged from the main dispenser 16 flows. The laundry tub cover 60 includes a sub dispenser 70 which accommodates an additive such as a detergent, bleach, or a fabric softener, and the water supplied from the water supply port 51*h* is supplied to the container 30 together with the additive through the sub dispenser 70. Preferably, the additive is liquid so that the additive can be smoothly discharged through a siphon tube 724 to be described later.

Water is supplied through the water supply port 51*h* multiple times. In this case, all additives are discharged through the siphon tube 724 to be described later during the first water supply. Accordingly, in the subsequent water supply, the water (or, raw water) in which the additive is not dissolved is supplied through the sub dispenser 70.

Meanwhile, when the second laundry tub 10 is rotated at a sufficient speed, the water flow developed outward in the radial direction by the centrifugal force in the container 30 is raised along an inner surface (inner surface of container body 31) of the container 30 and may flow into the laundry tub cover 60 through an inlet 425*h* to be described later. The laundry tub cover 60 includes the channel (FP, refer to FIG. 19) which guides the water flow which has flowed in through the inlet 452*h*).

The laundry tub cover 60 may include a nozzle 62 which discharges the water flow guided along the channel FP to the outside of the laundry tub cover 60. The nozzle 62 may be inserted into an outlet (431, refer to FIG. 19) formed in the lower cover 40 and fixed thereto. The nozzle 62 may include a slit-shaped outlet which extends long along a horizontal direction.

The outlet is open downward from the water tank cover 14. The second laundry tub 10 is rotated at a high speed, and the water discharged through the nozzle 62 may be guided along a bottom surface of the water tank cover 14.

As illustrated in FIG. 12, in a state where the second laundry tub 10 is installed in the balancer 20, the nozzle 62 is located above the balancer 20 (that is, is exposed upward from the balancer 20), and thus, the water discharged through the nozzle 62 does not interfere with the balancer 20 and can reach the water tank 4.

Meanwhile, referring to FIG. 20, a vane 35 extending long in the up-down direction is provided on the inner surface of the container 30. The vane 35 protrudes from the inner surface of the container 30 and may be manufactured of a part separated from the container to be installed in the container 30. After the water flow generated by the rotation of the second laundry tub 10 collides with the vane 35, the water flow is raised, and thus, falls to a center portion of the container 30. A plurality of the vanes 35 may be provided, and, preferably, the plurality of vanes 35 may be disposed symmetrically about a rotation center of the second laundry tub 10. In the present embodiment, a pair of vanes 35 is provided. However, the number of the vanes 35 is not limited.

The laundry tub cover 60 may include a handle 61 which is formed around the input port 60*h*. When the laundry tub cover 60 is viewed downward from above, the input port 60*h* is located on one side based on the handle 61, and the water supply port 51*h* is located on the other side thereof. The handle 61 may be provided in each of both sides of the input port 60*h*, and the water supply port 51*h* may also be provided on the other side of each handle 61, respectively.

The sub dispensers 70 may be provided on both sides of the laundry tub cover 60, respectively. In this case, the laundry detergent or bleach may be supplied through one of the pair of sub dispensers 70, and the fabric softener may be supplied through the other.

The sub dispenser 70 may be provided in the lower cover 40. The sub dispensers 70 may be respectively disposed at positions corresponding to the pair of water supply ports 51*h*. Hereinafter, the pair of sub dispensers 70 is divided into a first sub dispenser 70(1) and a second sub dispenser 70(2), respectively.

According to the rotation position (or rotation angle) of the second laundry tub 10, the water discharged from the main dispenser 16 can be selectively supplied to the first sub dispenser 70(1) or the second sub dispenser 70(2). For example, the rotation position (or rotation angle) of the second laundry tub 10 can be controlled by the controller so that water is supplied to the first sub dispenser (70(1)) during the washing process and water is supplied to the second sub dispenser (70(2)) during the rinse process.

Each sub-dispenser 70 may include a dispenser housing 71, a drawer 72 which is housed to be withdrawn in the dispenser housing 71 and has an opened upper surface, and a drawer cover 73 which covers the opened upper surface of the drawer 72. The drawer cover 73 may be detachably coupled with the drawer 72. The drawer cover 73 includes an opening portion 73*h* through which the water discharged from the main dispenser 16 passes, and the water passing through the opening portion 73*h* is supplied into the drawer 72.

The upper cover 50 may include a flow guide 52 which guides the water flowing in through the water supply port 51*h* to the sub dispenser 70. The flow guide 52 forms an inclined surface so that water is guided downward, and the water guided along the inclined surface is guided to the opening portion 73*h* of the drawer cover 73.

The upper cover 50 may include a plate 55 fixed to an upper side of the sub dispenser 70. The plate 55 can be detachable from the upper cover 50. The plate 55 forms a gap 55*h* between a lower end of the flow guide 52 and the plate 55, and the water guided along the flow guide 52 passes through the gap 55*h* and is supplied to the opening portion 73*h* of the drawer cover 73.

The dispenser housing 71 provides a space in which the drawer 72 is accommodated, and can be coupled to the lower cover 40. The dispenser housing 71 may be fixed to the lower cover 40 by fastening members such as screws or bolts.

The drawer 72 is a container having an opened upper surface and the additive is accommodated in the drawer 72. The drawer 72 is coupled to the dispenser housing 71 and this coupling allows the drawer 72 being inserted into the dispenser housing 71 or withdrawn from the dispenser housing 71. In the present embodiment, the drawer 72 is coupled to the dispenser housing 71 in a slidable manner, but is not necessarily limited to thereto. For example, the drawer 72 may be coupled to the dispenser housing 71 in a pivotable manner, that is, may be hinge-coupled to the dispenser housing 71.

Referring to FIG. 14, the drawer 72 may include the siphon tube 724 which protrudes upward from a bottom and the drawer cover 73 may include a siphon cap 732 which covers the siphon tube 724.

An outlet of the siphon tube 724 is formed on the bottom of the drawer 72, and the siphon cap 73 forms a channel having an annular cross section between an outer peripheral surface of the siphon tube 724 and the siphon cap 73. This structure is suitable to supply a liquid additive.

When the water is supplied to the sub dispenser 70 and a water level in the drawer 72 is gradually raised, the water is raised along the channel having an annular cross section, flows into the siphon tube 724 through an inlet of an upper end of the siphon tube 724, and thereafter, is discharged to the container 30 through an outlet on a lower end of the siphon tube 724.

Meanwhile, in order to simultaneously wash the laundry in the first laundry tub 6 and the laundry in the second laundry tub 10, the water is required to be supplied to the first laundry tub 6 in a state where second laundry tub 10 is installed. Hereinafter, how to supply the water to the first laundry tub 6 in the state where the second laundry tub 10 installed will be described.

Referring to FIG. 13, when viewed from above, an outer shape of the second laundry tub 10 may include a first section S1 which is in contact with a support portion 22 of the balancer 20 and a second section S2 which is spaced apart from the support portion 22.

The first section S1 may be located on a first axis (line indicated by B-B) passing through a vertical axis O, and the second section S2 may be located on a second axis Y which passes through the vertical axis O and is orthogonal to the first axis. The first section S1 may be formed on both sides symmetrically with respect to the second axis Y, and the second section S2 may be formed on both sides symmetrically with respect to the first axis.

When the controller controls the drive unit 8 so that the second laundry tub 10 is rotated and is aligned at a first rotation position, the water discharged from the main dispenser 16 can be supplied into the container 30 through a gap formed between the second section S2 and the inner peripheral surface of the balancer 20.

When the controller controls the drive unit 8 so that the second laundry tub 10 is aligned at a second rotation position rotated by a predetermined angle from the first rotation position, the water discharged from the main dispenser 16 is supplied to the sub dispenser 70 through the water supply port 51*h*. That is, in the second laundry tub 10, the water supply port 51*h* is aligned with the outlet of the main dispenser 16 at the second rotation position, and thus, the water discharged through the outlet flows into the water supply port 51*h*. In the present embodiment, the second rotation position is a position at which the first laundry tub 6 is rotated by 90° from the first rotation position. However, when the position of the water supply port 51*h* is changed according to an embodiment, the angle between the second rotation position and the first rotation position may be changed. As described above, since the washing motor is capable of controlling the speed, the controller can control a rotation angle of the first laundry tub 6 or a rotation position of the first laundry tub 6 based on the speed of the washing motor. The second laundry tub 10 is rotated integrally with the first laundry tub 6, and thus, controlling the rotation angle or rotation position of the first laundry tub 6 is also to control the rotation angle or rotation position of the second laundry tub 10.

Specifically, the water tank cover 14 may include a first hall sensor (hall sensor, not illustrated), and the second laundry tub 10 may include a first magnet. While the second laundry tub 10 is rotated, the first hall sensor may be configured to detect a magnetic field formed by the first magnet and send a signal to the controller based on the detected magnetic field. Based on the received signal, the controller can determine a rotation speed, a rotational position (or position of the first magnet), a rotation angle, or the like of the second laundry tub 10, and based on these, the controller can control the washing motor so that the first laundry tub 6 is aligned with the first rotation position or the second rotation position.

Meanwhile, a second magnet may be further provided in a rotor of the washing motor, and a second hall sensor for detecting a magnetic field generated by the second magnet may be disposed in a fixed structure (for example, a bottom surface of the water tank 4) near the second magnet. A plurality of second magnets may be disposed along a periphery of the rotor. The controller may control the washing motor based on a signal output from the second hall sensor, and in this case, by together considering the signal output from the first hall sensor, the controller may control the second laundry tub 10 so that the second laundry tub 10 is aligned with the first rotation position or the second rotation position.

Meanwhile, according to an embodiment, the rotation angle of the rotor may be detected without a separate sensor. That is, the controller can detect a rotation angle of the rotor in a sensor-less manner. For example, after a phase current having a constant frequency phase current flows through the washing motor, a position of the rotor of the washing motor can be estimated based on an output current detected while the current having the constant frequency flows through the washing motor. This sensor-less method is a known technique, and thus, detailed descriptions thereof are omitted.

Meanwhile, after the supply of the water into the container 30 is completed, the controller controls the drive unit 8 according to a preset algorithm to perform the washing. Thereafter, the water used for washing must be discharged from the second laundry tub 10, and this discharging is performed using a centrifugal force caused by the high-speed rotation of the second laundry tub 10.

Specifically, referring to FIG. 19, the lower cover 40 includes the inlet 452*h* into which the water raised in the container 30 by the centrifugal force when the second laundry tub 10 is rotated flows and an outlet 431 through which the water flowing in through the inlet 452*h* is discharged. Although omitted in FIG. 12, as illustrated in FIG. 2, a nozzle 62 may be inserted into the outlet 431.

The lower cover 40 may include a bottom portion 452 in which inlet 452*h* is formed and a side wall portion 43*a* which extends upward from the bottom portion 452 and has the outlet 431. The lower cover 40 includes a first upper surface portion 41 in which a first opening portion 40*h* is formed, a first inner wall portion 42 which extends downward from the first upper surface portion 41 around the first opening portion 40*h*, and an outer wall portion 43 which extends along an outer periphery of the first upper surface portion 41.

A portion of the first upper surface portion 41 is recessed to form a groove portion 45, and in this case, the bottom portion 452 constitutes a bottom surface of the groove portion 45. The side wall portion 43*a* is included in the outer wall portion and constitutes an outside inner peripheral surface 451 of the groove portion 45. The first inner wall portion 42 may include an opening portion 42*h* for installing the dispenser 70.

Referring to FIGS. 16, 19, and 20, the lower cover 40 may include an inner handle 410 which is formed between the groove portion 45 and the first opening portion 40*h*. One side surface of the inner handle 410 may be formed by the first inner wall portion 42, and in this case, the one side surface defines the first opening portion 40*h*. The opening portion 42*h* for installing the dispenser 70 is formed on one side surface, and the opening portion 42*h* is formed to be higher than the dispenser 70. Accordingly, a user grasps the handle 61, a space through which a finger of the user passes through is formed between the dispenser 70 and the inner handle 410.

Meanwhile, the groove portion 45 includes an inside inner peripheral surface 453 which is formed at a position spaced apart radially from the outside inner peripheral surface 451. The inside inner peripheral surface 453 extends upward from a bottom of the groove portion 45 on a side opposite to the outside inner peripheral surface 451.

Both ends of the inside inner peripheral surface 453 are connected to the outside inner peripheral surface 451 by groove inner surfaces 454 and 455. Accordingly, an inner side surrounded by the inside inner peripheral surface 453, the first groove inner surface 454, the second groove inner surface 455, and the outside inner peripheral surface 451 is a region defined by the groove portion 45.

An inclined surface 456 may extends radially inward from an upper end of the inside inner peripheral surface 453. Preferably, the inclined surface 456 is in contact with a bottom surface of the flow guide 52 so that water does not enter a gap between the inclined surface 456 and the flow guide 52 of the upper cover 50 to be described later.

The inside inner peripheral surface 453 is connected to the outer wall portion 43 by a pair of partition walls 47 and 48. Preferably, a locking member 81 described later comes into contact with the inside inner peripheral surface 453 by a restoring force of a spring 82 at an unlock position (that is, a position of the locking member 81 in a state where the second laundry tub 10 is stopped).

The upper cover 50 may include the second opening portion 50*h*, a second upper surface portion 51 in which the water supply port 51*h* is formed, and a second inner wall portion 53 which extends downward from the second upper surface portion 51 around the second opening portion 50*h*. The water supply portion 51*h* is located radially outside the second opening portion 50*h*.

The second upper surface portion 51 may include an outer handle 510 which is formed between the water supply port 51*h* and the second opening portion 50*h*. The outer handle 510 may include a handle upper surface portion 511 which is included in the second upper surface portion 51, a first handle side surface portion 512 which extends downward from the handle upper surface portion 511 around the second opening portion 50*h* and is included in the second inner wall portion 53, and a second handle side surface portion 513 which extends downward from the handle upper surface portion 511 around the water supply port 51*h*. That is, a "U" shaped groove which is open downward is formed by the handle upper surface portion 511, the first handle side surface portion 512, and the second handle side surface portion 513.

The inner handle 410 is inserted into the "U" shaped groove. The user can grasp the inner handle 410 and the outer handle 510 together, and thus, when the second laundry tub 10 is lifted, the upper cover 50 and the lower cover 40 are not separated from each other.

In order to more securely couple the inner handle 410 and the outer handle 510 with each other, a hook (not illustrated) may be formed in any one of the inner handle 410 and the outer handle 510, and an engagement groove (not illustrated) with which the hook engages may be formed in the other.

Meanwhile, the second inner wall portion 53 of the upper cover 50 may include an opening portion 53*h* at a position corresponding to the opening portion 42*h* of the lower cover 40. The first handle side surface portion 512 of the outer handle 510 may be formed by the second inner wall portion 53, and in this case, the first handle side surface portion 512 defines the second opening portion 50*h*.

A height of the opening portion 53*h* is determined by a lower end of the first handle side surface portion 512. The lower end of the first handle side surface portion 512 may be located at the substantially same height as that of a lower end of the second handle side surface portion 513.

Meanwhile, in the upper cover 50, the flow guide 52 may extend around the water supply portion 51*h*, particularly, from a section located on a side opposite to the second handle side surface portion 513. That is, the flow guide 52 extends from the second upper surface portion 51 at a position spaced outward along the radial direction from the second handle side surface portion 513. The flow guide 52 extends gradually downward as it goes inward along the radial direction from the second upper surface portion 51.

Meanwhile, referring to FIG. 19, the laundry tub cover 60 includes the channel FP which is formed from the inlet 452*h* to the outlet 431. When the second laundry tub 10 is rotated, in the container 110, a water flow which is developed outward along the radial direction by the centrifugal force is raised along the inner surface of the container 110. The raised water flow flows into the channel FP through the inlet 452*h*, and then, is discharged through the outlet 431. As described above, the inlet 452*h* and the outlet 431 are formed in the lower cover 40, the upper cover 50 is coupled to the lower cover 40, and thus, the channel FP is defined.

The channel FP may be defined as a region formed by the bottom portion 452 of the lower cover 40, the outer wall portion 43, and the first inner wall portion 42. The water which has flowed into the channel FP through the inlet 452*h* is raised along the inner surface (that is, outside inner peripheral surface 451) of the side wall portion 43*a* and is discharged through the outlet 431. In this case, residual water which is not discharged through the outlet 431 cannot be raised any more by the bottom surface of the upper cover 50. When capacity of the channel FP is sufficient, since most of the water in the channel FP is compressed to the outer inner peripheral surface 451 by centrifugal force, the water flow reaching the inside inner peripheral surface 453 is substantially not generated.

Therefore, according to an embodiment, the inside inner peripheral surface 453 may not contribute to the role of defining the channel (FP).

The lower cover 40 may further include a check valve 91 which opens or closes the inlet 452*h*. The check valve 91 may be configured to be opened or closed by the centrifugal force caused by the rotation of the second laundry tub 10, or by hydraulic pressure.

The check valve 91 may be disposed in the groove portion 45. A bottom surface of the check valve 91 is in close contact with an upper surface (that is, bottom surface of the groove portion 45) of the bottom portion 452, an outer end 91*a* of the check valve 91 is fixed to the bottom portion 452, and an inner end 91*b* radially located inside the outer end 91*a* is pivotable based on the outer end 91*a*. A rib (not illustrated) which presses the upper surface of the check valve 91 so that the outer end 91*a* is fixed may protrude from the bottom surface of the upper cover 50.

The check valve 91 may be formed of a material having some elasticity such as rubber. In this case, the check valve 91 is pivoted by a pressure of the water flow passing through the inlet 452 and a moment caused with the outer end 91*a* as an operating point by the centrifugal force to open the inlet 452, and when the second laundry tub 10 is stopped or deaccelerated, the check valve 91 is returned to the original position by the own weight and a restoring force of the material to close the inlet 452*h*.

However, the present disclosure is not limited to this. According to an embodiment, the outer end 91*a* is rotatably connected to the bottom portion 452, the check valve 91 can pivot about a portion connecting the outer end 91 to the bottom portion 452, and in this case, the check valve 91 may be formed of a material which does not have elasticity.

A washing course using the second laundry tub 10 may include a washing process and a drainage process. Preferably, the rotation speed of the second laundry tub 10 in the washing process is set so that the water flow in the container 30 does not reach the inlet 452*h*. In this case, the rotation speed of the second laundry tub 10 may be different according to the water level in the container 30. However, according to an embodiment, during the washing process, when a quantity of the water supplied to the container 30 is always constant, the rotation speed of the second laundry tub 10 when the water flow starts to reach the inlet 452*h* can be determined by experiment based on a case where a laundry having a preset quantity (that is, an input amount to guide the user through a product manual, or the like) is input, and the controller can control the rotation speed of the second laundry tub 10 in the washing process so that the rotation speed does not exceed the determined rotation speed.

Alternatively, even when the water flow raised in the container 30 reaches the inlet 452*h*, the rotation speed of the second laundry tub 10 during the washing process can be controlled within a range which does not reach an extent in which the water pressure applied through the inlet 452*h* overcomes the moment applied in a direction in which the check valve 91 is closed by the own weight.

Referring to FIGS. 14 and 18 to 20, the laundry treatment machine according to the embodiment of the present disclosure includes the locker 80 which is provided in the second laundry tub 10 and fixes the second laundry tub 10 so that the second laundry tub 10 is not removed from the first laundry tub 6 while the second laundry tub 10 is rotated. The locker 80 may be provided in the lower cover 40.

The locker 80 includes a locking member 81 and an elastic member 82. The locking member 81 is located at the first position (refer to (a) of FIG. 20, hereinafter, may be referred to as an "unlock position") in a state where the second laundry tub 10 is stopped, and is moved from the first position to the second position (refer to (b) of FIG. 20, hereinafter, may be referred to as a "lock position") by the centrifugal force when the second laundry tub 10 is rotated. The lock position is radially outside the unlock position.

The locking member 81 engages with the first laundry tub 6 at the lock position to fix the second laundry tub 10 to the first laundry tub 6. A straight line (that is, moving line of the locking member 81) connecting the unlock position to the lock position may intersect the first sections S1 (refer to FIG. 13).

The balancer 20 may include a locking groove 224 into which the locking member 81 is inserted at the lock position. The locking groove 22*r* may be formed in an inner diameter portion of the balancer body 21. When the second laundry tub 10 is mounted on the ring-shaped balancer 20 and is rotated at a predetermined speed or more in a state of being aligned at a preset rotation position, the locking member 81 is moved outward by the centrifugal force along the radial direction to reach the lock position, and in this process, the locking member 81 is inserted into the locking groove 22*r*. Even when the second laundry tub 100 is shaken or vibrated during the rotation thereof, since the locking member 81 and the locking groove 22*r* engage with each other, the second laundry tub 100 is prevented from being removed. In particular, the second laundry tub 10 is restrained from being moved upward, and thus, a problem that the second laundry tub 10 impacts the top cover 3 or a door (not illustrated) does not occur. Even when the second laundry tub 10 is rotated at a high speed (for example, a dehydration process), it is possible to prevent the machine from being damaged and prevent an accident.

The locking of the second laundry tub 10 is not performed by a separate power mechanism (for example, a motor), and the locking is performed by the centrifugal force caused by the rotation of the second laundry tub 10. Accordingly, it is possible to simply configure a structure for the lock and it is not necessary to take a special control for the lock.

The elastic member 82 is elastically deformed when the locking member 81 is located at the lock position, and when the rotation of the second laundry tub 100 is stopped, the elastic member 82 is restored to an original shape and returns the locking member 81 to the first position. When the rotation of the second laundry tub 10 is stopped, the locking member 81 is returned to the unlock position by a restoring force of the elastic member 82, and thus, the lock is automatically released. When the washing is completed, since the lock is automatically released, the second laundry tub 10 can be easily lifted without the user having to perform a separate operation for releasing the lock.

The elastic member 82 may be a coil spring which is compressed when the locking member 81 is moved from the unlock position to the lock position. The locking member 81 may include a spring mount 81*b* which is elastically supported by the spring 82 and a head 81*a* which protrudes from the spring mount 81*b*. The spring mount 81*b* may include spring fixing protrusions 81*c* and 81*d* which are formed at respective portions protruding toward both sides based on the head 81*a*, and the pair of springs 82 may be fitted into the fixing protrusions 81*c* and 81*d*. That is, one end of the spring 82 is located on an inner surface (that is, outside outer peripheral surface 451) of the outer wall portion 43, and the other end thereof can elastically support the spring mount 81*b*. A pair of protrusions (435*a* and 435*b*, refer to FIG. 22) protrudes from the outside inner peripheral surface 451 of the groove portion 45, and one end of the spring 82 may be fitted into the protrusions 435*a* and 435*b*.

The locking member 81 is in contact with the inside inner peripheral surface 453 of the groove portion 45 by the restoring force of the spring 82 at the unlock position. The locking member 81 is not shaken and can be stably maintained at the unlock position.

Referring to FIGS. 9 and 18, the lower cover 40 may include a first through portion 432 formed in the outer wall portion 43. The head 81*a* may be located in the first through portion 432. Preferably, even when the locking member 81 is located at any point between the unlock position and the lock position, the head 81*a* is always located in the first through portion 432.

Meanwhile, the container 30 may include a container body 31 and a rim portion 32 (refer to FIGS. 2 and 19) which is formed on an upper end portion of the container 31 and surrounds the outer wall portion 43 outside the lower cover 40. The rim portion 32 may be formed on the upper end of the container body 31, that is, along around the opening portion of the upper surface of the container 30. The rim portion 32 may include a second through portion 32*h* formed to communicate with the first through portion 432. The head 81*a* passes through the second through portion 32*h* and protrudes to the outside of the second laundry tub 10.

The head 81*a* may include an insertion portion 811 which is inserted into the locking groove 22*r* and an engagement portion 812 which connects the insertion portion 811 and the spring mount 81*b* to each other and of which a portion connected to the spring mount 81*b* has a cross-sectional area larger than a passage area of the first through portion 432. The insertion portion 811 can pass through the first through portion 432. However, the engagement portion 812 cannot pass through the first through portion 432.

A cross section of the head 81*a* taken along a plane orthogonal to a longitudinal direction (that is, the moving line of the locking member 81) is rectangular. In the first through portion 432, an outlet located on an outer surface of the outer wall portion 43 may be formed to correspond to a cross section of the insertion portion 811, and an inlet located on the inner surface of the outer wall portion 43 may be formed to correspond to a cross section of the engagement portion 812. The engagement portion 812 may include a first inclined surface (812*a*, refer to FIG. 20) which gradually descends from a portion connected to the spring mount 81*b* to the insertion portion 811 side, and a second inclined surface 432*a* corresponding to the first inclined surface 821*a* may be formed between the inlet and the outlet of the first through portion 432.

The lower cover 40 includes the pair of partition walls 47 and 48. A space SP in which the locker 80 is accommodated is provided between the pair of partition walls 47 and 48. The space SP is separated from the channel FP by the pair of partition walls 47 and 48. Each of the pair of partition walls 47 and 48 may extends from the bottom portion 452 to the outer wall portion 43. Moreover, each of the pair of partition walls 47 and 48 is connected to the inside inner peripheral surface 453. That is, the space SP is surrounded by the outer wall portion 43, the pair of partition walls 47 and 48, and the inside inner peripheral surface 453 and an upper surface of the space SP is open. However, the upper surface is again closed by a bottom surface of the upper cover 50.

In particular, upper ends of the pair of partition walls 47 and 48 are in close contact with the bottom surface of the upper cover 50, and thus, the water in the channel FP is prevented from flowing into the space SP over the partition walls 47 and 48. The bottom surface of the flow guide 52 may be in close contact with the upper ends of the pair of partition walls 47 and 48.

According to an embodiment, a sealer (not illustrated) for sealing between the upper ends of the pair of partition walls 47 and 48 and the bottom surface of the upper cover 50 may be provided to more reliably maintain tightness between the partition walls 47 and 48 and the upper cover 50. The sealer may be formed of a soft material (for example, rubber) and may be interposed between the pair of partition walls 47 and 48 and the bottom surface of the upper cover 50. In this case, one surface is pressed by the partition walls 47 and 48, and a surface opposite to the one surface is pressed by the bottom surface of the upper cover 50.

FIG. 21(*a*) illustrates a lower cover according to another embodiment of the present disclosure and FIG. 21(*b*) illustrates a portion of a bottom surface of an upper cover. FIG. 22 is a view when a portion of FIG. 21 indicated by E is viewed from above. Hereinafter, the same reference numerals are assigned to the same configuration of the above-described embodiment, descriptions thereof are the same as those described above, and thus, the descriptions are omitted.

Referring to FIGS. 21 and 22, the upper cover 50 may further include a pair of first ribs 514*a* and 514*b* protruding from the bottom surface. The first partition wall 47 may be inserted between the pair of first ribs 514*a* and 514*b*. Preferably, a gap between the first ribs 514*a* and 514*b* is slightly wider (preferably, 2 mm or less) than a thickness of the first partition wall 47. A pair of second ribs 515*a* and 515*b* is further formed, and the second partition wall 48 may be inserted therebetween.

The pair of first ribs 514*a* and 514*b*, the first partition wall 47 interposed therebetween, the pair of second ribs 515*a* and 515*b*, and the second partition wall 48 interposed therebetween form labyrinth seals. Accordingly, even when the bottom surface of the upper cover 50 is not in close contact with the upper ends of the ribs 514*a*, 514*b*, 515*a*, and 515*b*, the water dose not easily flow into the space SP.

FIG. 23 is a side cross-sectional view of a laundry treatment machine according to still another embodiment of the present disclosure. FIG. 24 is a perspective view of a second laundry tub illustrated in FIG. 23. FIG. 25 is an exploded perspective view of the second laundry tub illustrated in FIG. 24. FIG. 26 is a perspective view illustrating a laundry tub cover illustrated in FIG. 25. FIG. 27 is a perspective view illustrating a state where the second laundry tub illustrated in FIG. 24 is installed in a balancer. FIG. 28 is a view when an assembly illustrated in FIG. 27 is viewed from above. FIG. 29 is a cross-sectional view taken along line F-F of FIG. 28 and illustrates a state where a locking member is located at a first position. FIG. 30 is a cross-sectional view taken along line G-G of FIG. 29. FIG. 31 is a view when an upper cover illustrated in FIG. 25 is viewed from above. FIG. 32 is a view illustrating a state where the upper cover illustrated in FIG. 31 and a container is separated from each other. FIG. 33 is a view illustrating a state where a locker is installed in the upper cover illustrated in FIG. 25 and, in particular, illustrates a state where the locker is disposed between a pair of partition walls. FIG. 34 is a cross-sectional view taken along line H-H of FIG. 33. FIG. 35 is an enlarged view of a portion of FIG. 29, (a) illustrates a state where the locking member is located at a first position and (b) illustrates a state where the locking member is located at a lock position. FIG. 36 is a block diagram illustrating a control relationship between main components of the laundry treatment machine according to an embodiment of the present disclosure. Hereinafter, the laundry treatment machine according to the embodiment of the present disclosure will be described with reference to FIGS. 23 to 36.

Referring to FIG. 23, a cabinet 2 forms an external appearance of the laundry treatment machine, and a space in which a water tank 4 is accommodated is formed in the cabinet 2. The cabinet 2 is supported by a flat cabinet base 5, the cabinet 2 may include a front surface, a left surface, a right surface, and a back surface, and an upper surface of the cabinet 2 is open.

A top cover 3 may be coupled to an open upper surface of the cabinet 2. The top cover 3 may include an opening portion for input and withdrawal of laundry. A door (not illustrated) which opens and closes the opening portion may be rotatably coupled to the top cover 3.

The water tank 4 is for storing water, and can be suspended in the cabinet 2 by a support rod 15. The support rod 15 may be provided in each of four corners of the cabinet 2, one end of each support rod 15 is pivotally connected to the top cover 3, and the other end thereof is connected to the water tank 4 by a suspension 27 for dampening vibrations.

The water tank 4 has an open upper surface, and a water tank cover 14 may be provided on the opened upper surface. The water tank cover 14 is formed in a ring shape in which a substantially circular opening portion is formed in a central portion, and the laundry is input through the opening portion.

A first laundry tub 6 which accommodates the laundry and rotates about a vertical axis may be disposed in the water tank 4. The vertical axis is substantially perpendicular to the ground. The vertical axis may be precisely aligned on a line perpendicular to the ground. However, the vertical axis is not limited thereto, and the vertical axis may be inclined at a predetermined angle with respect to a vertical line. In the first laundry tub 6, a plurality of through holes 6*h* through which water passes may be formed, and water may flow between the first laundry tub 6 and the water tank 4 through the through holes 6*h*.

The first laundry tub 6 may include a drum 6*a* which has an open upper side and the through holes 6*h* and a ring-shaped balancer 20 coupled to an upper portion of the drum 6*a*. A lower surface of the drum 6*a* may be connected to a rotating shaft of a drive unit 8 by a hub 29.

A pulsator 9 may be rotatably provided in an inner lower portion of the first laundry tub 6. The pulsator 9 may include a plurality of radial wings protruding upward. When the pulsator 9 is rotated, a water flow may be formed by the wings.

The balancer 20 compensates for eccentricity caused when the drum 6*a* rotates. The balancer 20 is coupled to an upper end portion of the drum 6*a*. Referring to FIGS. 27 to 29, the balancer 20 may include a balancer body 21 forming ring-shaped cavities 20*h*1 and 20*h*2. A fluid (for example, salt water) or a plurality of weight bodies (for example, metal spheres) may be inserted into the cavities 20*h*1 and 20*h*2. The annular cavities 20*h*1 and 20*h*2 are concentric cavities. However, a plurality of cavities having different diameters may be formed.

If the drum 6*a* is biased to one side while being rotated, fluids or weights are moved to a side opposite to the biased direction of the drum 6*a* to correct the eccentricity. Various types of the ring-type balancer 20 applied to the laundry treatment machine are already known, and further description will be omitted.

The second laundry tub 10 may be inserted into the space (or, a substantially circular opening portion) defined by the ring-shaped balancer 20, and can be supported by the balancer 20 in the state where the second laundry tub 10 is inserted into the space. The second laundry tub 10 includes a container 30 in which the laundry is contained and a laundry tub cover 60 which covers the container 30. The laundry and water are contained in the container 30, an upper surface of the container 30 is open, and the laundry tub cover 60 covers at least a portion of the opened upper surface. The container 30 may be made of a transparent material so that laundry accommodated inside the container 30 is visible from the outside.

An inner diameter portion (when viewed from above, a portion forming an inner circle of two circles constituting the ring shape) of the balancer body 21 includes a ring-shaped support portion 22 supporting the container 30. A plurality of engagement grooves 22*c* (refer to FIG. 30) extending in the up-down direction are arranged in the support portion 22 along the circumferential direction. Each engagement groove 22*c* may be formed in a spiral shape.

An outer surface of the container 30 may be formed with threads 33 in the form of protrusions which engage with the engagement grooves 22*c* formed on the support portion 22. The thread 33 extends up and down in a shape corresponding to the engagement groove 22*c*. That is, when the engagement groove 22*c* is in the form of a spiral, the thread 33 is also a protrusion extending in a spiral shape. The plurality of threads 33 are arranged along the circumferential direction.

The threads 33 constitute a kind of helical gear, and engage with engagement grooves 22*c* formed in a seating portion 33 of the balancer 20. According to this structure, when the first laundry tub 6 is rotated, the second laundry tub 10 can be rotated integrally with the first laundry tub 6 without being idle. In addition, since this type of coupling between the balancer 20 and the container 30 is also a kind of screw coupling, the coupling between the second laundry tub 10 and the first laundry tub 6 is maintained reliably. In particular, the second laundry tub 10 can be fixed without being lowered by a restraining force (for example, a frictional force acting between engaging surfaces) of the coupling between the thread 33 and the engagement groove 22*c*.

The second laundry tub 10 accommodates the laundry and is provided to be detachable to the first laundry tub 6. That is, the second laundry tub 10 is detachably coupled with the first laundry tub 6. When the first laundry tub 6 is rotated in a state where the second laundry tub 10 is installed, the second laundry tub 10 is also rotated integrally with the first laundry tub 6.

The user may input first laundry into only the first laundry tub 6 in a state where the second laundry tub 10 is not installed, or installs the second laundry tub 10 to input second laundry into the second laundry tub 10.

Referring to FIG. 23, a drive unit 8 for providing power to rotate the first laundry tub 6 and the pulsator 9 may be disposed in the cabinet 2. The drive unit 8 is disposed under the water tank 4 and may be suspended in the cabinet 2 in a state of being coupled with the bottom surface of the water tank 4.

A rotating shaft of the drive unit 8 is always coupled with the pulsator 9, and may be coupled with or decoupled from the first laundry tub 6 according to a switching operation of a clutch (not illustrated). Therefore, when the drive unit 8 is operated in a state where the rotating shaft of the drive unit 8 is coupled with the first laundry tub 6, the pulsator 9 and the first laundry tub 6 are integrally rotated, and when the drive unit 8 is operated in a state where the rotating shaft is disconnected to (separated from) the first laundry tub 6, only the pulsator 9 is rotated in a state where the first laundry tub 6 is stopped.

The drive unit 8 may include a washing motor capable of controlling a speed. The washing motor may be an inverter direct drive motor. A controller (not illustrated) may be configured to include a Proportional-Integral controller (PI controller), a Proportional-Integral-Derivative controller (PID controller), or the like. The controller receives an output value (for example, output current) of the washing motor as an input, and may perform a control based on the received output value so that the rotating speed (or rotation speed) of the washing motor follows the preset target rotating speed (or target rotation speed).

The controller may control not only the washing motor but also all operations of the laundry treatment machine, and it will be understood that a control of each of the components mentioned below is made by the control of the controller.

Meanwhile, the laundry treatment machine may include at least one water supply pipe 11 which guides water supplied from an external water source such as a tap. At least one water supply pipe 11 may include a cold water pipe (not illustrated) receiving cold water from an external water source and a hot water pipe (not illustrated) receiving hot water.

A water supply valve 13 for controlling the water supply pipe 11 may be provided. In a case where a plurality of the water supply pipes 11 are provided, a plurality of the water supply valves 13 are provided, and thus, the water supply pipes 11 are respectively controlled by the water supply valves 13. When the at least one water supply valve 13 is opened under the control of the controller, water is supplied to a main dispenser 16 through the water supply pipe 11 corresponding to the opened water supply valve 13.

The main dispenser 16 supplies an additive acting on the laundry to the water tank 4 together with the water supplied through the water supply pipe 11. The additive supplied by the main dispenser 16 includes a laundry detergent, a fabric softener, bleach, or the like.

Meanwhile, the laundry treatment machine may further include a drainage bellows 19*a* for discharging water from the water tank 4 and a drainage valve 17 for controlling the drainage bellows 19*a*. The drainage bellows 19*a* may be connected to a pump 18. When the drainage valve 17 is opened, the water may be supplied to the pump 18 through the drainage bellows 19*a*. The water which has flowed into the pump 18 is discharged to the outside of the laundry treatment machine through a drainage pipe 19*b* when the pump 18 is operated.

An input port 60*h* through which the laundry is input into the container 30 is formed at a substantially center of the laundry tub cover 60. The laundry tub cover 60 may include a lower cover 40 and an upper cover 50 coupled to an upper side of the lower cover 40. The lower cover 40 may be coupled to an upper end portion of the container 30. The lower cover and the container 30 are made of a synthetic resin material, and are coupled with each other by welding, preferably, thermal welding, more preferably. However, the present disclosure is not limited thereto.

The upper cover 50 and the lower cover 40 may be detachably coupled with each other. The lower cover 40 includes a first opening portion 40*h*, and the upper cover 50 includes a second opening portion 50*h* which communicates with the first opening portion 40*h* and constitutes the input portion 60*h*.

A space in which a locker 80, a check valve 91, and a channel FP to be described later are disposed is provided between the upper cover 50 and the lower cover 40, and if necessary, after the user separates the upper cover 50 from the lower cover 40, the user may maintain or repair the locker 80 or the check valve 91 or clean the channel FP.

The laundry tub cover 60 may include a water supply port 51*h* into which the water discharged from the main dispenser 16 flows. The laundry tub cover 60 includes a sub dispenser 70 which accommodates an additive such as a detergent, bleach, or a fabric softener, and the water supplied from the water supply port 51*h* is supplied to the container 30 together with the additive through the sub dispenser 70. Preferably, the additive is liquid so that the additive can be smoothly discharged through a siphon tube 724 to be described later.

Water is supplied through the water supply port 51*h* multiple times. In this case, all additives are discharged through the siphon tube 724 to be described later during the first water supply. Accordingly, in the subsequent water supply, the water (or, raw water) in which the additive is not dissolved is supplied through the sub dispenser 70.

Meanwhile, when the second laundry tub 10 is rotated at a sufficient speed, the water flow developed outward in the radial direction by the centrifugal force in the container 30 is raised along an inner surface (inner surface of container body 31) of the container 30 and may flow into the laundry tub cover 60 through an inlet 425*h* to be described later. The laundry tub cover 60 includes the channel (FP, refer to FIG. 34) which guides the water flow which has flowed in through the inlet 452*h*).

The laundry tub cover 60 may include a nozzle 62 which discharges the water flow guided along the channel FP to the outside of the laundry tub cover 60. The nozzle 62 may be inserted into an outlet (431, refer to FIG. 19) formed in the lower cover 40 and fixed thereto. The nozzle 62 may include a slit-shaped outlet which extends long along a horizontal direction.

The outlet is open downward from the water tank cover 14. The second laundry tub 10 is rotated at a high speed, and the water discharged through the nozzle 62 may be guided along a bottom surface of the water tank cover 14.

As illustrated in FIG. 27, in a state where the second laundry tub 10 is installed in the balancer 20, the nozzle 62 is located above the balancer 20 (that is, is exposed upward from the balancer 20), and thus, the water discharged through the nozzle 62 does not interfere with the balancer 20 and can reach the water tank 4.

Meanwhile, referring to FIG. 25, a vane 35 extending long in the up-down direction is provided on the inner surface of the container 30. The vane 35 protrudes from the inner surface of the container 30 and may be manufactured of a part separated from the container to be installed in the container 30. After the water flow generated by the rotation of the second laundry tub 10 collides with the vane 35, the water flow is raised, and thus, falls to a center portion of the container 30. A plurality of the vanes 35 may be provided, and, preferably, the plurality of vanes 35 may be disposed symmetrically about a rotation center of the second laundry tub 10. In the present embodiment, a pair of vanes 35 is provided. However, the number of the vanes 35 is not limited.

The laundry tub cover 60 may include a handle 61 which is formed around the input port 60*h*. When the laundry tub cover 60 is viewed downward from above, the input port 60*h* is located on one side based on the handle 61, and the water supply port 51*h* is located on the other side thereof. The handle 61 may be provided in each of both sides of the input port 60*h*, and the water supply port 51*h* may also be provided on the other side of each handle 61, respectively.

The sub dispensers 70 may be provided on both sides of the laundry tub cover 60, respectively. In this case, the laundry detergent or bleach may be supplied through one of the pair of sub dispensers 70, and the fabric softener may be supplied through the other.

The sub dispenser 70 may be provided in the lower cover 40. The sub dispensers 70 may be respectively disposed at positions corresponding to the pair of water supply ports 51*h*. Hereinafter, the pair of sub dispensers 70 is divided into a first sub dispenser 70(1) and a second sub dispenser 70(2), respectively.

According to the rotation position (or rotation angle) of the second laundry tub 10, the water discharged from the main dispenser 16 can be selectively supplied to the first sub dispenser 70(1) or the second sub dispenser 70(2). For example, the rotation position (or rotation angle) of the second laundry tub 10 can be controlled by the controller so that water is supplied to the first sub dispenser (70(1)) during the washing process and water is supplied to the second sub dispenser (70(2)) during the rinse process.

Each sub-dispenser 70 may include a dispenser housing 71, a drawer 72 which is housed to be withdrawn in the dispenser housing 71 and has an opened upper surface, and a drawer cover 73 which covers the opened upper surface of the drawer 72. The drawer cover 73 may be detachably coupled with the drawer 72. The drawer cover 73 includes an opening portion 73*h* through which the water discharged from the main dispenser 16 passes, and the water passing through the opening portion 73*h* is supplied into the drawer 72.

The upper cover 50 may include a flow guide 52 which guides the water flowing in through the inlet 51*h* to the sub dispenser 70. The flow guide 52 forms an inclined surface so that water is guided downward, and the water guided along the inclined surface is guided to the opening portion 73*h* of the drawer cover 73.

The upper cover 50 may include a plate 55 fixed to an upper side of the sub dispenser 70. The plate 55 can be detachable from the upper cover 50. The plate 55 forms a gap 55*h* between a lower end of the flow guide 52 and the plate 55, and the water guided along the flow guide 52 passes through the gap 55*h* and is supplied to the opening portion 73*h* of the drawer cover 73.

The dispenser housing 71 provides a space in which the drawer 72 is accommodated, and can be coupled to the lower cover 40. The dispenser housing 71 may be fixed to the lower cover 40 by fastening members such as screws or bolts.

The drawer 72 is a container having an opened upper surface and the additive is accommodated in the drawer 72. The drawer 72 is coupled to the dispenser housing 71 and this coupling allows the drawer 72 being inserted into the dispenser housing 71 or withdrawn from the dispenser housing 71. In the present embodiment, the drawer 72 is coupled to the dispenser housing 71 in a slidable manner, but is not necessarily limited to thereto. For example, the drawer 72 may be coupled to the dispenser housing 71 in a pivotable manner, that is, may be hinge-coupled to the dispenser housing 71.

Referring to FIG. 29, the drawer 72 may include the siphon tube 724 which protrudes upward from a bottom and the drawer cover 73 may include a siphon cap 732 which covers the siphon tube 724.

An outlet of the siphon tube 724 is formed on the bottom of the drawer 72, and the siphon cap 73 forms a channel having an annular cross section between an outer peripheral surface of the siphon tube 724 and the siphon cap 73. This structure is suitable to supply a liquid additive.

When the water is supplied to the sub dispenser 70 and a water level in the drawer 72 is gradually raised, the water is raised along the channel having an annular cross section, flows into the siphon tube 724 through an inlet of an upper end of the siphon tube 724, and thereafter, is discharged to the container 30 through an outlet on a lower end of the siphon tube 724.

Meanwhile, in order to simultaneously wash the laundry in the first laundry tub 6 and the laundry in the second laundry tub 10, the water is required to be supplied to the first laundry tub 6 in a state where second laundry tub 10 is installed. Hereinafter, how to supply the water to the first laundry tub 6 in the state where the second laundry tub 10 installed will be described.

Referring to FIG. 28, when viewed from above, an outer shape of the second laundry tub 10 may include a first section S1 which is in contact with a support portion 22 of the balancer 20 and a second section S2 which is spaced apart from the support portion 22.

The first section S1 may be located on a first axis (line indicated by F-F) passing through a vertical axis O, and the second section S2 may be located on a second axis Y which passes through the vertical axis O and is orthogonal to the first axis. The first section S1 may be formed on both sides symmetrically with respect to the second axis Y, and the second section S2 may be formed on both sides symmetrically with respect to the first axis.

When the controller controls the drive unit 8 so that the second laundry tub 10 is rotated and is aligned at a first rotation position, the water discharged from the main dispenser 16 can be supplied into the container 30 through a gap formed between the second section S2 and the inner peripheral surface of the balancer 20.

When the controller controls the drive unit 8 so that the second laundry tub 10 is aligned at a second rotation position rotated by a predetermined angle from the first rotation position, the water discharged from the main dispenser 16 is supplied to the sub dispenser 70 through the water supply port 51*h*. That is, in the second laundry tub 10, the water supply port 51*h* is aligned with the outlet of the main dispenser 16 at the second rotation position, and thus, the water discharged through the outlet flows into the water supply port 51*h*. In the present embodiment, the second rotation position is a position at which the first laundry tub 6 is rotated by 90° from the first rotation position. However, when the position of the water supply port 51*h* is changed according to an embodiment, the angle between the second rotation position and the first rotation position may be changed. As described above, since the washing motor is capable of controlling the speed, the controller can control a rotation angle of the first laundry tub 6 or a rotation position of the first laundry tub 6 based on the speed of the washing motor. The second laundry tub 10 is rotated integrally with the first laundry tub 6, and thus, controlling the rotation angle or rotation position of the first laundry tub 6 is also to control the rotation angle or rotation position of the second laundry tub 10.

Specifically, the water tank cover 14 may include a first hall sensor (hall sensor, not illustrated), and the second laundry tub 10 may include a first magnet. While the second laundry tub 10 is rotated, the first hall sensor may be configured to detect a magnetic field formed by the first magnet and send a signal to the controller based on the detected magnetic field. Based on the received signal, the controller can determine a rotation speed, a rotation position (or position of the first magnet), a rotation angle, or the like of the second laundry tub 10, and based on these, the controller can control the washing motor so that the first laundry tub 6 is aligned with the first rotation position or the second rotation position.

Meanwhile, a second magnet may be further provided in a rotor of the washing motor, and a second hall sensor for detecting a magnetic field generated by the second magnet may be disposed in a fixed structure (for example, a bottom surface of the water tank 4) near the second magnet. A plurality of second magnets may be disposed along a periphery of the rotor. The controller may control the washing motor based on a signal output from the second hall sensor, and in this case, by together considering the signal output from the first hall sensor, the controller may control the second laundry tub 10 so that the second laundry tub 10 is aligned with the first rotation position or the second rotation position.

Meanwhile, according to an embodiment, the rotation angle of the rotor may be detected without a separate sensor. That is, the controller can detect a rotation angle of the rotor in a sensor-less manner. For example, after a phase current having a constant frequency phase current flows through the washing motor, a position of the rotor of the washing motor can be estimated based on an output current detected while the current having the constant frequency flows through the washing motor. This sensor-less method is a known technique, and thus, detailed descriptions thereof are omitted.

Meanwhile, after the supply of the water into the container 30 is completed, the controller controls the drive unit 8 according to a preset algorithm to perform the washing. Thereafter, the water used for washing must be discharged from the second laundry tub 10, and this discharging is performed using a centrifugal force caused by the high-speed rotation of the second laundry tub 10.

Specifically, referring to FIG. 34, the lower cover 40 includes the inlet 452*h* into which the water raised in the container 30 by the centrifugal force when the second laundry tub 10 is rotated flows and an outlet 431 through which the water flowing in through the inlet 452*h* is discharged. Although omitted in FIG. 34, as illustrated in FIG. 2, a nozzle 62 may be inserted into the outlet 431.

The lower cover 40 may include a bottom portion 452 in which inlet 452*h* is formed and a side wall portion 43*a* which extends upward from the bottom portion 452 and has the outlet 431. The lower cover 40 includes a first upper surface portion 41 in which a first opening portion 40*h* is formed, a first inner wall portion 42 which extends downward from the first upper surface portion 41 around the first opening portion 40*h*, and an outer wall portion 43 which extends along an outer periphery of the first upper surface portion 41.

A portion of the first upper surface portion 41 is recessed to form a groove portion 45, and in this case, the bottom portion 452 constitutes a bottom surface of the groove portion 45. The side wall portion 43*a* is included in the outer wall portion and constitutes an outside inner peripheral surface 451 of the groove portion 45. The first inner wall portion 42 may include an opening portion 42*h* for installing the dispenser 70.

Referring to FIGS. 31, 34, and 35, the lower cover 40 may include an inner handle 410 which is formed between the groove portion 45 and the first opening portion 40*h*. One side surface of the inner handle 410 may be formed by the first inner wall portion 42, and in this case, the one side surface defines the first opening portion 40*h*. The opening portion 42*h* for installing the dispenser 70 is formed on one side surface, and the opening portion 42*h* is formed to be higher than the dispenser 70. Accordingly, a user grasps the handle 61, a space through which a finger of the user passes through is formed between the dispenser 70 and the inner handle 410.

Meanwhile, the groove portion 45 includes an inside inner peripheral surface 453 which is formed at a position spaced apart radially from the outside inner peripheral surface 451. The inside inner peripheral surface 453 extends upward from a bottom of the groove portion 45 on a side opposite to the outside inner peripheral surface 451.

Both ends of the inside inner peripheral surface 453 are connected to the outside inner peripheral surface 451 by groove inner surfaces 454 and 455. Accordingly, an inner side surrounded by the inside inner peripheral surface 453, the first groove inner surface 454, the second groove inner surface 455, and the outside inner peripheral surface 451 is a region defined by the groove portion 45.

An inclined surface 456 may extends radially inward from an upper end of the inside inner peripheral surface 453. Preferably, the inclined surface 456 is in contact with a bottom surface of the flow guide 52 so that water does not enter a gap between the inclined surface 456 and the flow guide 52 of the upper cover 50 to be described later.

The inside inner peripheral surface 453 is connected to the outer wall portion 43 by a pair of partition walls 47 and 48. Preferably, a locking member 81 described later comes into contact with the inside inner peripheral surface 453 by a restoring force of a spring 82 at an unlock position (that is, a position of the locking member 81 in a state where the second laundry tub 10 is stopped).

The upper cover 50 may include the second opening portion 50*h*, a second upper surface portion 51 in which the water supply port 51*h* is formed, and a second inner wall portion 53 which extends downward from the second upper surface portion 51 around the second opening portion 50*h*. The water supply portion 51*h* is located radially outside the second opening portion 50*h*.

The second upper surface portion 51 may include an outer handle 510 which is formed between the water supply port 51*h* and the second opening portion 50*h*. The outer handle 510 may include a handle upper surface portion 511 which is included in the second upper surface portion 51, a first handle side surface portion 512 which extends downward from the handle upper surface portion 511 around the second opening portion 50*h* and is included in the second inner wall portion 53, and a second handle side surface portion 513 which extends downward from the handle upper surface portion 511 around the water supply port 51*h*. That is, a "U" shaped groove which is open downward is formed by the handle upper surface portion 511, the first handle side surface portion 512, and the second handle side surface portion 513.

The inner handle 410 is inserted into the "U" shaped groove. The user can grasp the inner handle 410 and the outer handle 510 together, and thus, when the second laundry tub 10 is lifted, the upper cover 50 and the lower cover 40 are not separated from each other.

In order to more securely couple the inner handle 410 and the outer handle 510 with each other, a hook (not illustrated) may be formed in any one of the inner handle 410 and the outer handle 510, and an engagement groove (not illustrated) with which the hook engages may be formed in the other.

Meanwhile, the second inner wall portion 53 of the upper cover 50 may include an opening portion 53*h* at a position corresponding to the opening portion 42*h* of the lower cover 40. The first handle side surface portion 512 of the outer handle 510 may be formed by the second inner wall portion 53, and in this case, the first handle side surface portion 512 defines the second opening portion 50*h*.

A height of the opening portion 53*h* is determined by a lower end of the first handle side surface portion 512. The lower end of the first handle side surface portion 512 may be located at the substantially same height as that of a lower end of the second handle side surface portion 513.

Meanwhile, in the upper cover 50, the flow guide 52 may extend around the water supply portion 51*h*, particularly, from a section located on a side opposite to the second handle side surface portion 513. That is, the flow guide 52 extends from the second upper surface portion 51 at a position spaced outward along the radial direction from the second handle side surface portion 513. The flow guide 52 extends gradually downward as it goes inward along the radial direction from the second upper surface portion 51.

Meanwhile, referring to FIG. 34, the laundry tub cover 60 includes the channel FP which is formed from the inlet 452*h* to the outlet 431. When the second laundry tub 10 is rotated, in the container 110, a water flow which is developed outward along the radial direction by the centrifugal force is raised along the inner surface of the container 110. The raised water flow flows into the channel FP through the inlet 452*h*, and then, is discharged through the outlet 431. As described above, the inlet 452*h* and the outlet 431 are formed in the lower cover 40, the upper cover 50 is coupled to the lower cover 40, and thus, the channel FP is defined.

The channel FP may be defined as a region formed by the bottom portion 452 of the lower cover 40, the outer wall portion 43, and the first inner wall portion 42. The water which has flowed into the channel FP through the inlet 452*h* is raised along the inner surface (that is, outside inner peripheral surface 451) of the side wall portion 43*a* and is discharged charged through the outlet 431. In this case, residual water which is not discharged through the outlet 431 cannot be raised any more by the bottom surface of the upper cover 50. When capacity of the channel FP is sufficient, since most of the water in the channel FP is compressed to the outer inner peripheral surface 451 by centrifugal force, the water flow reaching the inside inner peripheral surface 453 is substantially not generated. Therefore, according to an embodiment, the inside inner peripheral surface 453 may not contribute to the role of defining the channel (FP).

The lower cover 40 may further include a check valve 91 which opens or closes the inlet 452*h*. The check valve 91 may be configured to be opened or closed by the centrifugal force caused by the rotation of the second laundry tub 10, or by hydraulic pressure.

The laundry treatment machine according to the present embodiment may perform a washing process in which the second laundry tub 10 is rotated in a state where the water stored in the container 30 is maintained, and a dehydration process in which the water in the container 10 is discharged through the channel FP by the centrifugal force caused by the rotation of the second laundry tub 10. In the dehydration process, the check valve is opened when the second laundry tub 10 is rotated at a preset dehydration rate.

The check valve 91 may be disposed in the groove portion 45. A bottom surface of the check valve 91 is in close contact with an upper surface (that is, bottom surface of the groove portion 45) of the bottom portion 452, an outer end 91*a* of the check valve 91 is fixed to the bottom portion 452, and an inner end 91*b* radially located inside the outer end 91*a* is pivotable based on the outer end 91*a*. A rib (not illustrated) which presses the upper surface of the check valve 91 so that the outer end 91*a* is fixed may protrude from the bottom surface of the upper cover 50.

The check valve 91 may be formed of a material having some elasticity such as rubber. In this case, the check valve 91 is pivoted by a pressure of the water flow passing through the inlet 452 and a moment caused with the outer end 91*a* as an operating point by the centrifugal force to open the inlet 452, and when the second laundry tub 10 is stopped or deaccelerated, the check valve 91 is returned to the original position by the own weight and a restoring force of the material to close the inlet 452*h*.

However, the present disclosure is not limited to this. According to an embodiment, the outer end 91*a* is rotatably connected to the bottom portion 452, the check valve 91 can pivot about a portion connecting the outer end 91 to the bottom portion 452, and in this case, the check valve 91 may be formed of a material which does not have elasticity.

A washing course using the second laundry tub 10 may include the washing process and a drainage process. Preferably, the rotation speed of the second laundry tub 10 in the washing process is set so that the water flow in the container 30 does not reach the inlet 452*h*. In this case, the rotation speed of the second laundry tub 10 may be different according to the water level in the container 30. However, according to an embodiment, during the washing process, when a quantity of the water supplied to the container 30 is always constant, the rotation speed of the second laundry tub 10 when the water flow starts to reach the inlet 452*h* can be determined by experiment based on a case where a laundry having a preset quantity (that is, an input amount to guide the user through a product manual, or the like) is input, and the controller can control the rotation speed of the second laundry tub 10 in the washing process so that the rotation speed does not exceed the determined rotation speed.

Alternatively, even when the water flow raised in the container 30 reaches the inlet 452*h*, the rotation speed of the second laundry tub 10 during the washing process can be controlled within a range which does not reach an extent in which the water pressure applied through the inlet 452*h* overcomes the moment applied in a direction in which the check valve 91 is closed by the own weight.

Referring to FIGS. 29 and 33 to 35, the laundry treatment machine according to the embodiment of the present disclosure includes the locker 80 which is provided in the second laundry tub 10 and fixes the second laundry tub 10 so that the second laundry tub 10 is not removed from the first laundry tub 6 while the second laundry tub 10 is rotated. The locker 80 may be provided in the lower cover 40.

The locker 80 includes a locking unit 85 and an elastic member 82. The locking unit 85 is located at an unlock position (refer to (a) of FIG. 35) in a state where the second laundry tub 10 is stopped, and is moved from the first position to a lock position (refer to (b) of FIG. 35) by the centrifugal force when the second laundry tub 10 is rotated. The lock position is radially outside the unlock position.

The locking unit 85 engages with the first laundry tub 6 at the lock position to fix the second laundry tub 10 to the first laundry tub 6. In particular, the locking unit 85 is moved to the lock position by a centrifugal force caused when the second laundry tub 10 is rotated at a preset dehydration rate, is returned to the unlock position when the rotation of the second laundry tub 10 is stopped, and an engagement between the locking unit 85 and the first laundry tub 6 is released. A straight line (that is, moving line of the locking member 81) connecting the unlock position to the lock position may intersect the first sections S1 (refer to FIG. 28).

A sensor operation unit 97 is provided in the first laundry tub 6 and is provided to be movable between the first position and the second position. A sensor 98 for detecting the sensor operating unit 97 is provided in a predetermined structure which is fixed to an outer side of the first laundry tub 6. The sensor operating unit 97 causes the sensor 98 not to perform sensing at the first position and causes the sensor 98 to perform the sensing at the second position. Hereinafter, the first position is referred to as a "non-sensing position" and the second position is referred to as a "sensing position".

The sensor operating unit 97 can activate a signal detected by the sensor 98 according to a position of the sensor operating unit 97. For example, the sensor operating unit 97 may include a magnet (this will be described in more detail below) which generates a magnetic force detected by the sensor 98. However, the present disclosure is not limited thereto, and the sensor operating unit 97 may be implemented in various ways such as activating an optical signal or a frequency detected by the sensor 98 at the sensing position or operating a switch for applying a signal to the sensor 98.

The balancer 20 may include a locking groove 224 into which the locking member 81 is inserted at the lock position. The locking groove 22*r* may be formed in an inner diameter portion of the balancer body 21. When the second laundry tub 10 is mounted on the ring-shaped balancer 20 and is rotated at a predetermined speed or more in a state of being aligned at a preset rotation position, the locking member 81 is moved outward by the centrifugal force along the radial direction to reach the lock position, and in this process, the locking unit 85 is inserted into the locking groove 22*r*. Even when the second laundry tub 100 is shaken or vibrated during the rotation thereof, since the locking unit 85 the locking groove 22*r* engage with each other, the second laundry tub 100 is prevented from being removed. In particular, the second laundry tub 10 is restrained from being moved upward, and thus, a problem that the second laundry tub 10 impacts the top cover 3 or a door (not illustrated) does not occur. Even when the second laundry tub 10 is rotated at a high speed (for example, a dehydration process), it is possible to prevent the machine from being damaged and prevent an accident.

The locking/unlocking operation of the locking unit 85 is not necessarily performed only by the centrifugal force. The locking unit 85 may be moved manually by the user. In the embodiment, the locking of the second laundry tub 10 is not performed by a separate power mechanism (for example, a motor), and the locking is performed by the centrifugal force caused by the rotation of the second laundry tub 10. Accordingly, it is possible to simply configure a structure for the lock and it is not necessary to take a special control for the lock.

The elastic member 82 is elastically deformed when the locking unit 85 is located at the lock position, and when the rotation of the second laundry tub 10 is stopped, the elastic member 82 is restored to an original shape and returns the locking unit 85 to the first position. When the rotation of the second laundry tub 10 is stopped, the locking unit 85 is returned to the unlock position by a restoring force of the elastic member 82, and thus, the lock is automatically released. When the washing is completed, since the lock is automatically released, the second laundry tub 10 can be easily lifted without the user having to perform a separate operation for releasing the lock.

The elastic member 82 may be a coil spring which is compressed when the locking unit 85 is moved from the unlock position to the lock position. The locking unit 85 may include a spring mount 81*b* which is elastically supported by the spring 82 and a head 81*a* which protrudes from the spring mount 81*b*. The locking unit 85 may be provided in a locking member 81 to be described later.

The spring mount 81*b* may include spring fixing protrusions 81*c* and 81*d* which are formed at respective portions protruding toward both sides based on the head 81*a*, and the pair of springs 82 may be fitted into the fixing protrusions 81*c* and 81*d*. That is, one end of the spring 82 is located on an inner surface (that is, outside outer peripheral surface 451) of the outer wall portion 43, and the other end thereof can elastically support the spring mount 81*b*. A pair of protrusions 435*a* and 435*b* protrudes from the outside inner peripheral surface 451 of the groove portion 45, and one end of the spring 82 may be fitted into the protrusions 435*a* and 435*b*.

The locking unit 85 is in contact with the inside inner peripheral surface 453 of the groove portion 45 by the restoring force of the spring 82 at the unlock position. The locking member 81 is not shaken and can be stably maintained at the unlock position.

The locking unit 85 includes the locking member 81 which is movable between the locking position and the unlock position, and the first magnet which is provided in the locking member 81. Moreover, the sensor operating unit 97 may include a second magnet 97 which applies a repulsive force between the first magnet 96 and the second magnet 97.

The second magnet 97 can be moved by the repulsive force applied from the first magnet 96. A raising/lowering guide 20*s* for guiding the movement of the second magnet 97 is formed in the second laundry tub 10. When the first magnet 96 approaches a certain distance from the second magnet 97, the repulsive force is sufficient to move the second magnet 97. The raising/lowering guide 20*s* guides the second magnet 97 so that the second magnet 97 is gradually raised when the second magnet 97 moves away from the first magnet 96.

The raising/lowering guide 20*s* is a space in which the second magnet 97 is accommodated and may be a space which is gradually raised radially outward. In this case, the second magnet 97 at the second position is located radially outside the first position.

The sensor for detecting the second magnet 97 is disposed in a structure fixed to the outer side of the first laundry tub 6. The fixed structure is a structure independent with respect to the rotation of the first laundry tub 6, and for example, may include the water tank 4, the water tank cover 14, the cabinet 2, or the like.

The sensor may include a switching element which is switched by a magnetic force and outputs a signal. For example, the switching element is configured to include a pair of conductive reeds spaced apart from each other, and when the second magnet 97 approach the switching element within a certain distance, the switching element may output a signal while the pair of reeds come into contact with each other (that is, switched) by magnetic force.

The signal output from the sensor 98 may be transmitted to the controller 94 through wired or wireless communication. However, it is difficult to construct a communication line for wired communication depending on a position at which the sensor 98 is attached. Accordingly, in this case, wireless communication is preferable.

The second magnet 97 is located at the first position (refer to (a) of FIG. 35) where the sensor 98 is insensitive (or non-operated) when the locking member 81 is located at the unlock position. In this state, when the locking member 81 is moved to the lock position, the second magnet 97 is moved along the raising/lowering guide 20*s* by the repulsive force applied from the first magnet 96 and reaches the second position (refer to (b) of FIG. 35), and the sensor 98 is sensed (or operated).

While the locking member 81 maintains the lock position, the second magnet 97 maintains the second position by the repulsive force applied from the first magnet 96. That is, while the second laundry tub 10 is rotated at a dehydration rate, when the locking is normally performed by the locking member 81 (that is, when the locking member 81 is inserted into the locking groove 224), the sensor 98 continuously detects the second magnet 97, and thus, the controller 94 performs a control so that the dehydration process is continued based on the signal output from the sensor 98.

On the other hand, when the locking member 81 is not inserted into the locking groove 22*r* for some reason and the repulsive force of the first magnet 96 for pushing the second magnet 97 is not sufficient, the second magnet 97 cannot move to the second position, and thus, it is not possible to detect the second magnet 97 by the sensor 98. In particular, the second magnet 97 should be raised along the raising/lowering guide 20*s* to move the second position. However, the second magnet 97 cannot be raised to the second position only by the repulsive force generated when the second laundry tub 10 is rotated at the dehydration rate. That is, in an inclination of the raising/lowering guide 20*s*, when not only the centrifugal force applied to the second magnet 97 when the second laundry tub is rotated at the dehydration rate but also the repulsive force applied from the first magnet 96 to the second magnet 97 is added, the second magnet 97 overcomes the inclination and reaches the second position. However, when the repulsive force is not applied and only the centrifugal force is applied (that is, when the second laundry tub 10 is rotated at the dehydration rate in a state where the locking member 81 does not reach the lock position), preferably, the inclination of the raising/lowering guide 20*s* is set to a range within the second magnet 97 does not reach the second position.

Meanwhile, when the second magnet 97 cannot be raised to the second position and the controller 94 does not receive a signal from the sensor 98, the controller 94 determines that the locking by the locking member 81 is not correctly performed, the controller 94 may cause the process not to enter the dehydration process or stop the rotation of the second laundry tub 10 if the process is the dehydration process.

Meanwhile, when the locking member 81 moves from the lock position to the unlock position, the second magnet 97 is lowered from the second position to the first position by the own weight. For example, when the rotation of the second laundry tub 10 is stopped and the locking member 81 is moved to the unlock position, the magnet 96 also is away from the second magnet 97. Accordingly, it is not possible to hold the second magnet 97 at the second position only by the repulsive force applied from the first magnet 96. As a result, the second magnet 97 is lowered along the raising/lowering guide 20*s*, is returned to the first position, and thus, the sensor 98 can no longer detect the second magnet 97. When a signal is no longer received from the sensor 98, the controller 94 can determine that the locking member 81 is normally unlocked. According to an embodiment, when an output means such as a display (not illustrated) or an audio output device (not illustrated) is provided, the controller 94 may perform a control so that a message that the second laundry tub 10 may be taken out is output through the output means.

Referring to FIGS. 23 and 33, the lower cover 40 may include a first through portion 432 formed in the outer wall portion 43. The head 81*a* may be located in the first through portion 432. Preferably, even when the locking member 81 is located at any point between the unlock position and the lock position, the head 81*a* is always located in the first through portion 432.

Meanwhile, the container 30 may include a container body 31 and a rim portion 32 (refer to FIGS. 24 and 34) which is formed on an upper end portion of the container 31 and surrounds the outer wall portion 43 outside the lower cover 40. The rim portion 32 may be formed on the upper end of the container body 31, that is, along around the opening portion of the upper surface of the container 30. The rim portion 32 may include a second through portion 32*h* formed to communicate with the first through portion 432. The head 81*a* passes through the second through portion 32*h* and protrudes to the outside of the second laundry tub 10.

The head 81*a* may include an insertion portion 811 which is inserted into the locking groove 22*r* and an engagement portion 812 which connects the insertion portion 811 and the spring mount 81*b* to each other and of which a portion connected to the spring mount 81*b* has a cross-sectional area larger than a passage area of the first through portion 432. The insertion portion 811 can pass through the first through portion 432. However, the engagement portion 812 cannot pass through the first through portion 432.

A cross section of the head 81*a* taken along a plane orthogonal to a longitudinal direction (that is, the moving line of the locking member 81) is rectangular. In the first through portion 432, an outlet located on an outer surface of the outer wall portion 43 may be formed to correspond to a cross section of the insertion portion 811, and an inlet located on the inner surface of the outer wall portion 43 may be formed to correspond to a cross section of the engagement portion 812. The engagement portion 812 may include a first inclined surface (812*a*, refer to FIG. 35) which gradually descends from a portion connected to the spring mount 81*b* to the insertion portion 811 side, and a second inclined surface 432*a* corresponding to the first inclined surface 821*a* may be formed between the inlet and the outlet of the first through portion 432.

The lower cover 40 includes the pair of partition walls 47 and 48. A space SP in which the locker 80 is accommodated is provided between the pair of partition walls 47 and 48. The space SP is separated from the channel FP by the pair of partition walls 47 and 48. Each of the pair of partition walls 47 and 48 may extends from the bottom portion 452 to the outer wall portion 43. Moreover, each of the pair of partition walls 47 and 48 is connected to the inside inner peripheral surface 453. That is, the space SP is surrounded by the outer wall portion 43, the pair of partition walls 47 and 48, and the inside inner peripheral surface 453 and an upper surface of the space SP is open. However, the upper surface is again closed by a bottom surface of the upper cover 50.

In particular, upper ends of the pair of partition walls 47 and 48 are in close contact with the bottom surface of the upper cover 50, and thus, the water in the channel FP is prevented from flowing into the space SP over the partition walls 47 and 48. The bottom surface of the flow guide 52 may be in close contact with the upper ends of the pair of partition walls 47 and 48.

According to an embodiment, a sealer (not illustrated) for sealing between the upper ends of the pair of partition walls 47 and 48 and the bottom surface of the upper cover 50 may be provided to more reliably maintain tightness between the partition walls 47 and 48 and the upper cover 50. The sealer may be formed of a soft material (for example, rubber) and may be interposed between the pair of partition walls 47 and 48 and the bottom surface of the upper cover 50. In this case, one surface is pressed by the partition walls 47 and 48, and a surface opposite to the one surface is pressed by the bottom surface of the upper cover 50.

What is claimed is:

1. A laundry treatment machine comprising:

a water tank which stores water and has an open upper surface, a first laundry tub which is rotated about a vertical axis in the water tank;

a second laundry tub which is detachably coupled to the first laundry tub, and is rotated integrally with the first laundry tub;

a locking unit which is provided in the second laundry tub and is movable between a lock position at which the locking unit engages with the first laundry tub and an unlock position at which the engagement between the locking unit and the first laundry tub is released;

a sensor operating unit which is disposed in the first laundry tub and is movable between a first position and a second position;

a sensor which is disposed in a predetermined structure fixed outside the first laundry tub and detects the sensor operating unit; and a raising/lowering guide which guides the sensor operating unit so that the sensor operating unit is moved from the first position to the second position while being raised gradually, wherein the sensor operating unit causes the sensor not to perform sensing at the first position and causes the sensor to perform sensing at the second position.

2. The laundry treatment machine according to claim 1, wherein the locking unit moves from the unlock position to the lock position by a centrifugal force when the second laundry tub rotates at a preset dehydration rate.

3. The laundry treatment machine according to claim 1, wherein the sensor operating unit is lowered along the raising/lowering guide by own weight of the sensor operating unit when the locking unit is moved from the lock position to the unlock position.

4. The laundry treatment machine according to claim 1, wherein the locking unit includes a locking member which is provided to be movable between the lock position and the unlock position, and a first magnet which is disposed in the locking member, and the sensor operating unit includes a second magnet which applies a repulsive force between the first magnet and the second magnet.

5. The laundry treatment machine according to claim 1, wherein the raising/lowering guide is a space which accommodates the sensor operating unit and extends to gradually rise outward in a radial direction, and the sensor operating unit at the second position is radially located outside the sensor operating unit at the first position.

6. The laundry treatment machine according to claim 4, wherein in a state where the locking member does not reach the lock position, the second magnet is not raised to the second position when the second laundry tub is rotated at a preset dehydration rate.

7. The laundry treatment machine according to claim 6, wherein a distance between the first magnet and the second magnet in the state where the locking member does not reach the lock position is longer than a distance between the first magnet and the second magnet when the locking member is located at the lock position.

8. The laundry treatment machine according to claim 6, wherein the second laundry tub includes:

a container which accommodates laundry and has an open upper surface; and a laundry tub cover which covers the upper surface of the container and includes an input port through which the laundry is put into the container, and the laundry tub cover includes a channel which guides water raised by a centrifugal force in the container so that the water is discharged to an outside of the second laundry tub when the second laundry tub is rotated by the dehydration rate.

9. The laundry treatment machine according to claim 8, wherein the laundry tub cover includes a lower cover which is coupled to an upper side of the container and includes an inlet through which water raised in the container flows into the channel when the first laundry tub is rotated and an outlet through which the water guided along the channel is discharged, and an upper cover which is coupled to an upper side of the lower cover and defines the channel.

10. The laundry treatment machine according to claim 9, wherein the second laundry tub further includes a check valve which opens or closes the inlet, and the check valve is opened when the second laundry tub is rotated at the dehydration rate.

11. The laundry treatment machine according to claim 8, wherein the laundry treatment machine performs a washing process in which the second laundry tub is rotated in a state where water stored in the container is maintained and a dehydration process in which the water in the container is discharged through the channel by a centrifugal force caused by the rotation of the second laundry tub, and the dehydration rate is a rotation speed of the second laundry tub in the dehydration process.

12. The laundry treatment machine according to claim 4, wherein the first laundry tub includes:

a drum having an upper surface; and a ring-shaped balancer installed on the upper surface of the drum, and the raising/lowering guide is formed in the balancer.

13. The laundry treatment machine according to claim 12, wherein an inner diameter portion of the balancer includes a locking groove into which the locking member is inserted at the lock position.

14. The laundry treatment machine according to claim 1, wherein the sensor is disposed in the water tank.

15. The laundry treatment machine according to claim 1, the laundry treatment machine further includes a ring-shaped water tank cover which is installed on the open upper surface of the water tank, and the sensor is disposed in the water tank cover.

* * * * *